US007793763B2

(12) United States Patent
Zhu et al.

(10) Patent No.: US 7,793,763 B2
(45) Date of Patent: Sep. 14, 2010

(54) SYSTEM AND METHOD FOR DAMPING VIBRATIONS IN ELEVATOR CABLES

(75) Inventors: Weidong Zhu, Elridge, MD (US); Yan Chen, Baltimore, MD (US)

(73) Assignee: University of Maryland, Baltimore County, Baltimore, MD (US)

( * ) Notice: Subject to any disclaimer, the term of this patent is extended or adjusted under 35 U.S.C. 154(b) by 0 days.

(21) Appl. No.: 11/429,243

(22) Filed: May 8, 2006

(65) Prior Publication Data

US 2006/0266591 A1 Nov. 30, 2006

Related U.S. Application Data

(63) Continuation of application No. PCT/US2004/35522, filed on Nov. 15, 2004.

(60) Provisional application No. 60/520,012, filed on Nov. 14, 2003, provisional application No. 60/618,701, filed on Oct. 14, 2004.

(51) Int. Cl.

| | |
|---|---|
| ***B66B 7/06*** | (2006.01) |
| ***B66B 5/00*** | (2006.01) |
| ***B66D 1/00*** | (2006.01) |
| ***B66C 13/06*** | (2006.01) |

(52) U.S. Cl. ..... 187/411; 187/251; 187/345; 187/393; 187/414; 254/277; 212/273

(58) Field of Classification Search ..... 187/264, 187/265, 292, 345, 414, 251, 406, 411, 393–394; 254/272, 277, 392; 248/638, 317; 188/378, 188/65.1, 266–322.5; 74/473.29, 604; 212/273; 182/142, 150; 104/124–127

See application file for complete search history.

(56) References Cited

U.S. PATENT DOCUMENTS

| | | | | | |
|---|---|---|---|---|---|
| 3,991,856 | A | * | 11/1976 | Shigeta et al. | 187/266 |
| 4,079,816 | A | * | 3/1978 | Ohta | 187/414 |
| 4,128,142 | A | * | 12/1978 | Satoh et al. | 187/293 |
| 4,241,814 | A | | 12/1980 | Masclet | |
| 4,553,640 | A | * | 11/1985 | Inaba et al. | 187/292 |

(Continued)

FOREIGN PATENT DOCUMENTS

JP 04049191 A * 2/1992

(Continued)

OTHER PUBLICATIONS

Zhu, W.D.: "Theoretical and Experimental Investigation of Elevator Cable Dynamics and Control," Technicians Committee on Vibration and Sound of ASME, Dec. 9, 2003, entire document.

(Continued)

*Primary Examiner*—John Q Nguyen
*Assistant Examiner*—Stefan Kruer
(74) *Attorney, Agent, or Firm*—Nixon Peabody LLP

(57) ABSTRACT

A vibration damped elevator system is provided that includes a damper or dampers attached to the elevator cable. The damping coefficients of the damper or dampers are chosen to provide optimum dissipation of the vibratory energy in the elevator cable. A method of determining the optimum placement of the damper or dampers and their respective damping coefficients is also provided.

2 Claims, 45 Drawing Sheets

U.S. PATENT DOCUMENTS

| | | | | | |
|---|---|---|---|---|---|
| H00702 | H | * | 11/1989 | Shively et al. | 187/405 |
| 5,025,893 | A | * | 6/1991 | Saito | 187/266 |
| 5,103,937 | A | * | 4/1992 | Robertson | 187/414 |
| 5,289,902 | A | * | 3/1994 | Fujita | 187/346 |
| 5,304,751 | A | | 4/1994 | Skalski et al. | |
| 5,469,937 | A | | 11/1995 | Hakala et al. | |
| 5,533,399 | A | | 7/1996 | Gibson et al. | 73/579 |
| 5,641,041 | A | | 6/1997 | Masuda et al. | |
| 5,811,743 | A | * | 9/1998 | Kohara et al. | 187/393 |
| 5,824,975 | A | | 10/1998 | Hong | |
| 5,947,232 | A | * | 9/1999 | Traktovenko et al. | 187/414 |
| 6,065,569 | A | | 5/2000 | Fuller | |
| 6,234,276 | B1 | | 5/2001 | Wagatsuma et al. | |
| 6,267,205 | B1 | * | 7/2001 | Piech et al. | 187/292 |
| 6,315,084 | B1 | | 11/2001 | Shon | |
| 6,364,063 | B1 | | 4/2002 | Aulanko et al. | |
| 6,431,325 | B1 | | 8/2002 | Bledsoe et al. | |
| 6,464,042 | B2 | | 10/2002 | Risch et al. | |
| 6,907,785 | B1 | | 6/2005 | Gallagher | 73/579 |
| 2002/0179377 | A1 | | 12/2002 | Higaki et al. | |
| 2003/0013541 | A1 | | 1/2003 | Weiss et al. | 473/316 |
| 2005/0072234 | A1 | | 4/2005 | Zhu et al. | 73/579 |

FOREIGN PATENT DOCUMENTS

| | | | | |
|---|---|---|---|---|
| JP | 04189290 | A | * | 7/1992 |
| JP | 5178564 | | | 7/1993 |
| JP | 05178564 | A | * | 7/1993 |
| JP | 06156932 | A | * | 6/1994 |

OTHER PUBLICATIONS

Chi, R.M., et al. "Longitudinal Vibration of a Hoist Rope Coupled With the Vertical Vibration of an Elevator Car." *Journal of Sound and Vibration* 148(1) (1991): 154-159.

Ramallo, J.C., et al. "'Smart' Isolation for Seismic Control." *Fourteenth Engineering Mechanics Conference* (2000):1-6.

Szymanski, Jeff D., et al. "Architectural Acoustics and Musical Acoustics: Recording Studio Acoustics." *145th Meeting: Acoustical Society of America* 113(4) (May 1, 2003): 2273-2321.

Pota, Hemanshu R., et al. "A Flatness Based Approach to Trajectory Modification of Residual Motion of Cable Transporter Systems.":1-11.

Pesterev, A.V., et al. "A New Method for Calculating Bending Moment and Shear Force in Moving Load Problems." ASME 68 (Mar. 2001):252-259.

Chan, Hian-Leng., et al. "Automatic Sensor-Fault Detection System for Comprehensive Structural Health Monitoring System." *IMAC—XXIII* (2005):1-8.

Wang, Yumei. "Control Strategies for 3D Smart Base Isolation Systems Using Modal and Nodal Approaches." *Washington University; Dissertation* (May 2006): 1-176.

Ren, Wei-Xin., et al. "Baseline Finite Element Modeling of a Large Span Cable-Stayed Bridge Through Field Ambient Vibration Tests." Computers and Structures 83 (2005): 536-550.

Li, W.L. "A New Method for Structural Model Updating and Joint Stiffness Identification." *Mechanical Systems and Signal Processing* 16(1) (2002): 155-167.

Lee, Ho-Hoon. "A New Trajectory Control of a Flexible-Link Robot Based on a Distributed-Parameter Dynamic Model." International Journal of Control 77 (Apr. 15, 2004): 546-553.

Lee, Ho-Hoon. "New Dynamic Modeling of Flexible-Link Robots." *Journal of Dynamic Systems, Measurement, and Control* 127 (Jun. 2005):307-309.

Jiang, L.J., et al. "A Sensitivity-Enhancing Control Approach for Structural Model Updating.":1.

Peeters, Bart., et al. "Automotive and Aerospace Applications of the PolyMAX Modal Parameter Estimation Method." *Proceedings of IMAC 22* (2004):1-11.

Olson, Steven E., et al. "Beamforming of Lamb Waves for Structural Health Monitoring." Journal of Vibration and Acoustics: 1-9.

Kaczmarczyk, S., et al. "Prediction of the Influence of Vibration on Structural Integrity of Elevator Suspension Ropes." Proceedings of DAMAS 2005 6th International Conference on Damage Assessment of Structures (Jul. 2005):1-8.

Wetton, R.E., et al. "Comparison of Dynamic Mechanical Measurements in Bending, Tension and Torsion." *ANTEC 89* (May 1989): 1160-1162.

Zhang, Lixin., et al. "Complex Modal Analysis of Non-Self-Adjoint Hybrid Serpentine Belt Drive Systems." Journal of Vibration and Acoustics 123 (Apr. 2001): 150-156.

Grisso, Benjamin Luke. "Considerations of the Impedance Method, Wave Propagation, and Wireless Systems for Structural Health Monitoring." *Virginia Polytechnic Institute and State University; Thesis:* 1-108.

Penzien, Joseph., et al. "Earthquake Engineering for Transportation Structures—Past, Present, and Future." *International Civil Engineering Consultants, Inc.* (1995): 1-34.

Szász, György., et al. "Time Periodic Control of a Bladed Disk Assembly Using Shaft Based Actuation." *Journal of Vibration and Acoustics* 123 (Jul. 2001): 395-411.

Krauss, Ryan W. "Experimental Identification of Nonlinear Systems.":1-53.

Peairs, Daniel M., et al. "Improving Accessibility of the Impedance-Based Structural Health Monitoring Method." *Journal of Intelligent Material Systems and Structures* 15 (Feb. 2004):129-139.

Olson, Colin C., et al. "Improving Excitations for Active Sensing in Structural Health Monitoring via Evolutionary Programming." *University of California* San Diego:1-25.

S. Lall, Stanford. "Least Squares" (2004): 1-31.

Huang, Norden E. "HHT Basics and Applications: For Speech, Machine Health Monitoring, and Bio-Medical Data Analysis." (Mar. 24, 2003):1-28.

Gladwell, Graham M.L., et al. "Inverse Problems in Vibration" *Applied Mechanics Review* 39(7) (Jul. 1986):1013-1018.

Banks, H.T. "Inverse Problems Tutorial:Inverse Problem Methodology in Complex Stochastic Systems." *Statistical and Applied Mathematical Sciences Institute* (Sep. 2002):1-63.

Dippery, Kyle D., et al. "Investigating Model Identification Procedures for Systems With Modal Interactions." *University of Kentucky*:1-12.

Fang, X., et al. "Investigation of Granular Damping in Transient Vibrations Using Hilbert Transform Based Technique." *University of Connecticut*:1-31.

"LMS PolyMAX: A Revolution in Modal Parameter Estimation." *LMS International Brochure*:1-10.

Tomasini, Enrico Primo. "Vibration Measurements by Laser Techniques: Advances and Applications." *The International Society for Optical Engineering* 2358 (Oct. 1994):37-47.

Avitabile, Peter. "Model Updating: Endless Possibilities." *Modal Analysis and Controls Laboratory: University of Massachusetts Lowell* (Feb. 2000):1-9.

Mares, C., et al. "Model Updating Using Robust Estimation." *Mechanical Systems and Signal Processing* 16(1) (2002):169-183.

Cha, P.D., et al. "Model Updating by Adding Known Masses." *International Journal for Numerical Methods in Engineering* 50 (2001):2457-2571.

Ginsberg, Jerry H., et al. "Modern Theoretical and Experimental Modal Analysis." G.W. Woodruff School of Mechanical Engineering: Georgia Institute of Technology. (Nov. 17, 2003):1-65.

Avitabile, Peter. "Experimental Modal Analysis (A Simple Non-Mathematical Presentation)." *Model Analysis and Controls Laboratory: University of Massachusetts Lowell*:1-15.

Siller, Hugo Ramon Elizalde. "Non-Linear Modal Analysis Methods for Engineering Structures." *Department of Mechanical Engineering: Imperial College London/University of London* (Aug. 2004): 1-239.

Kizhner, Semion., et al. "Hilbert-Huang Transform Data Processing System (HHT-DPS)." *NASA Goddard Space Flight Center Hilbert-Huang Transform Advanced Technology Briefing* (Mar. 24, 2003):1-25.

Wu, W.-T., et al. "Modal Analysis of the Steady State Response of a Driven Periodic Linear System." *Journal of Sound and Vibration* 183(2) (1995):297-308.

Drexel, M.V. "Modal Overlap and Dissipation Effects of a Cantilever Beam With Multiple Attached Oscillators." *Journal of Vibration and Acoustics* 123 (Apr. 2001):181-187.
Drexel, Michael V., et al. "Mode Isolation: A New Algorithm for Modal Parameter Identification." *Acoustical Society of America* 110(3) (Sep. 2001):1371-1378.
Coffeen, Robert C., "Architectural Acoustics and Engineering Acoustics: Multi-Channel Sound Reinforcement Systems." *145th Meeting: Acoustical Society of America* 113(4) (Apr. 2003):2201-2232.
Huang, Norden E. "Nonstationary and Nonlinear Time Analysis." (Jul. 21, 2004):1-64.
DeMichele, Dominick J., et al. "Proceedings of the 11th International Modal Analysis Conference." *Society for Experimental Mechanics* 1923 (Feb. 1993):286-292.
Leissa, Arthur W. "On a Curve Veering Aberration." *Journal of Applied Mathematics and Physics* 25 (1994):99-111.
Varga, A. "On Computing Generalized Inverse Systems Using Matrix Pencil Methods." *International Journal of Applied Mathematics and Computer Science* 11(2001):1055-1068.
Dohner, Jeffrey L., "White Paper: On the Development of Methodologies for Constructing Predictive Models of Structures with Joints and Interfaces." *Sandia National Laboratories: The Structural Dynamics Department*:1-14.
Lin, R.M., et al. "On the Location of Structural Nonlinearity From Modal Testing—A Feasability Study." *IMAC* 1 (1990):358-364.
Wenzel, Dr. H. "On the Performance and Durability of Stay Cables." Vienna Consulting Engineers:1-11.
Campbell, Richard H. "Architectural Acoustics: Integration of Synthesis Techniques and "Acoustical" Music." *Joint 140th Meeting ASA/NOISE-CON 108*(5) (Nov. 2000):2537-2579.
Electron, J. Diff. Eqns. "Chapter VII: Optimization and Approximation Topics." *Monograph* 01(1994):169-205.
"Chapter 4:Detailed Inspection."(Dec. 1, 2001):1-9.
"Overview of HHT Processing and the HHT-DPS.":1-6.
Behi, Fariborz., et al. "Parametric Identification for Industrial Manipulators Using Experimental Modal Analysis." *IEEE Transactions on Robotics and Automation* 7(5) (Oct. 1991):642-652.
Sugiura, Toshihiko "Parametrically Excited Horizontal and Rolling Motion of a Levitated Body Above a High-*Tc* Superconductor." *IEEE Transactions on Applied Superconductivity* 13(2) (Jun. 2003):2247-2250.
Chung, Chiou-Fong. "The Dynamics Analysis of Nonlinear Vibration System and Modeling of a Rotating System.":1-84.
Ahmadian, H., et al. "Physical Realization of Generic-Element Parameters in Model Updating." Journal of Vibration and Acoustics 124 (Oct. 2002):628-633.
"Polytec Scanning Vibrometer." *Polytec: Theory Manual*:1-1—13-10.
Avitabile, Peter., et al. "Reallocation of System Mass and Stiffness for Achieving Target Specifications." *Modal Analysis and Controls Laboratory:University of Massachusetts Lowell*:1-13.
Drexel, Michael V. "State Space Implementation of the Algorithm of Mode Isolation." *Journal of Vibration and Acoustics* 125 (Apr. 2003):205-213.
Peeters, Bart., et al. "Stochastic System Identification for Operational Modal Analysis: A Review." Journal of Dynamic Systems, Measurement, and Control 123 (Dec. 2001):659-667.
"Advances in Mechanics." *Tsinghua Tongfang Optical Disc Co., Ltd.*34(2) (May 25, 2004):215-223.
Ren, Wei-Xin., et al. "Roebling Suspension Bridge. I: Finite-Element Model and Free Vibration Response." *Journal of Bridge Engineering* (Mar./Apr. 2004):110-118.
Zhou, F.C., et al. "Rolling Element Bearing Fault Early Diagnosis Using Cyclic Bispectrum Analysis.":1-7. http://atlas-conferences.com/c/a/s/c/08.htm.
Mottershead, J.E., et al. "Selection and Updating of Parameters for an Aluminium Space-Frame Model." *Mechanical Systems and Signal Processing* 14(6) (2000):923-944.
Joseph, Daniel D., et al. "Short-Wave Instabilities and Ill-Posed Initial-Value Problems." *Theoretical and Computational Fluid Dynamics* 1 (1990):191-227.
"Singularity and Ill-Conditioning." *Linear Systems*:1-11.
Ginsberg, Jerry H. "Wave-Number-Based Assessment of the Doubly Asymptotic Approximation. I. Frequency Domain Wet Surface Impedance." Acoustical Society of America 107(4) (Apr. 2000):1898-1905.
Ginsberg, Jerry H. "Wave-Number-Based Assessment of the Doubly Asymptotic Approximation. II. Frequency and Time Domain Response." Acoustical Society of America 107(4) (Apr. 2000):1906-1914.
Terumichi, Yoshiaki. "Wear Development on Elastic Rail With Repeated Passage of Disks.":1-15.
Shabana, Ahmed A., "Three Dimensional Absolute Nodal Coordinate Formulation for Beam Elements: Theory." *Journal of Mechanical Design* 123 (Dec. 2001):606-613.
Zhu, X.Q., et al. "Time Domain Identification of Moving Loads on Bridge Deck." *Journal of Vibration and Acoustics* 125 (Apr. 2003):187-198.
Farrar, Charles R., et al. "Structural Health Monitoring at Los Alamos National Laboratory." *Institute of Electrical Engineers Colloquium on Condition Monitoring: Machinery, External Structures and Health* (1999):2/1-2/4.
Schulz, Mark. "Structural Health Monitoring of Aerospace Vehicles." *North Carolina Agricultural and Technical State University* (1999):1-2.
Roitman, N., et al. "Structural Model Adjustment Using Iterative Methods." *Materials and Structures* 36 (Nov. 2003):570-577.
Ying, Ren. "The Analysis and Identification of Friction Joint Parameters in the Dynamic Response of Structures." *Department of Mechanical Engineering: Imperial College Thesis* (Mar. 1992):1-267.
Huang, Norden E., et al. "The Empirical Mode Decomposition and the Hilbert Spectrum for Nonlinear and Non-Stationary Time Series Analysis." *The Royal Society* (1998):903-995.
Capecchi, Danilo., et al. "Monitoring of Structural Systems by Using Frequency Data." *Earthquake Engineering and Structural Dynamics* 28 (1999):447-461.

* cited by examiner

Position (m)
160
120
80
40
0

Velocity (m/s)
0
-2
-4

Acceleration (m/s²)
0.8
0.4
0.0
-0.4
-0.8
0 5 10 15 20 25 30 35
t (s)

Jerk (m/s³)
1.0
0.5
0.0
-0.5
-1.0
1
2
3
4
5
6
7
0 5 10 15 20 25 30 35
t (s)

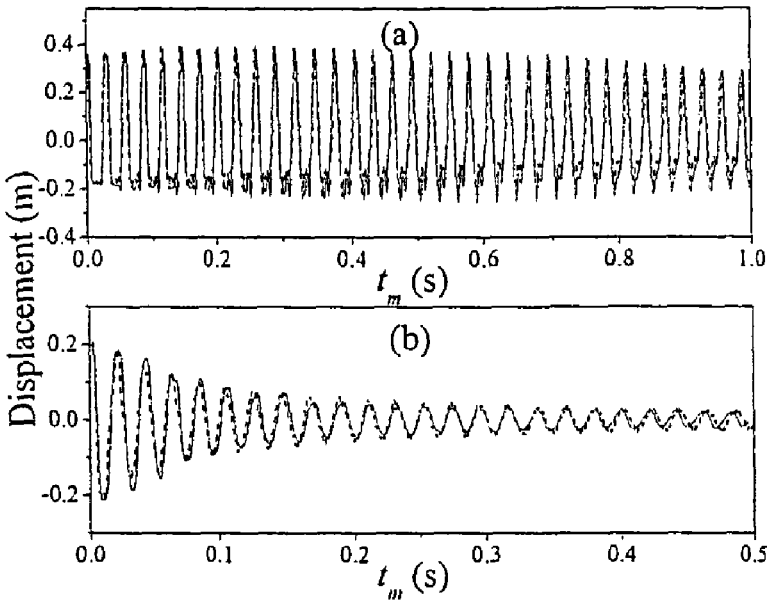
Fig. 27(a)
Fig. 27(b)
Fig. 28(a) Fig. 28(b)
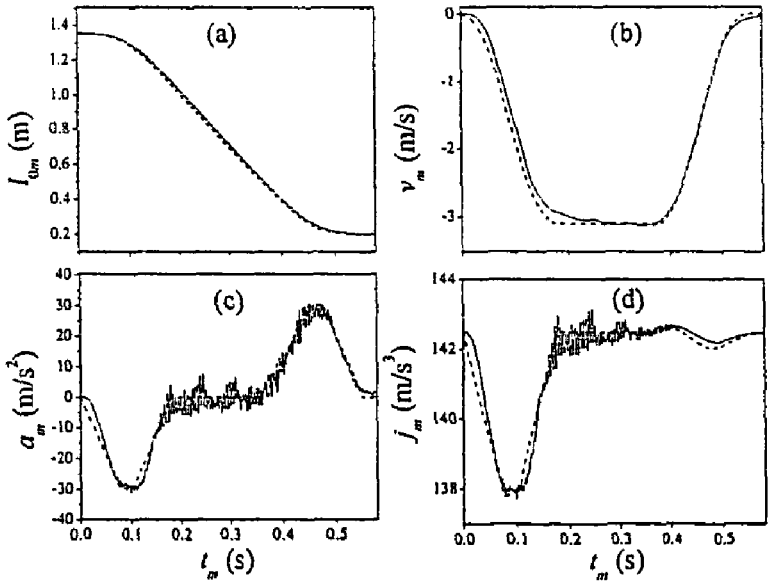
Fig. 28(c) Fig. 28(d)

SYSTEM AND METHOD FOR DAMPING VIBRATIONS IN ELEVATOR CABLES

REFERENCE TO RELATED APPLICATIONS

This application is a Continuation of PCT/US2004/35522 filed Nov. 15, 2004, which claims priority to Provisional U.S. Patent Application No. 60/520,012, filed Nov. 14, 2003, and Provisional U.S. Patent Application No. 60/618,701, filed Oct. 14, 2004, and a Continuation of PCT/US2004/35523 filed Nov. 15, 2004, which claims priority to Provisional U.S. Patent Application No. 60/520,012, filed Nov. 14, 2003 and Provisional U.S. Patent Application No. 60/618,701, filed Oct. 14, 2004.

GOVERNMENT RIGHTS

This invention was made with government support under Award No. CMS-0116425 awarded by the National Science Foundation. The United States government has certain rights in this invention.

BACKGROUND OF THE INVENTION

1. Field of the Invention

The present invention relates to control of vibratory energy in translating media and, more particularly, to a system and method of dissipating or damping vibratory energy in translating media, such as elevator cables.

2. Background of the Related Art

The design of high-rise elevators poses significant challenges. In order to improve the efficiency of high-rise elevators, elevator car speeds are being increased to over 1,000 m/min. Lateral vibrations in the elevator cable pose a major problem that affects ride comfort and can contribute to mechanical and noise problems in the elevator system.

SUMMARY OF THE INVENTION

An object of the invention is to solve at least the above problems and/or disadvantages and to provide at least the advantages described hereinafter.

The present invention provides a vibration damped elevator system that includes a damper or dampers attached to the elevator cable. The damping coefficients of the damper or dampers are chosen to provide optimum dissipation of the vibratory energy in the elevator cable. A method of determining the optimum placement of the damper or dampers and their respective damping coefficients is also provided.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

Figures 1, 1A:
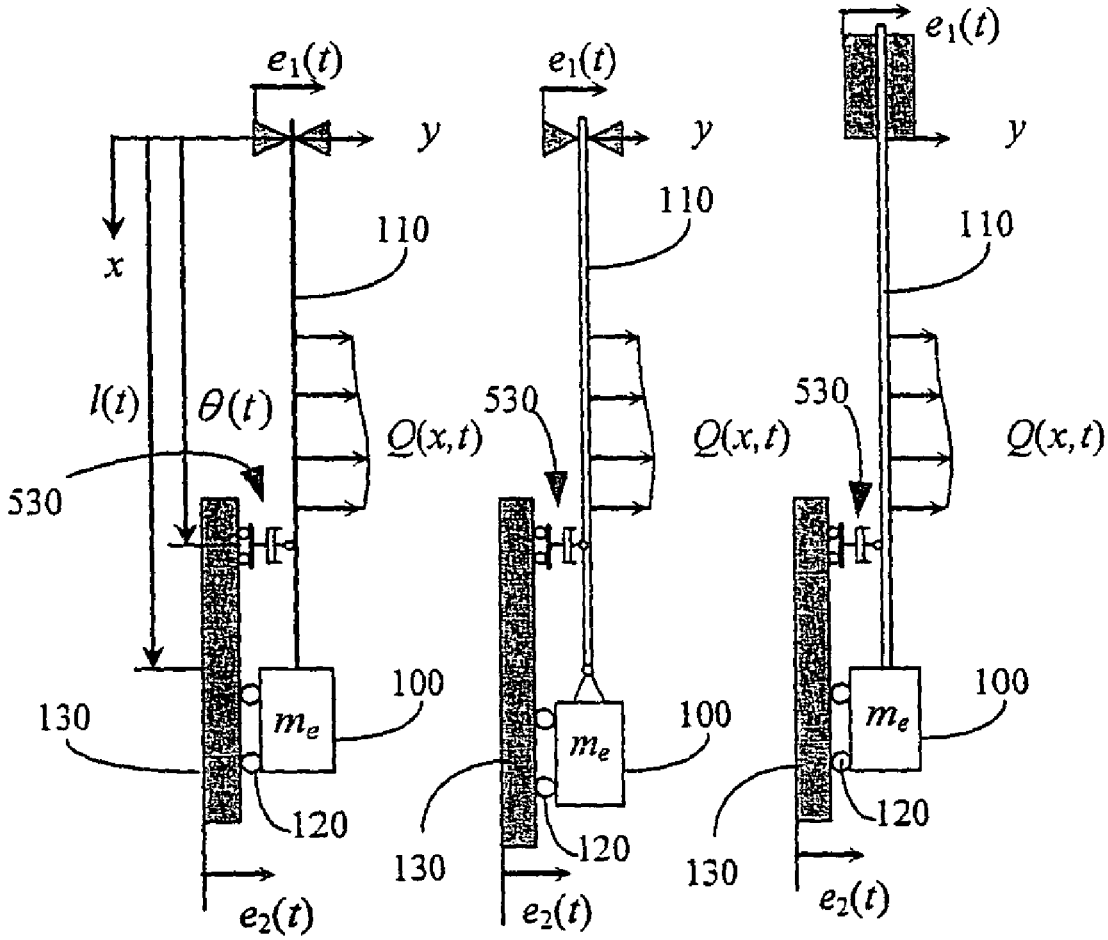
FIGS. 1(*a*)-1(*c*) are schematic diagrams of a vertically traveling hoist cable 110 with a car attached at the lower end for a string model, a pinned-pinned beam model, and a fixed-fixed beam model, respectively.
Figures 5A, 5B, 5C:
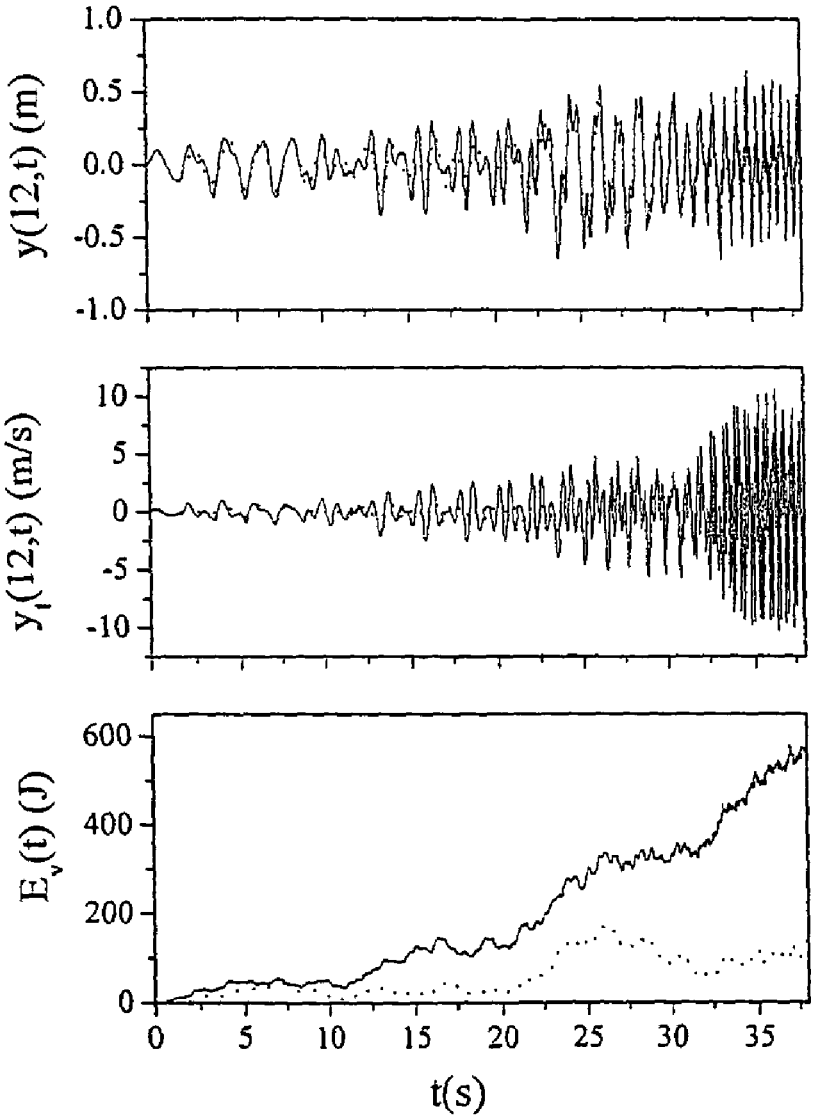
Figures 6A, 6B, 6C:
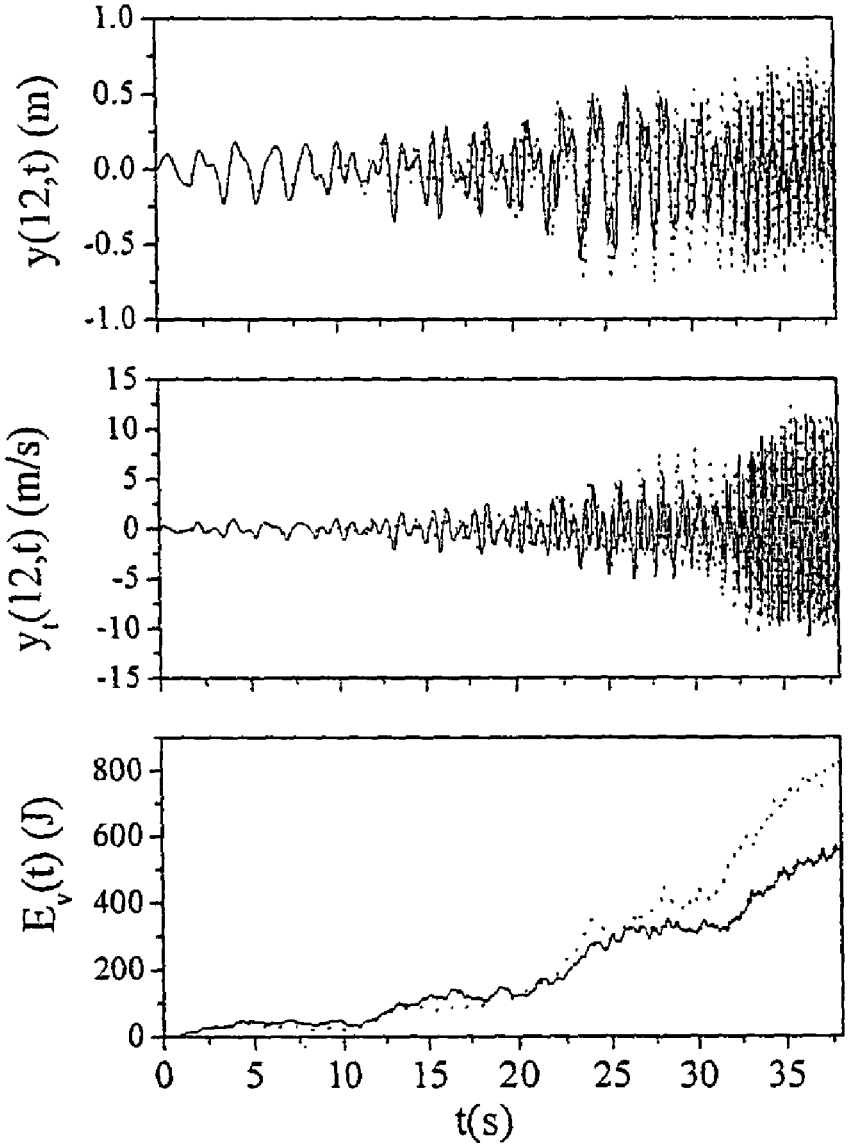
Figures 7A, 7B, 7C:
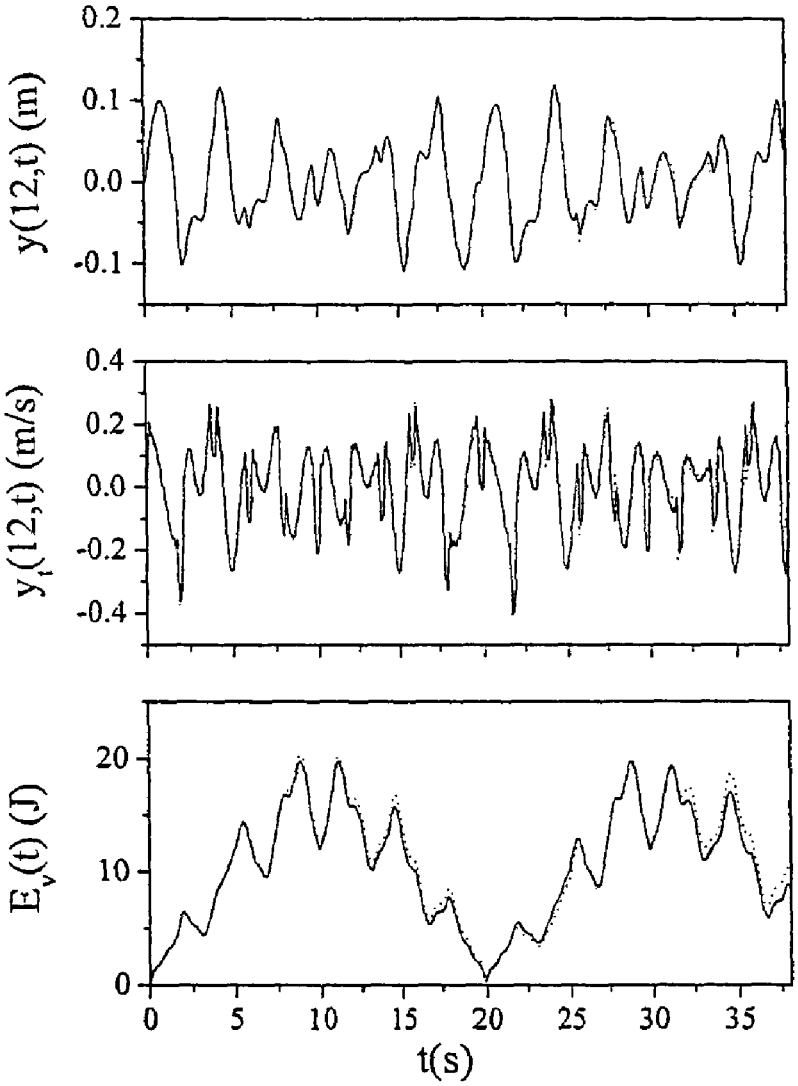
Figures 8A, 8B, 8C, 8D:
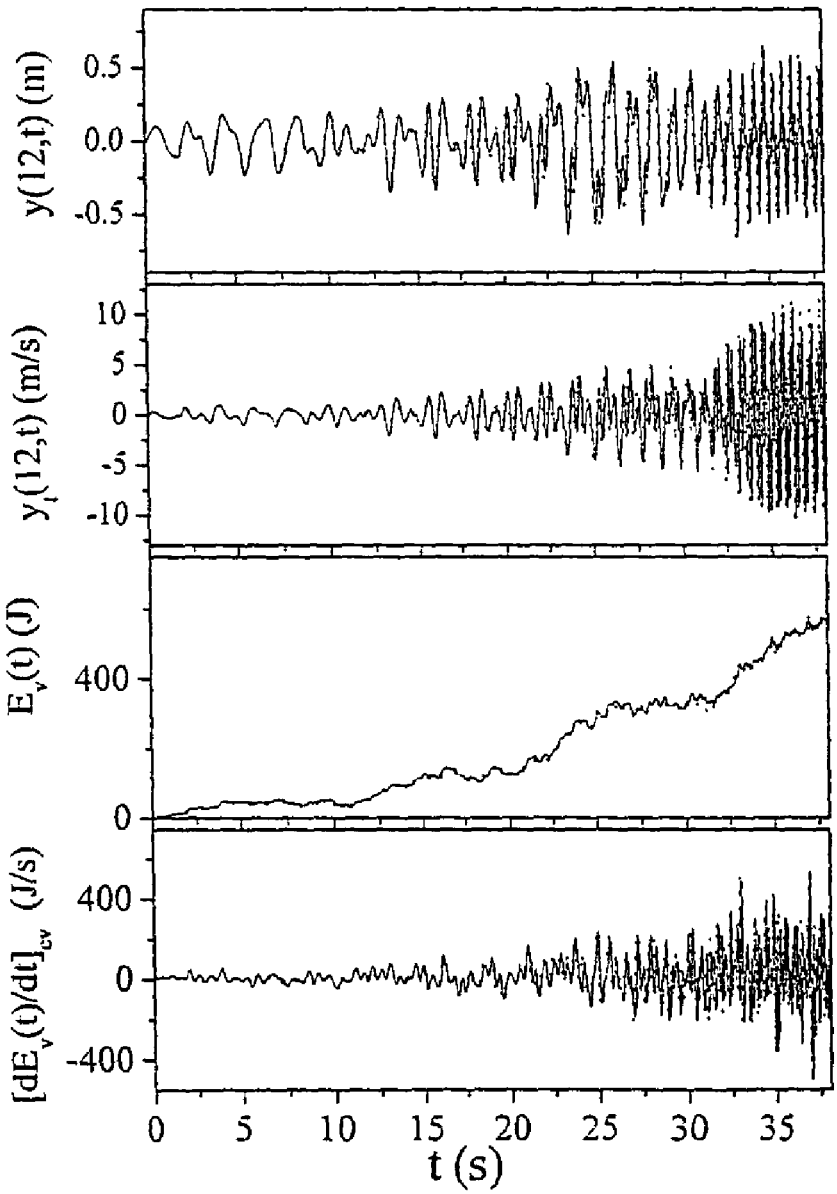
Figures 9A, 9B, 9C, 9D:
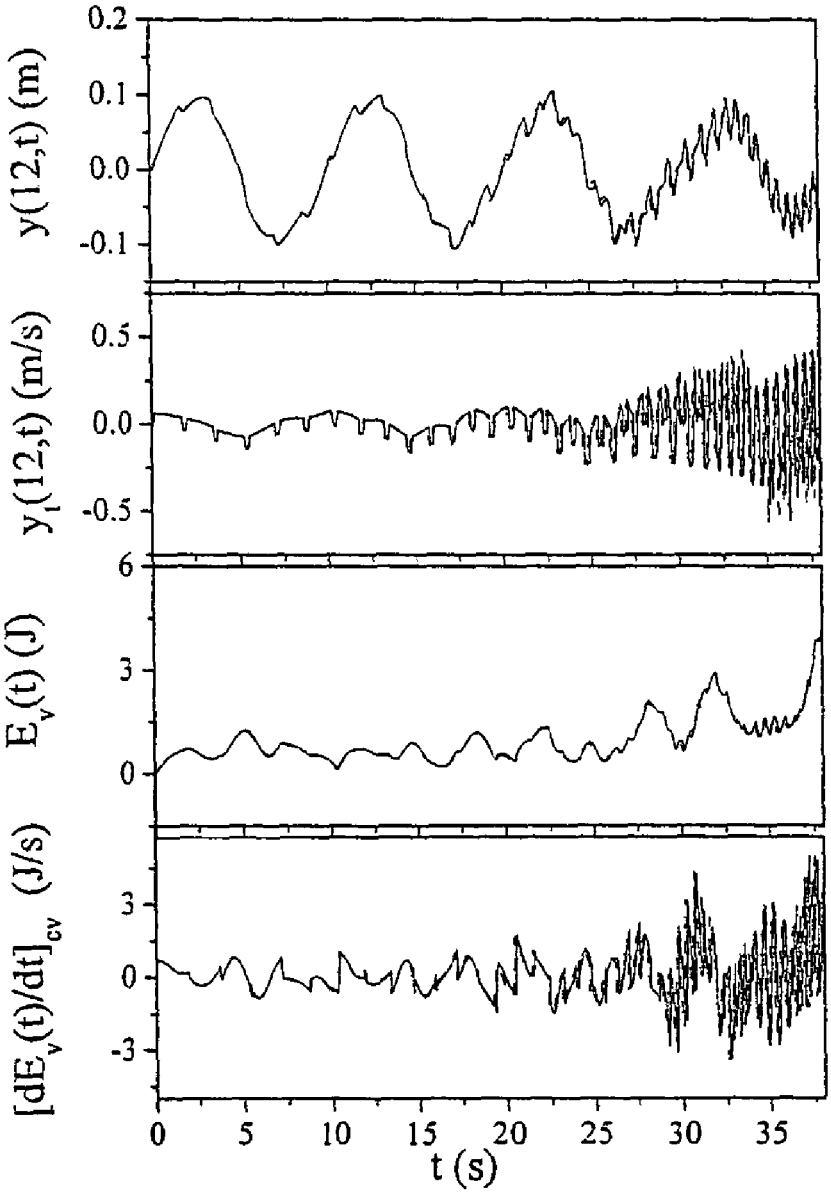
Figures 10A, 10B, 10C, 10D:
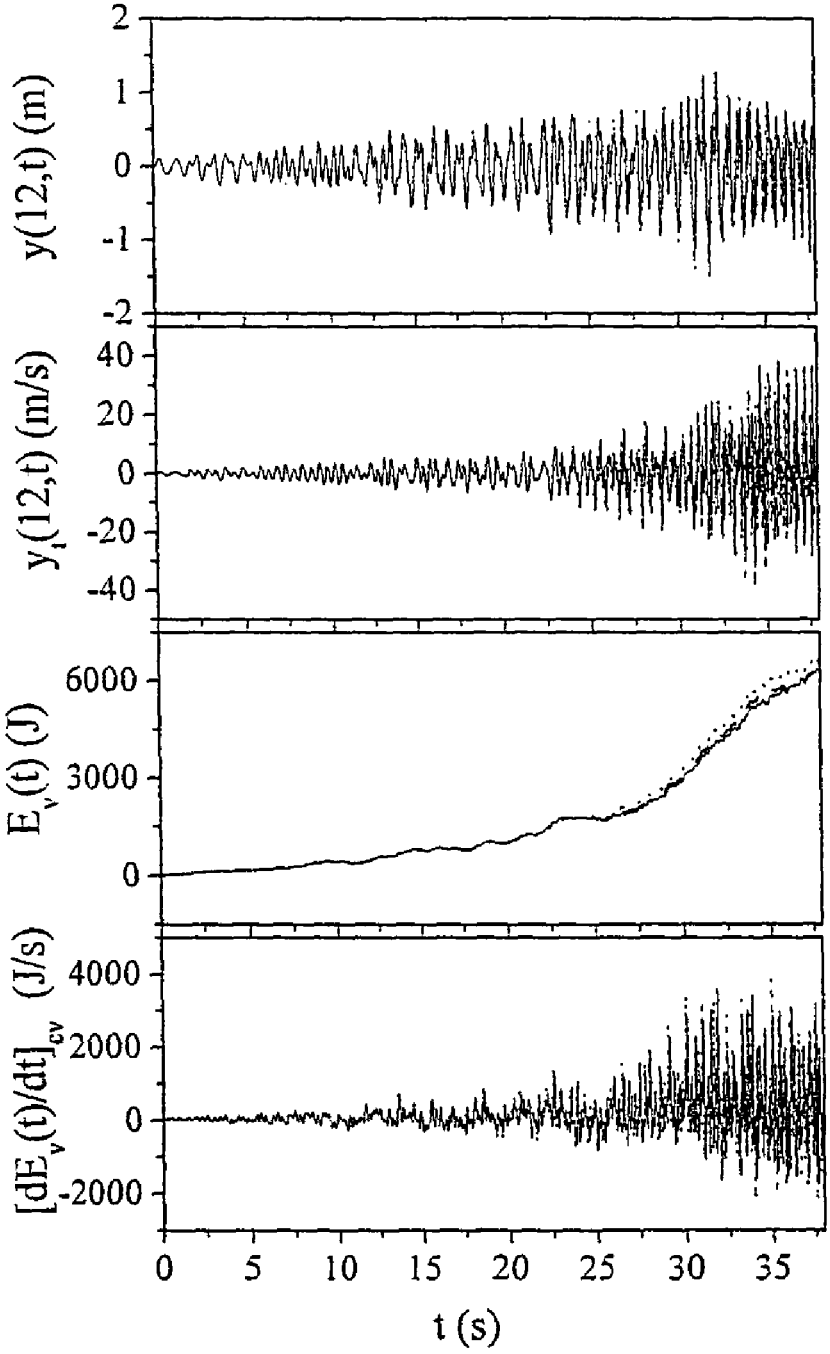
Figure 11:
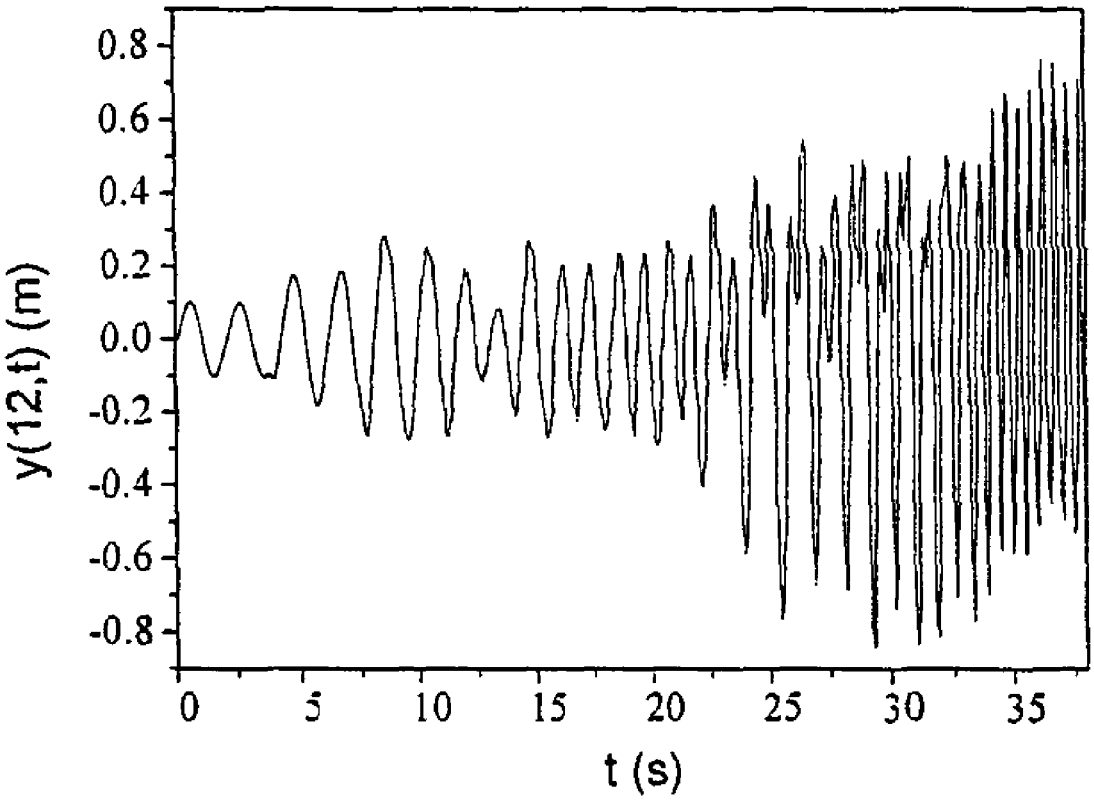
Figure 12A:
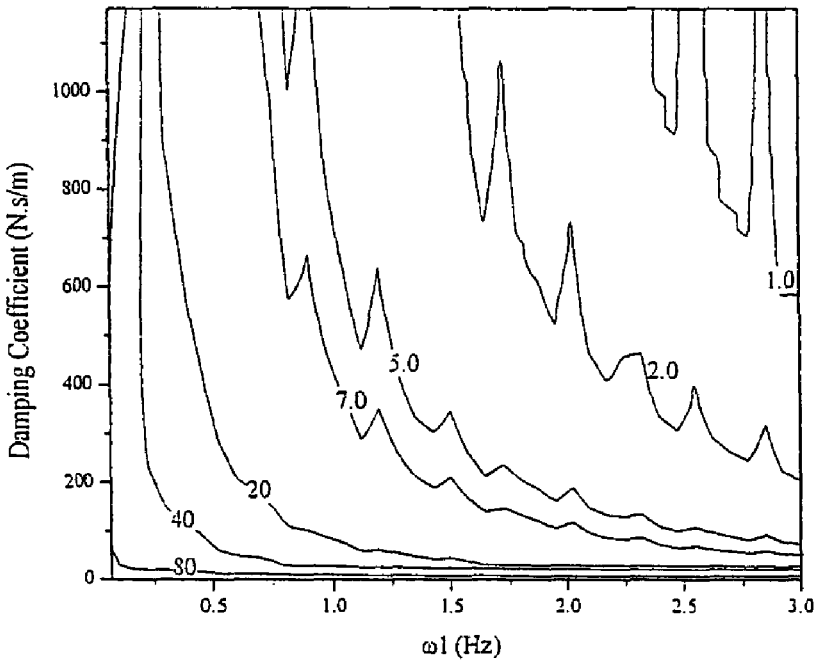
Figure 12B:
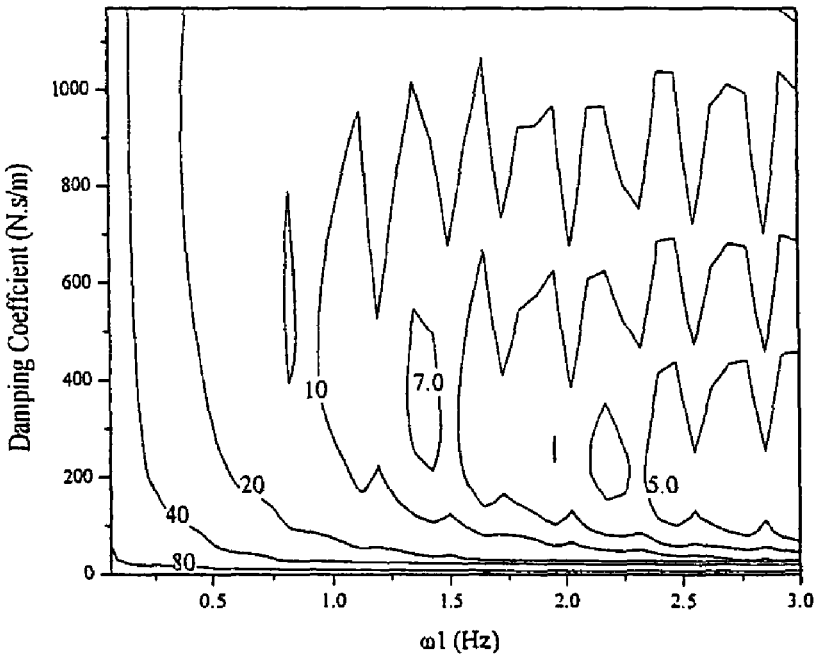
Figure 12C:
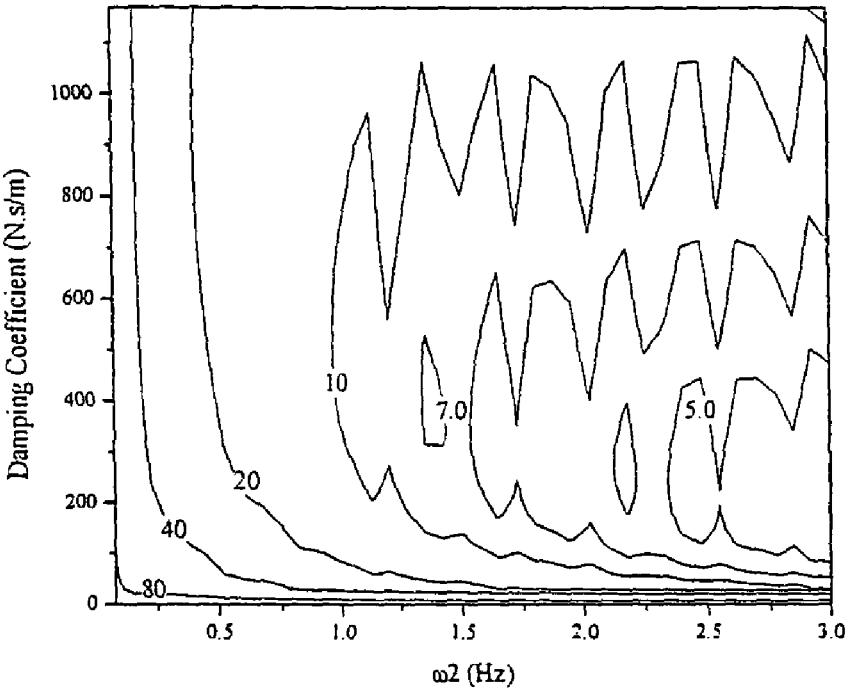
Figure 12D:
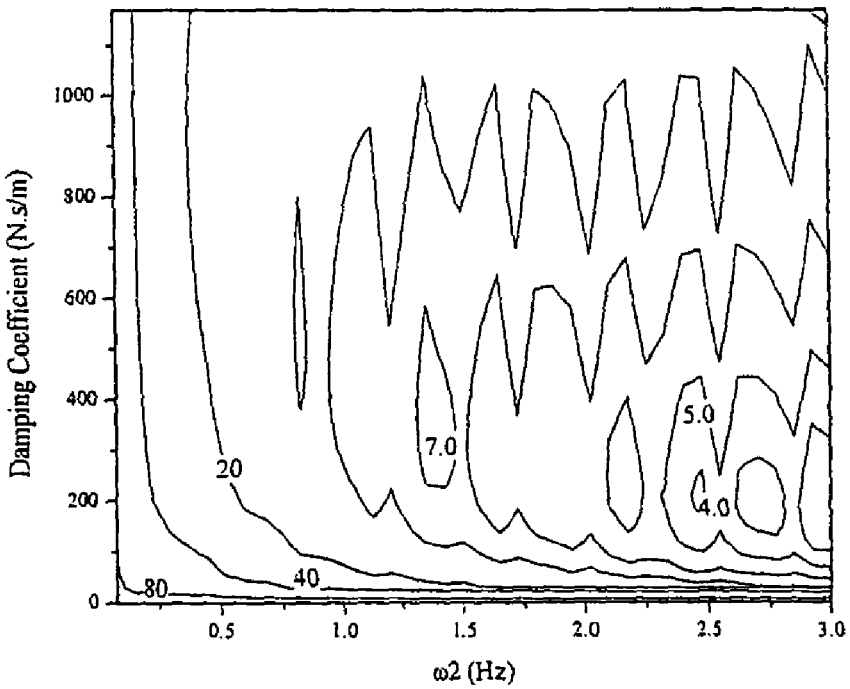
Figure 13:
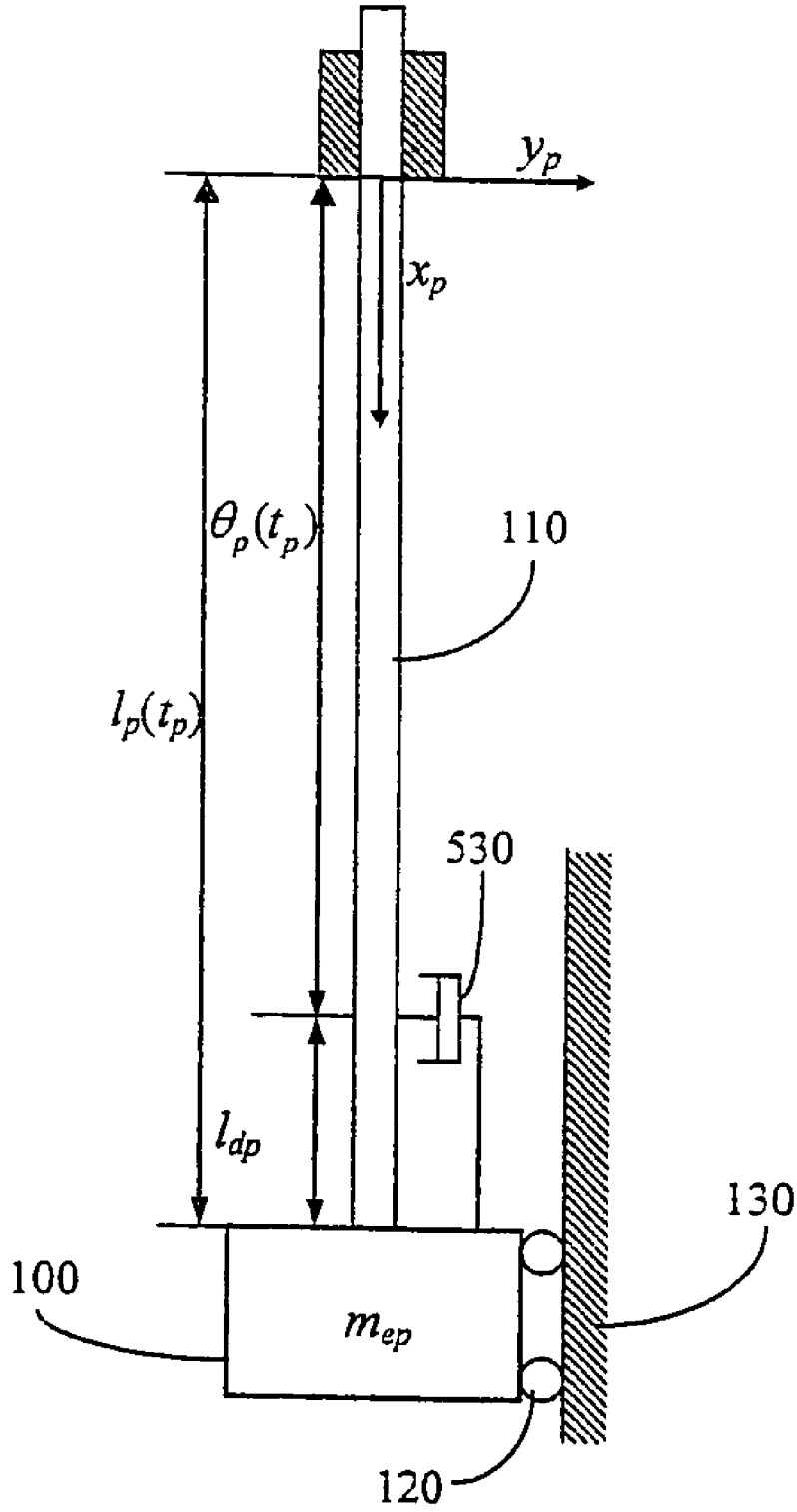
Figure 14:
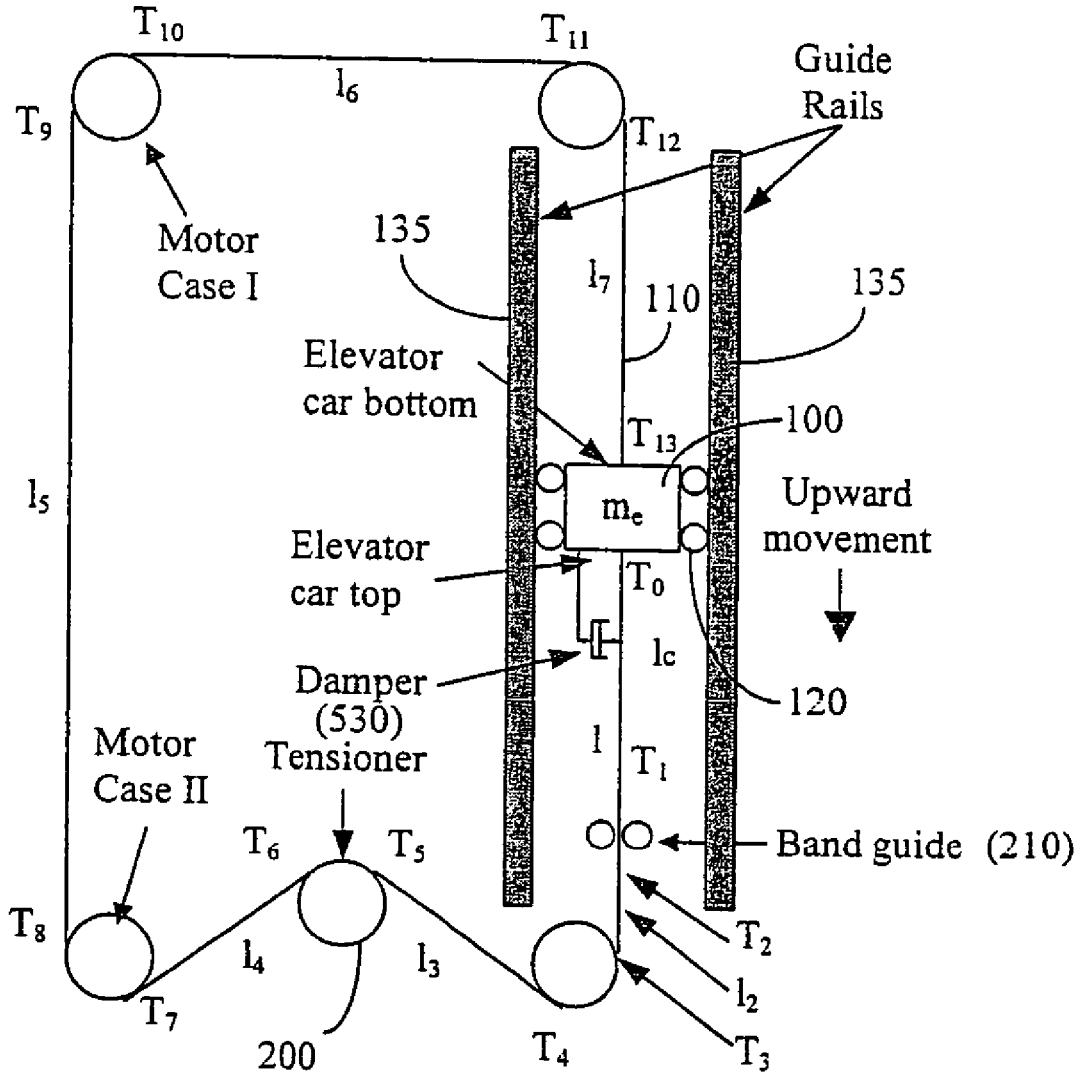
Figure 15:
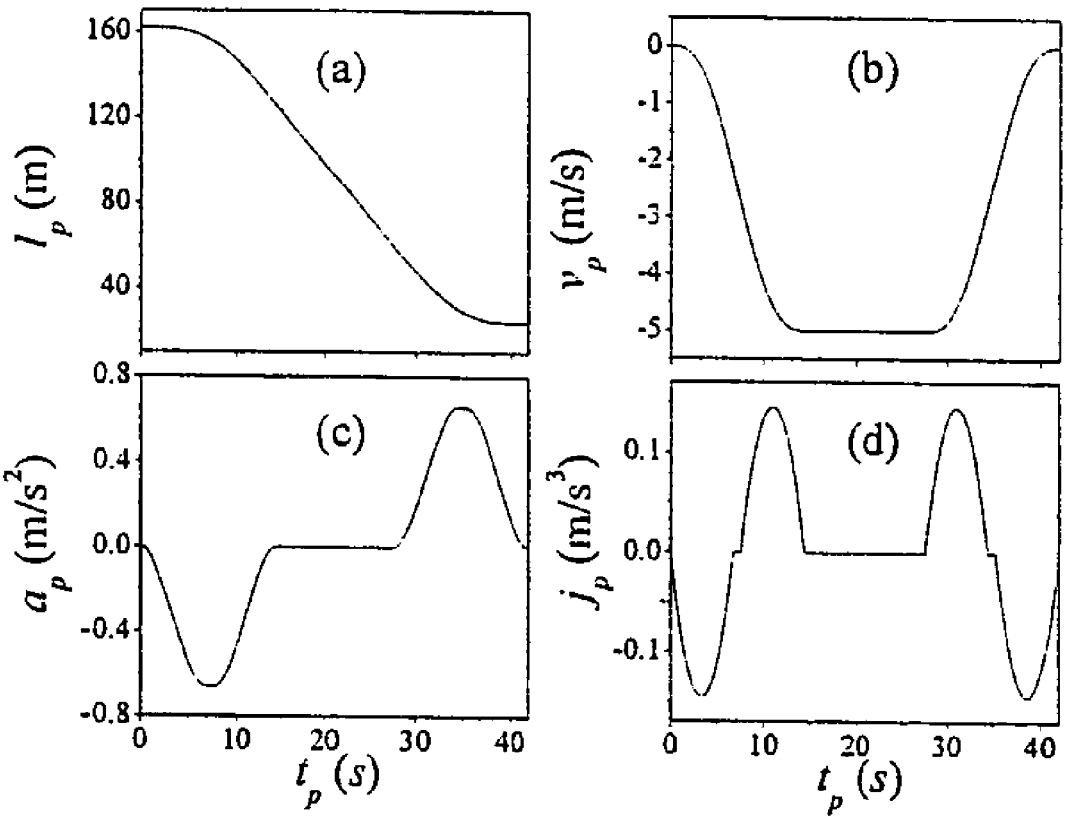
Figure 16A:
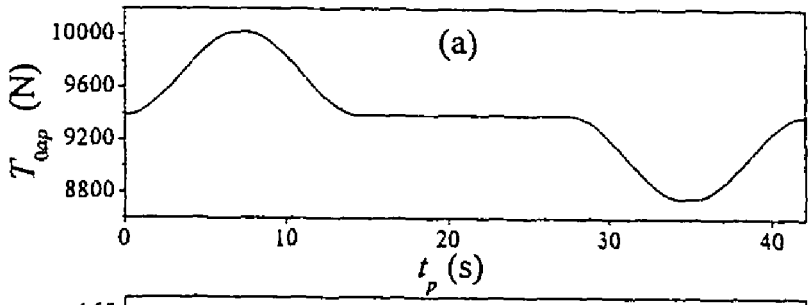
Figure 16B:
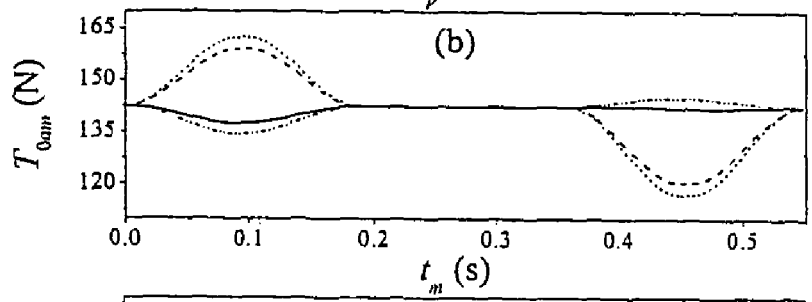
Figure 16C:
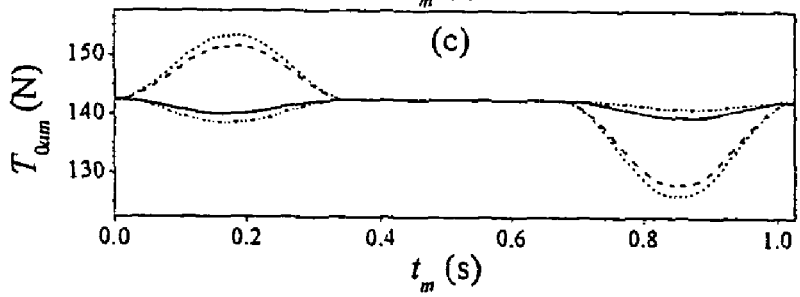
Figures 17A, 17B, 17C:
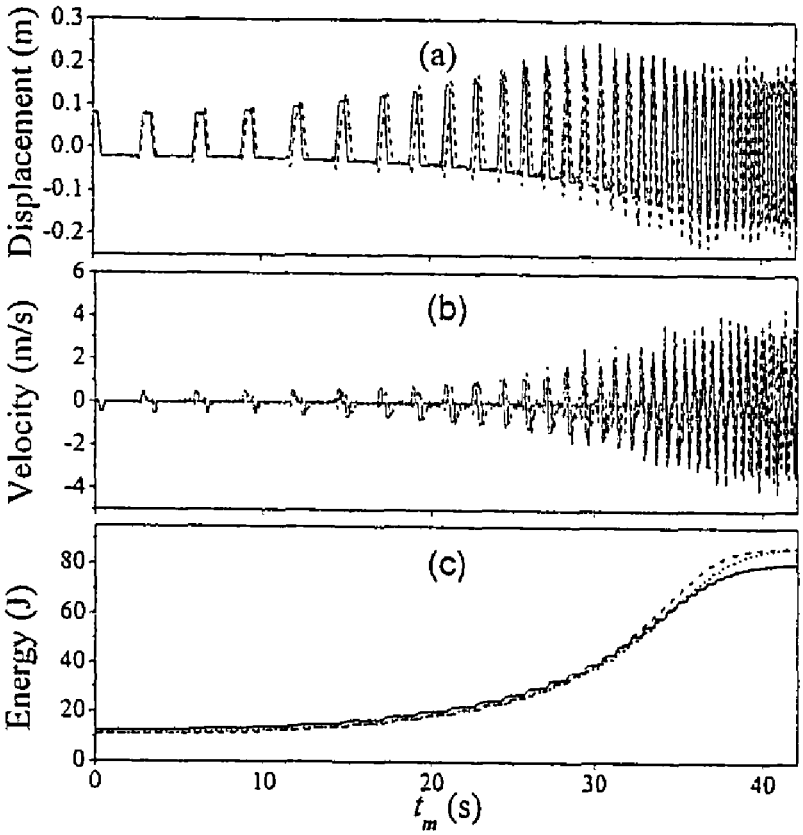
Figures 18A, 18B, 18C:
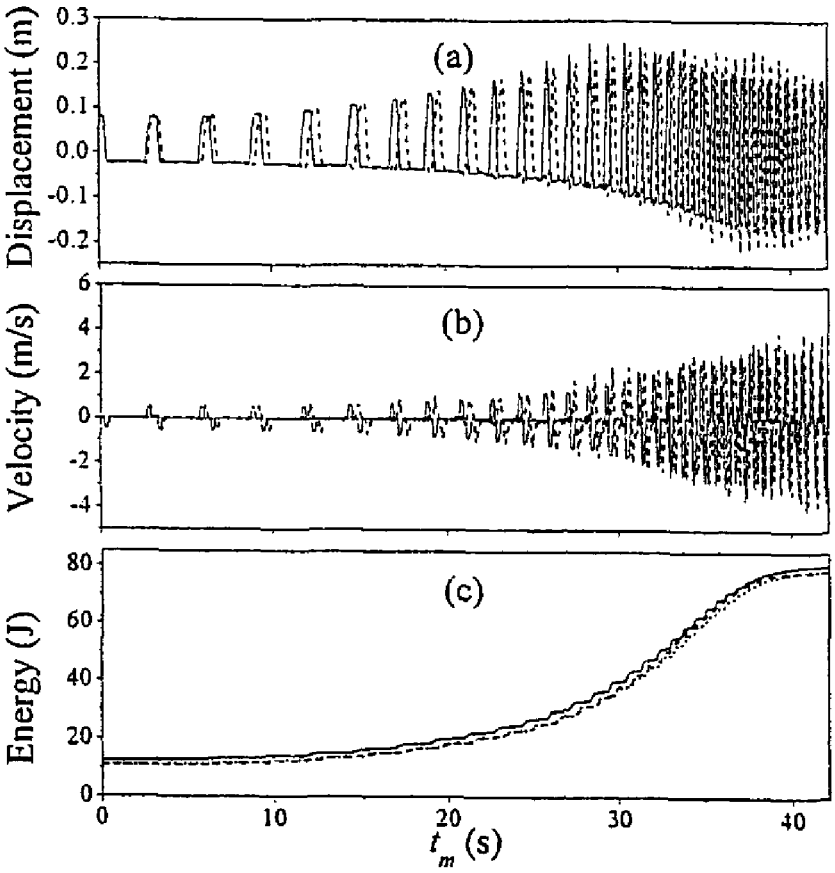
Figure 19A:
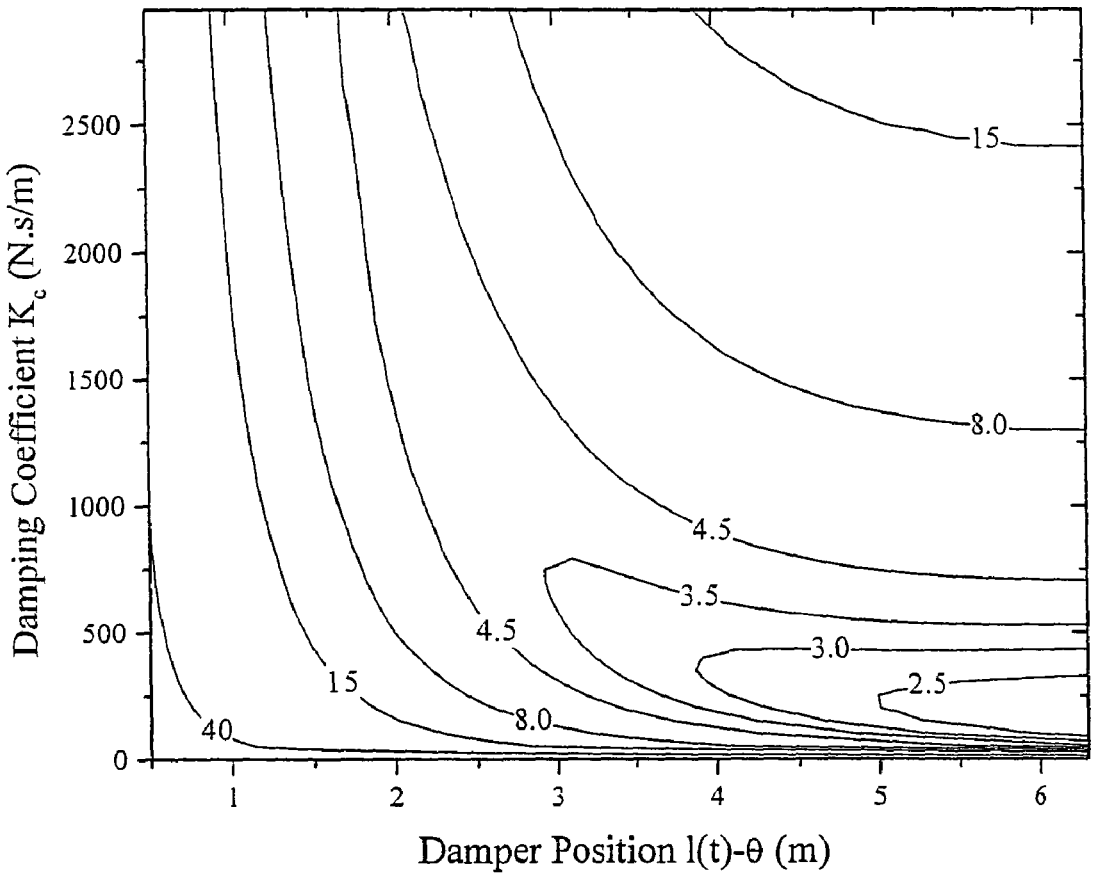
Figure 19B:
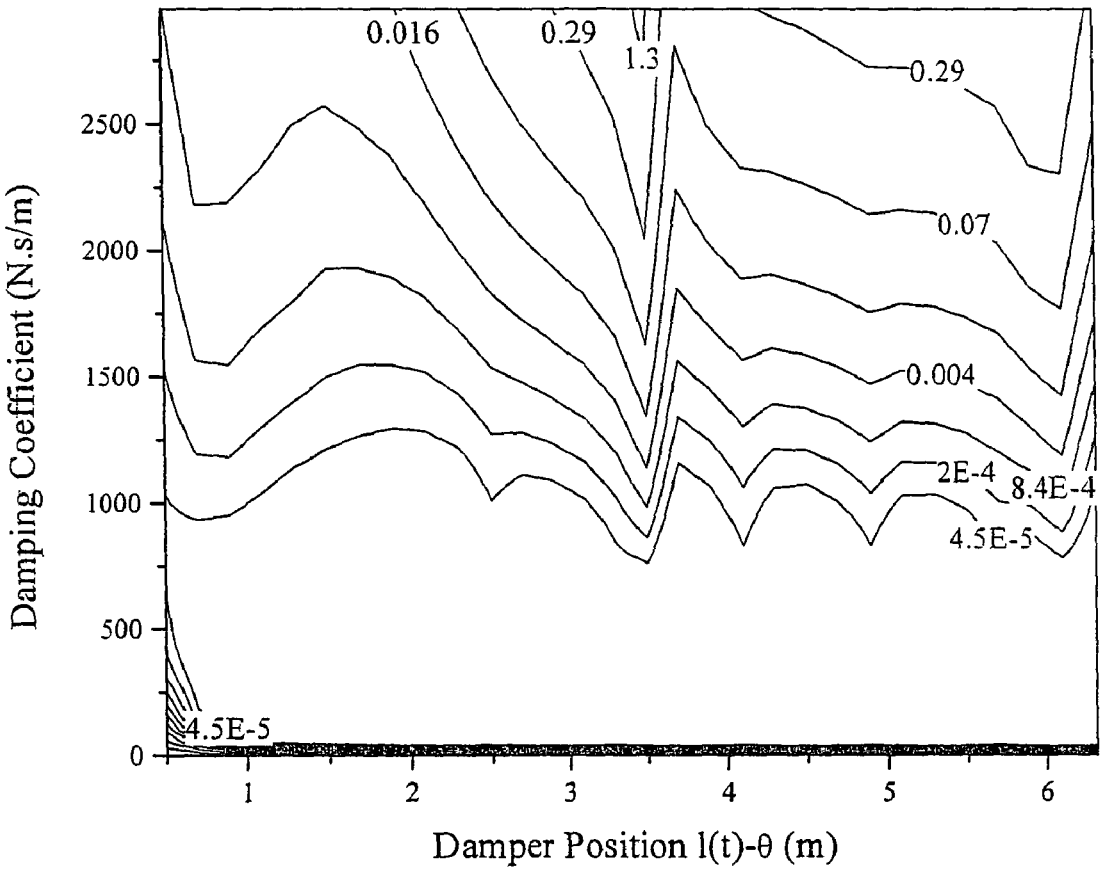
Figure 20A:
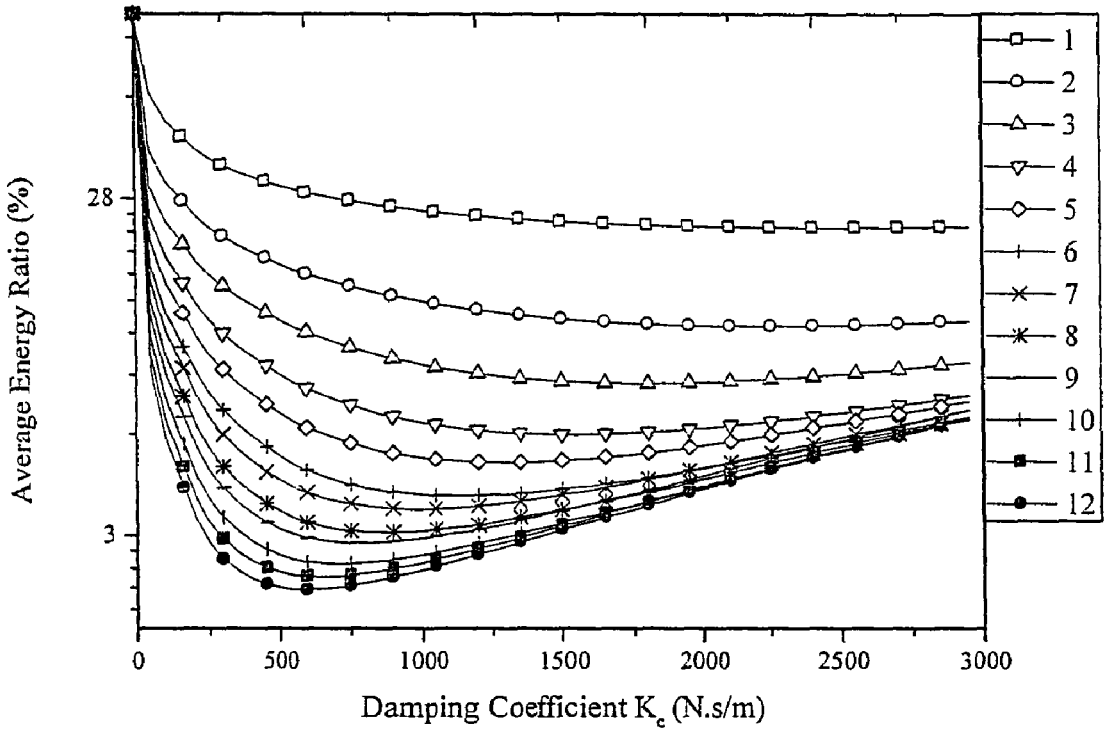
Figure 20B:
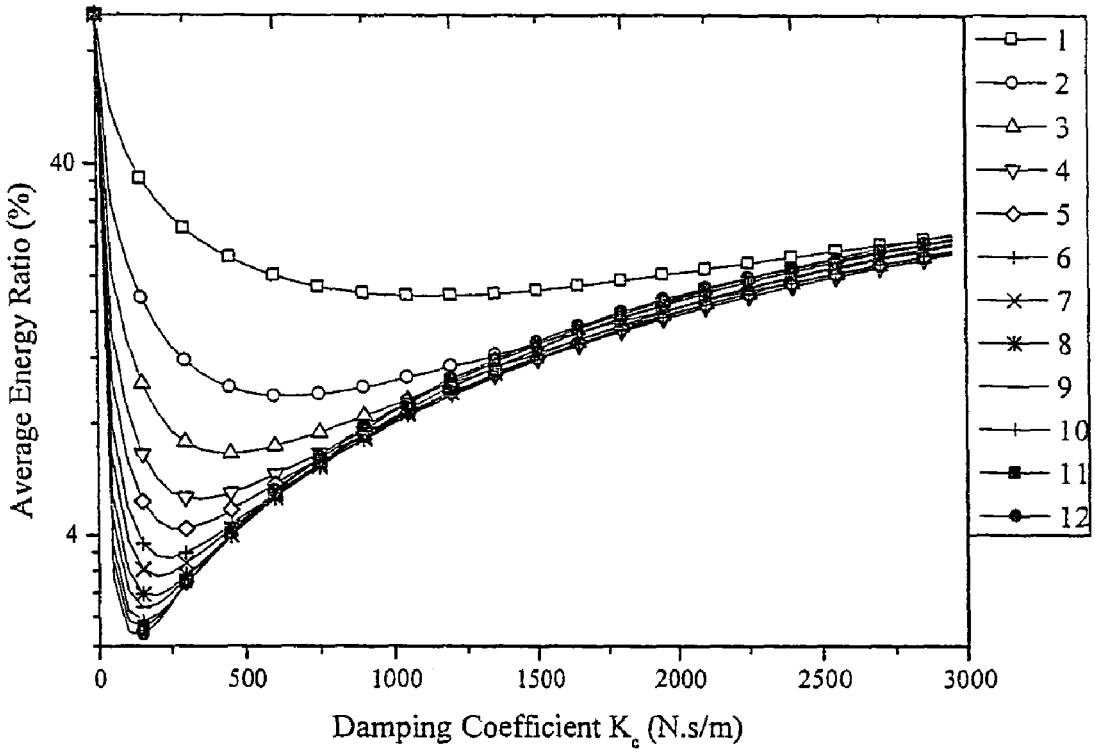
Figure 20C:
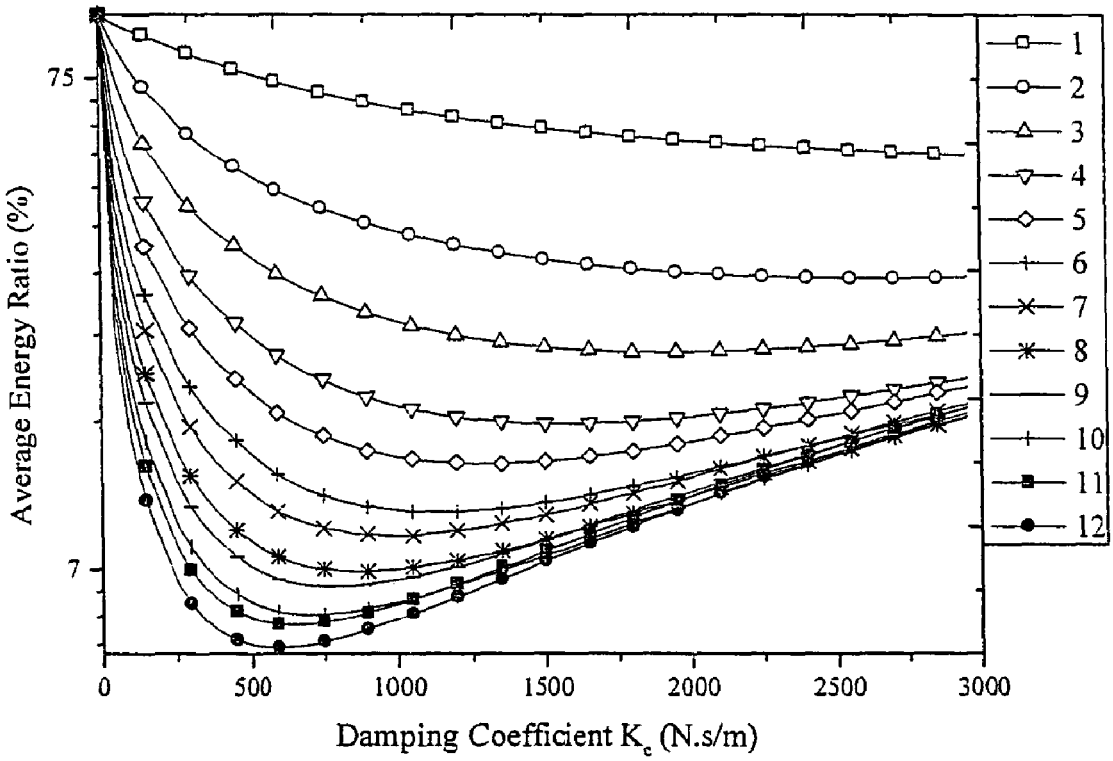
Figure 20D:
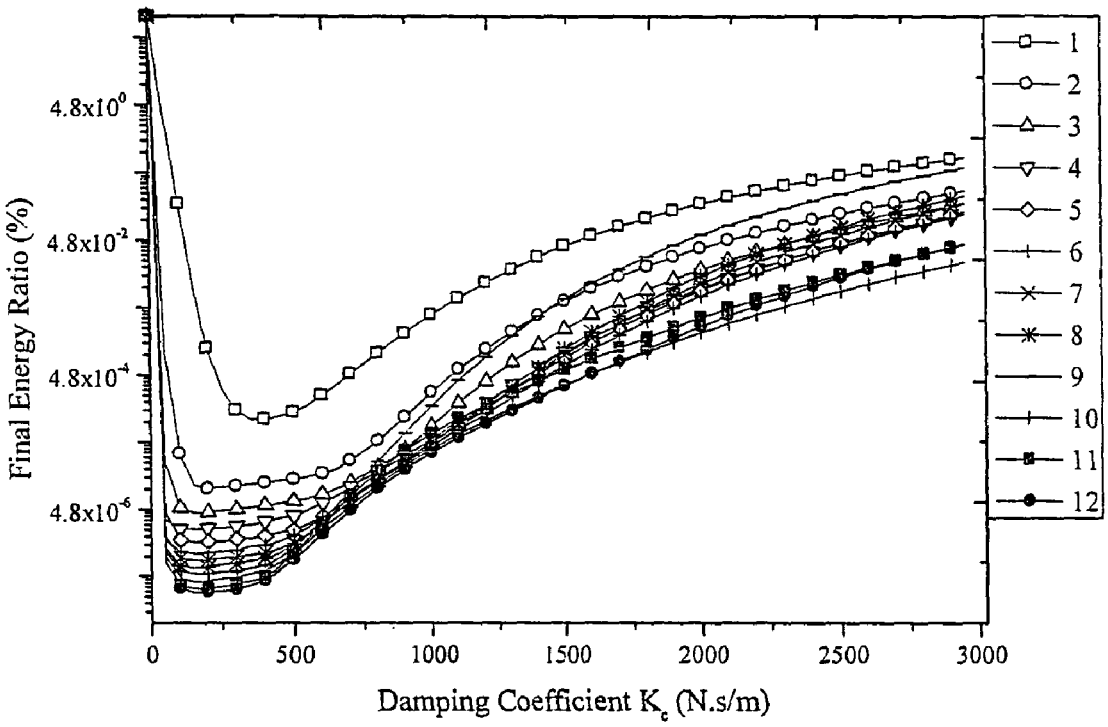
Figures 21A, 21B, 21C:
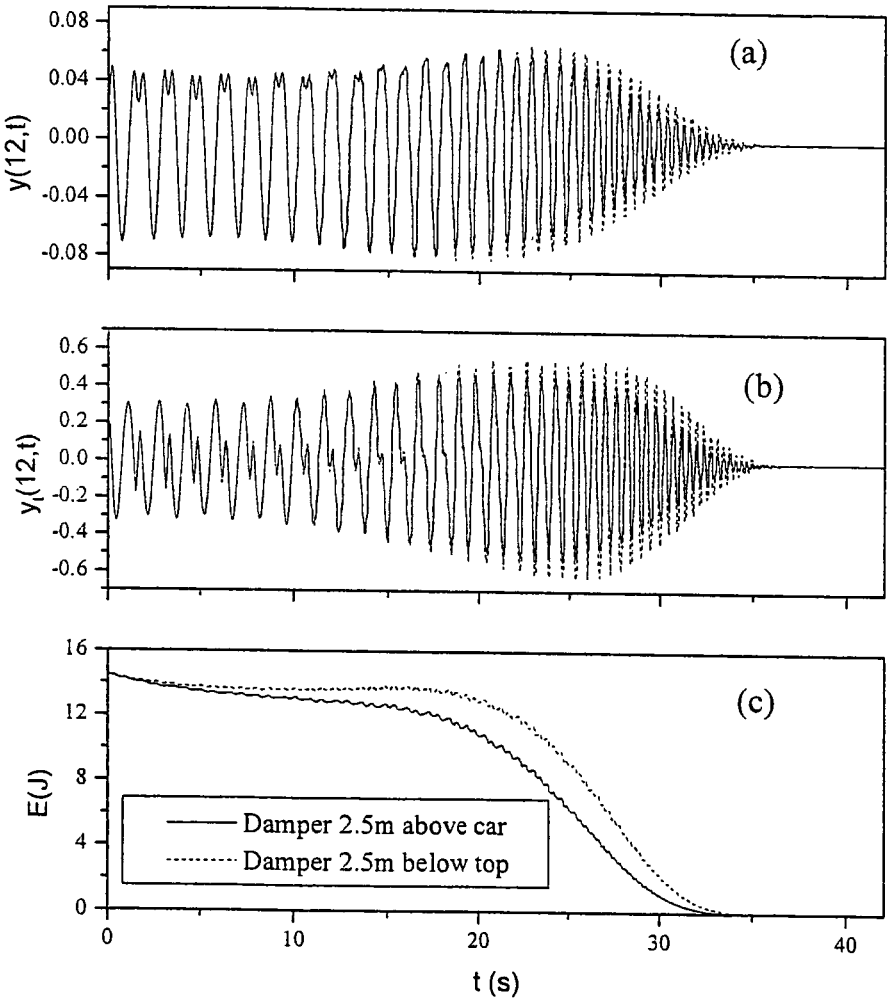
Figure 22:
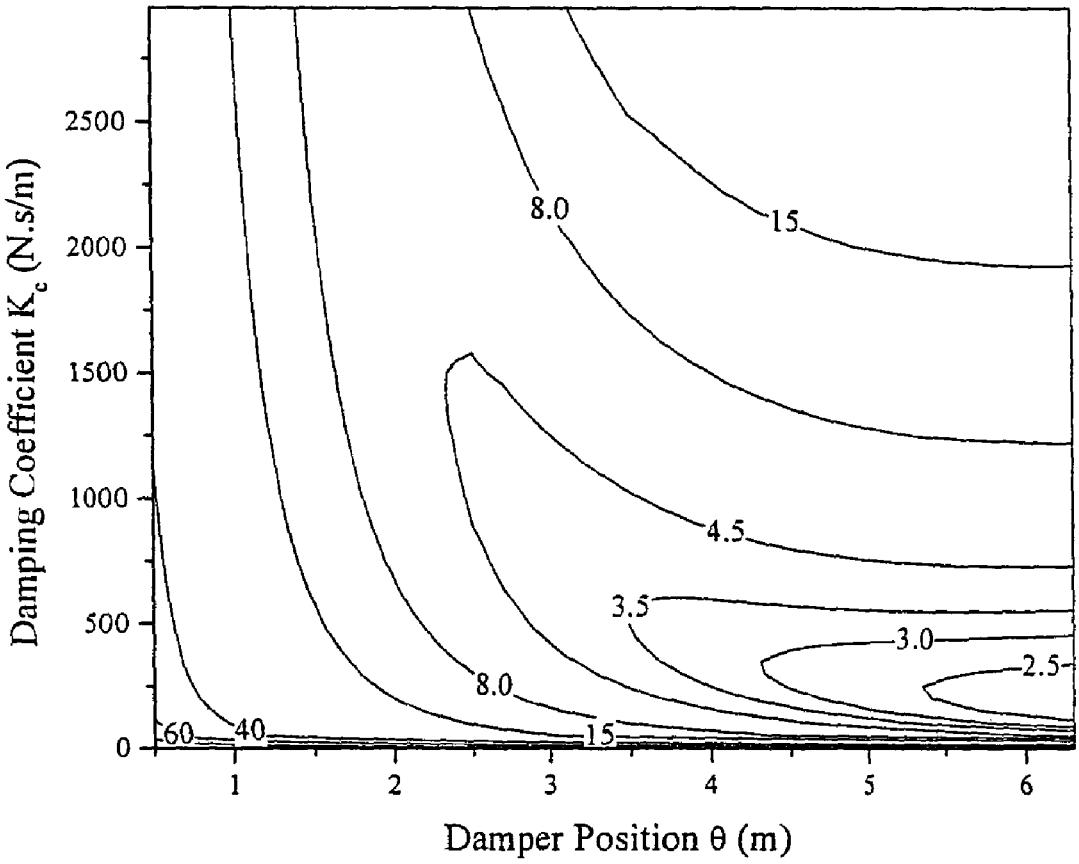
Figures 23A, 23B:
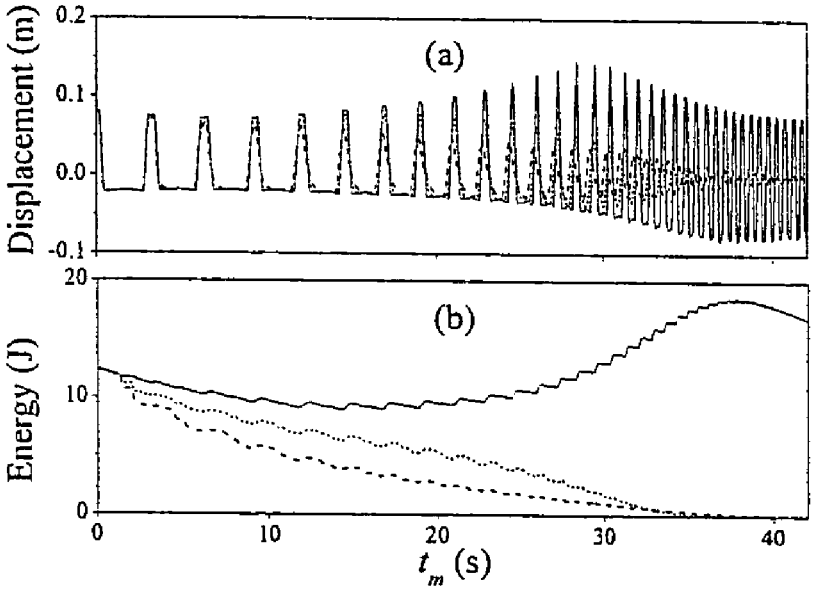
Figure 24:
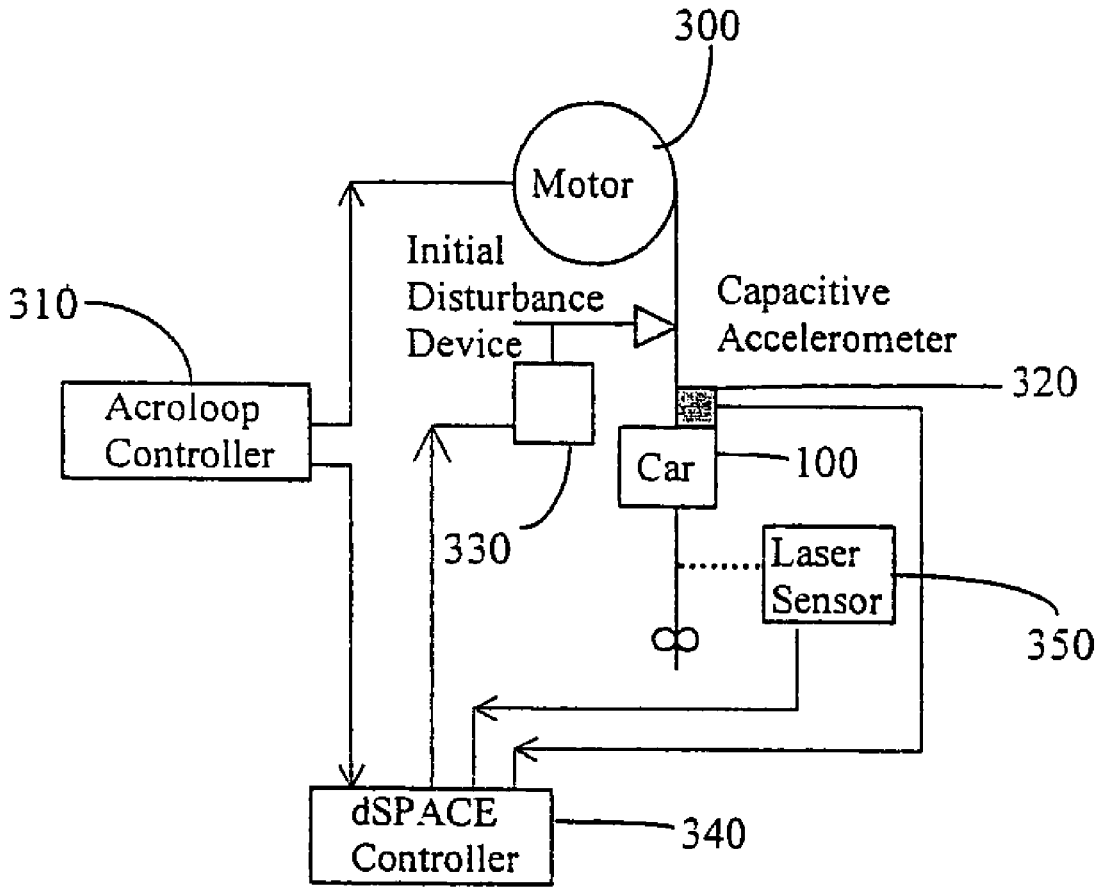
Figure 25:
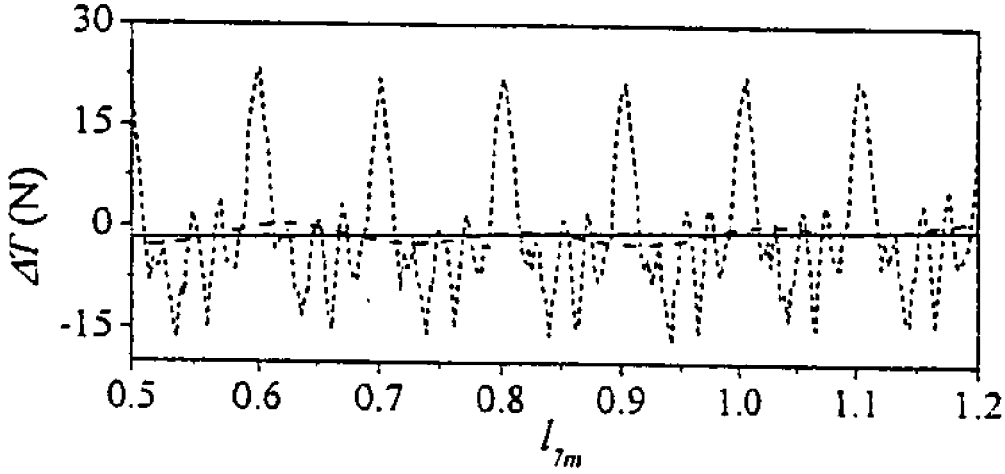
Figure 26:
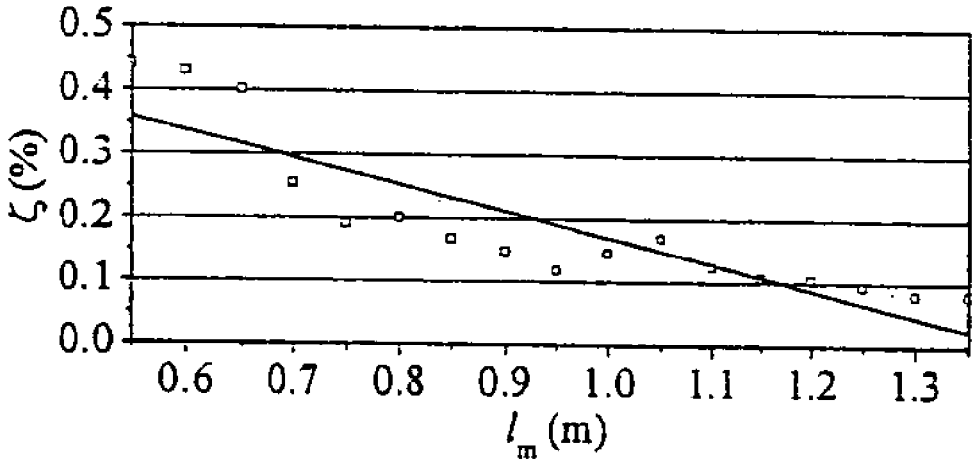
Figures 29A, 29B, 29C:
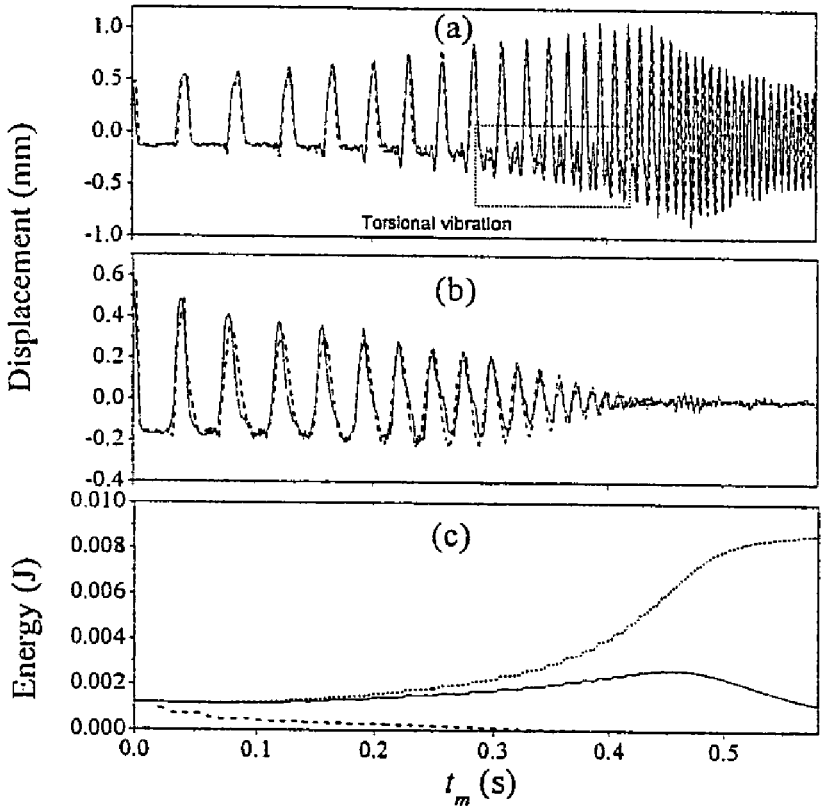
Figure 30A:
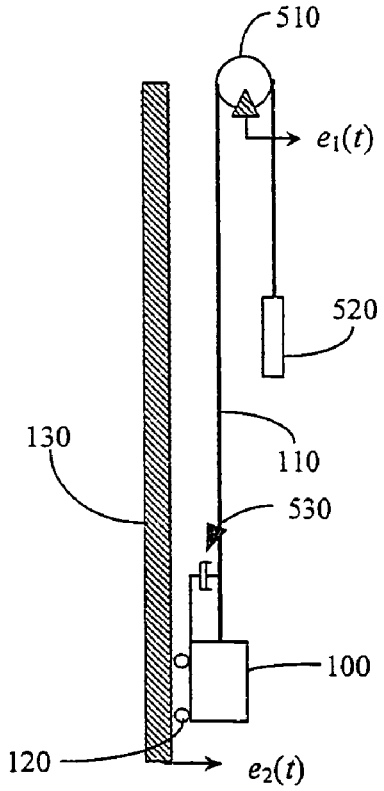
Figure 30B:
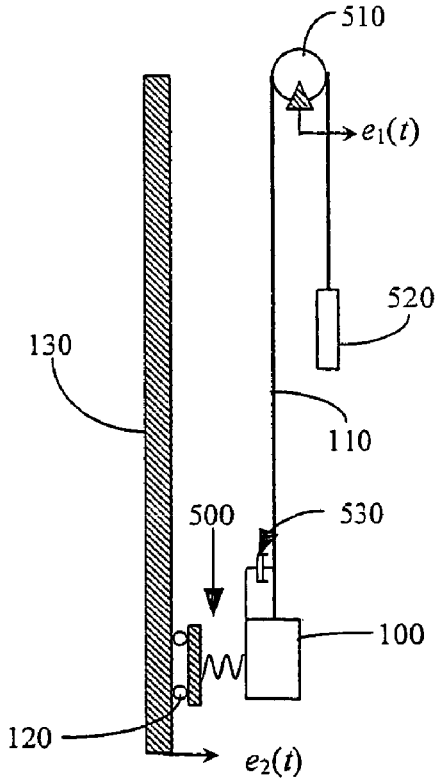
Figure 31A:
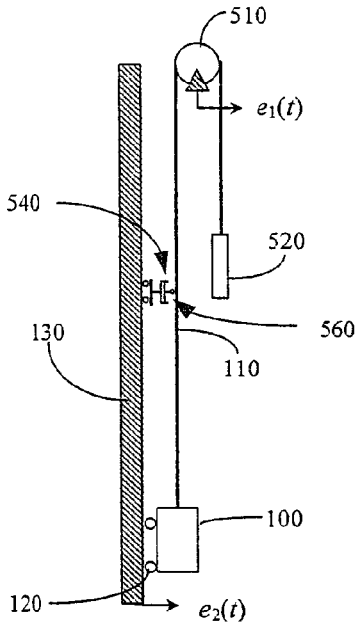
Figure 31B:
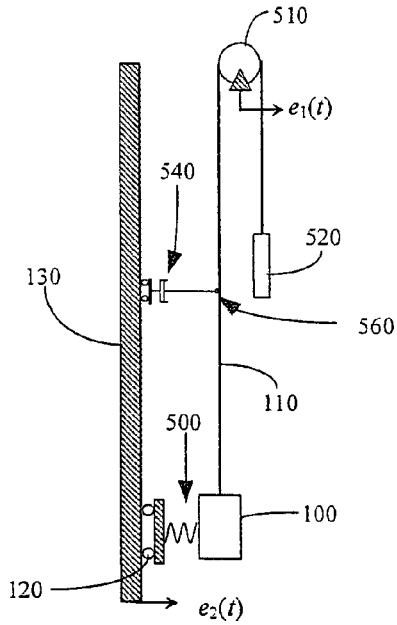
Figure 31C:
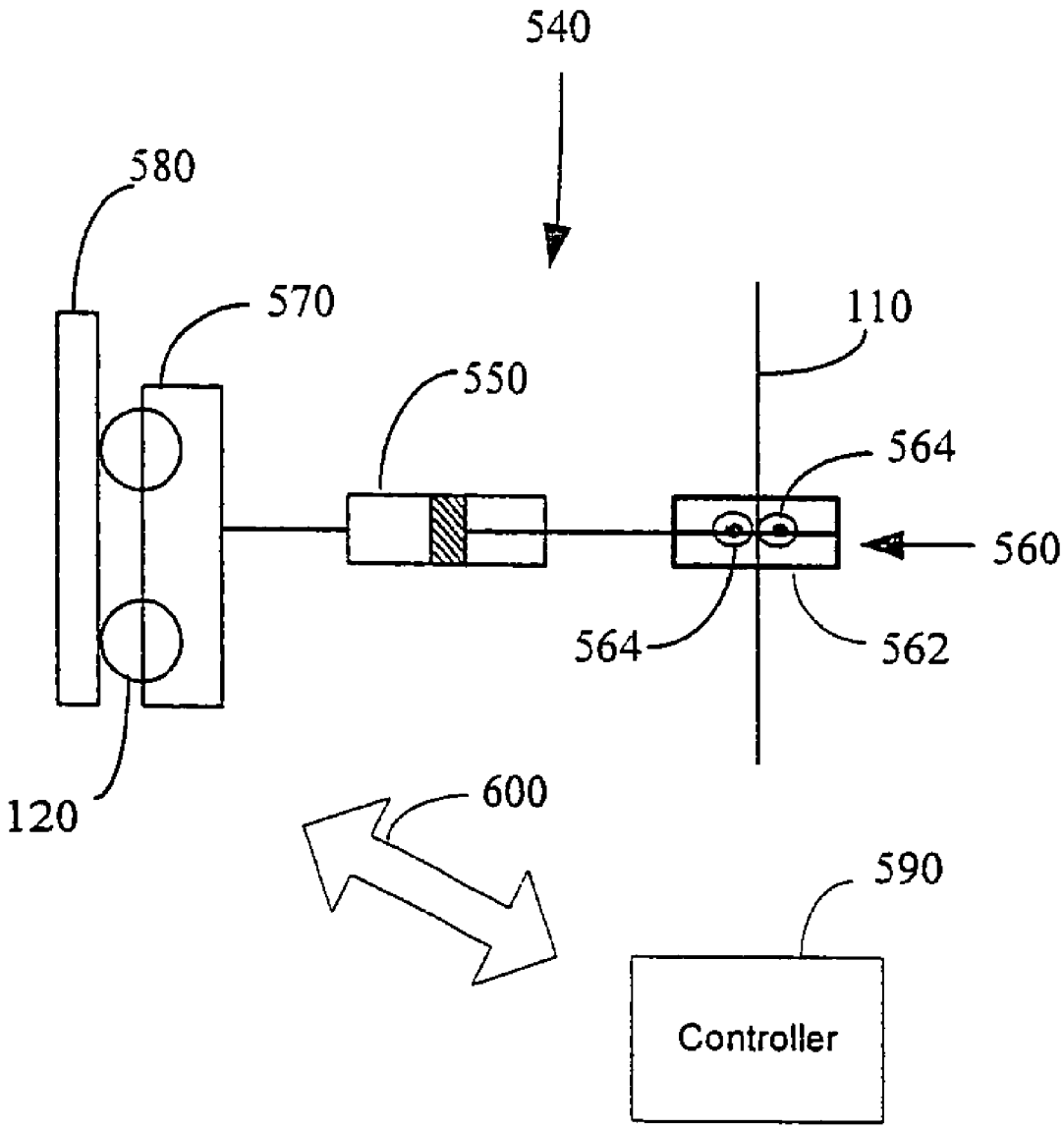
Figure 32A:
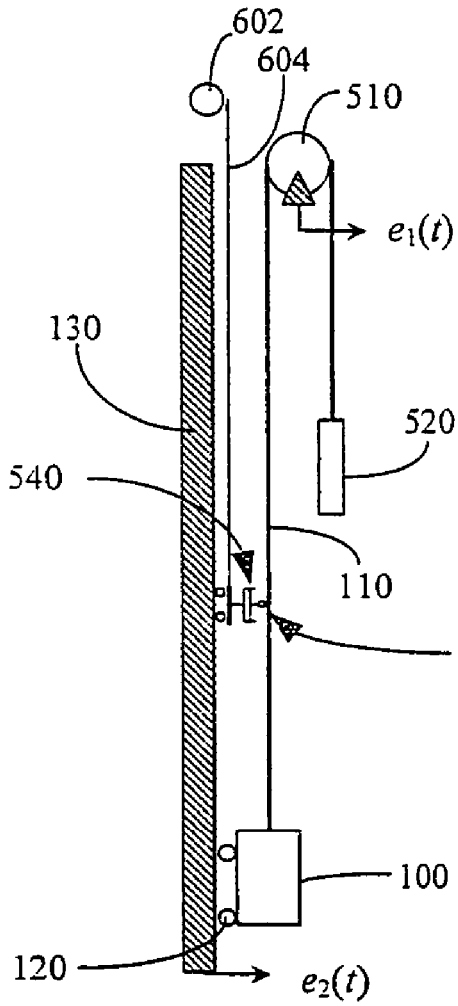
Figure 32B:
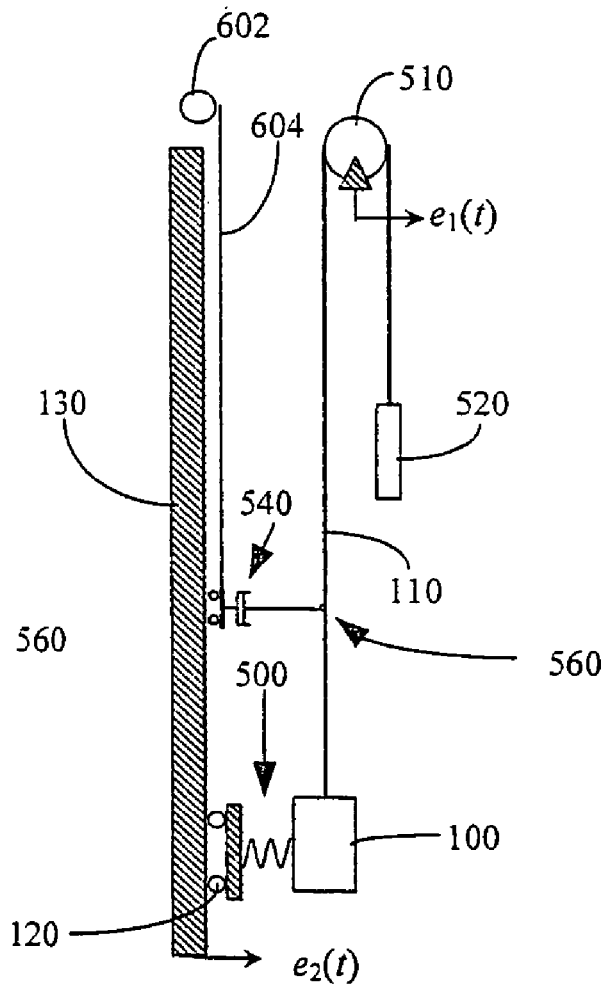
Figure 32C:
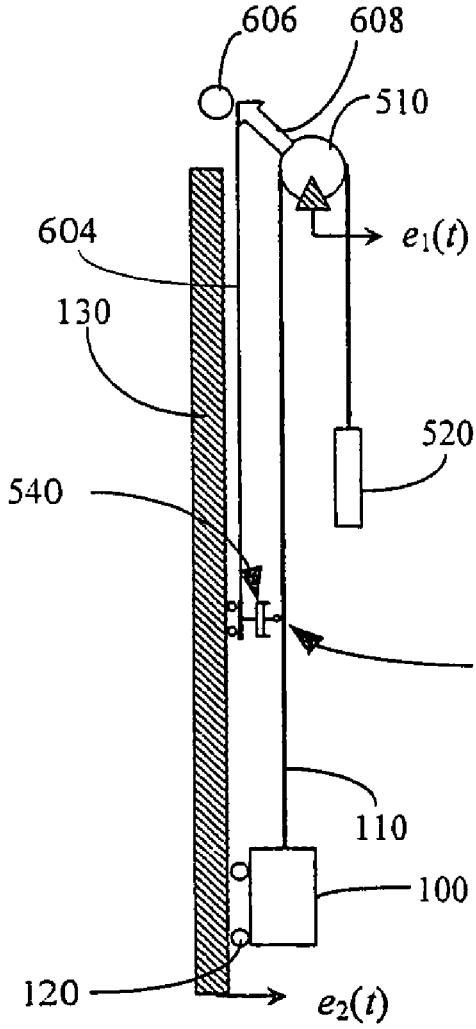
Figure 32D:
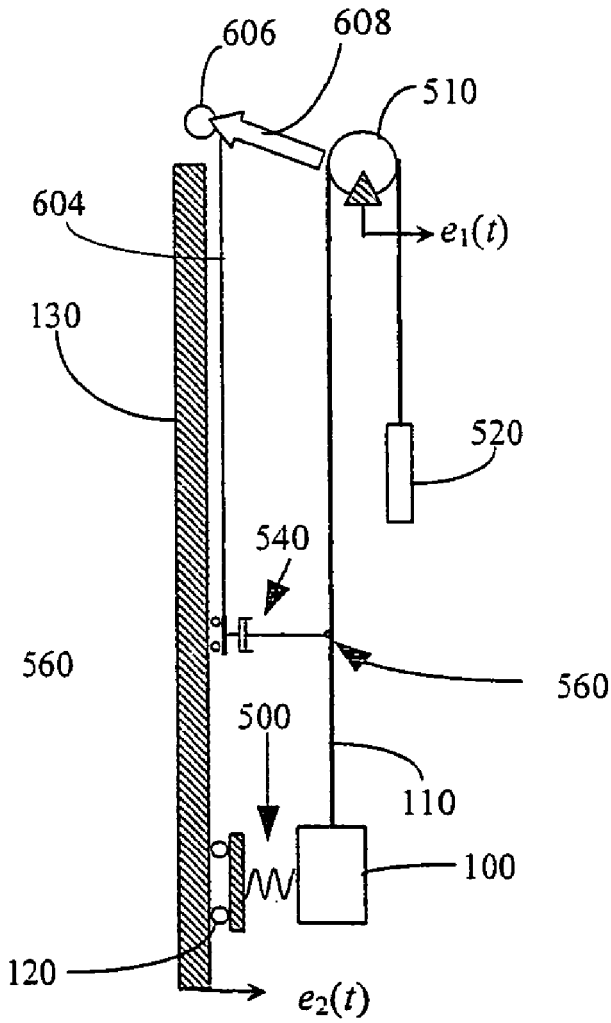
Figure 32E:
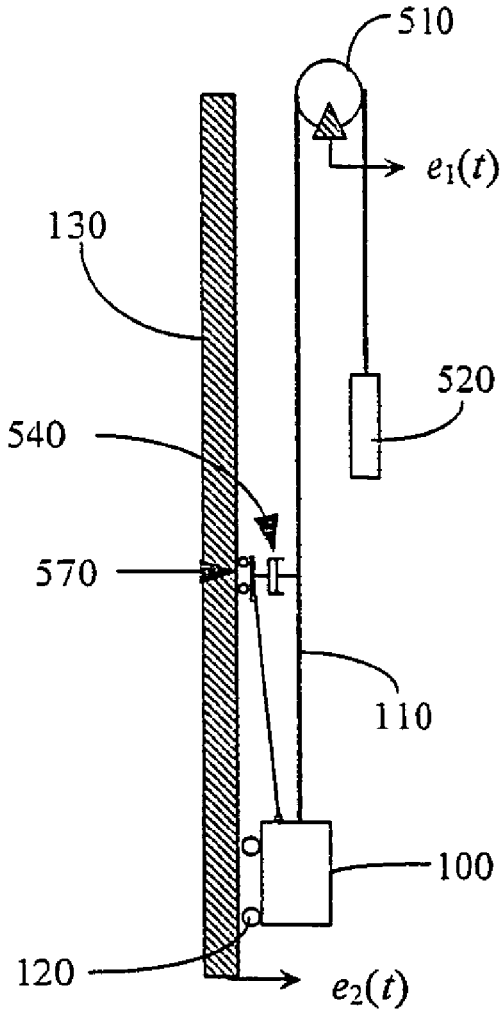
Figure 32F:
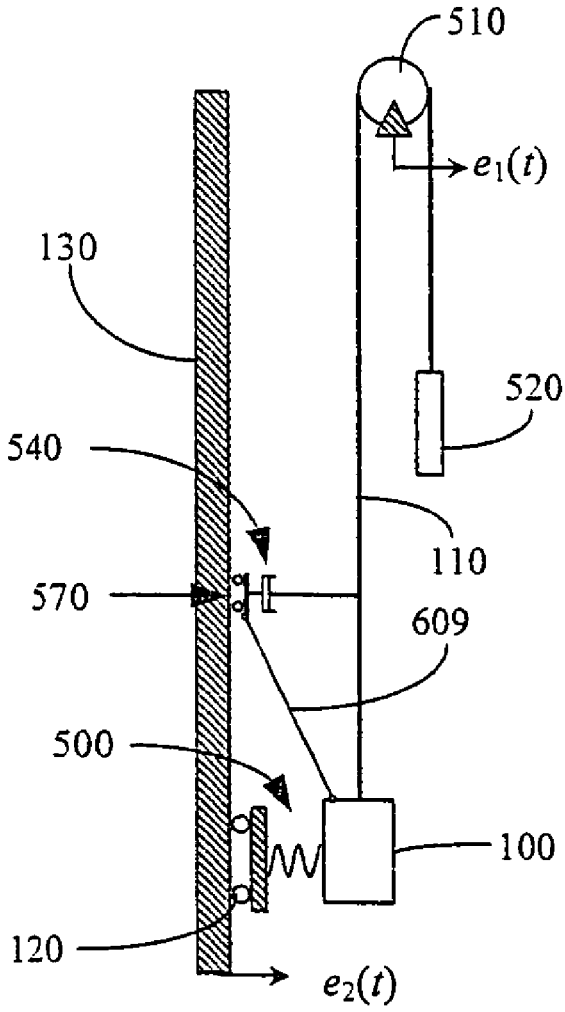
Figure 33A:
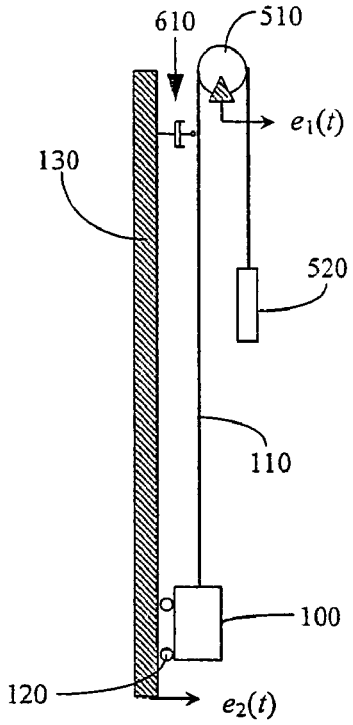
Figure 33B:
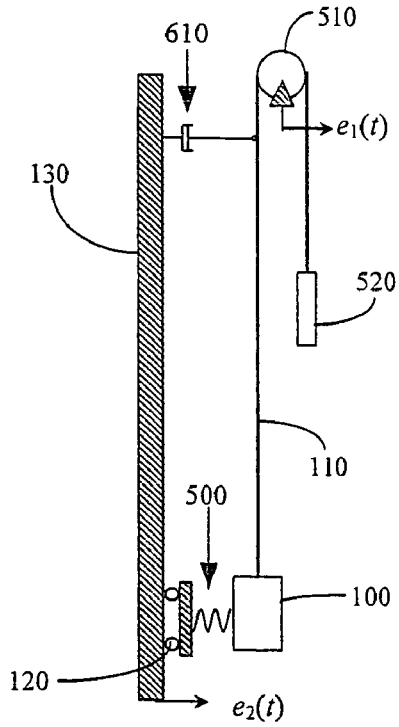
Figure 34:
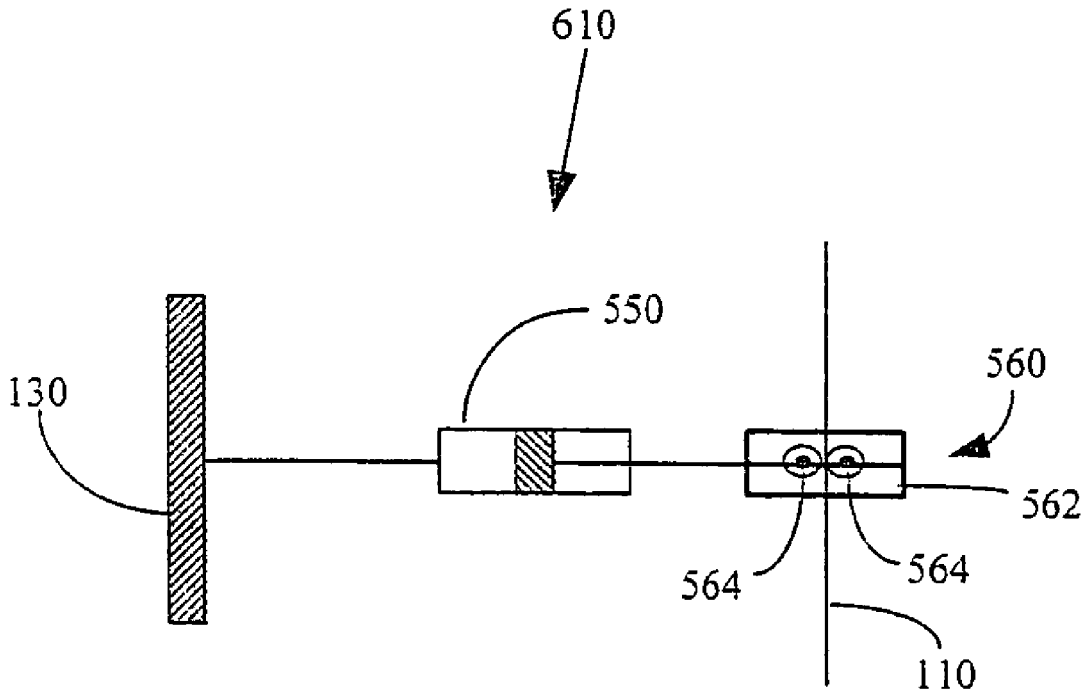
Figure 35A:
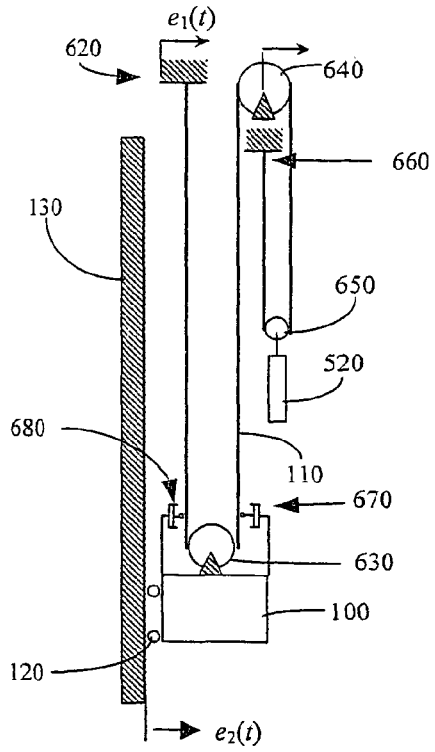
Figure 35B:
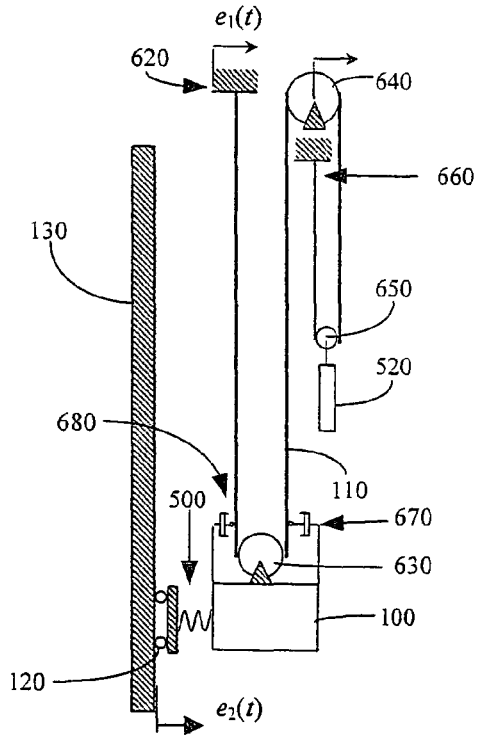
Figure 36A:
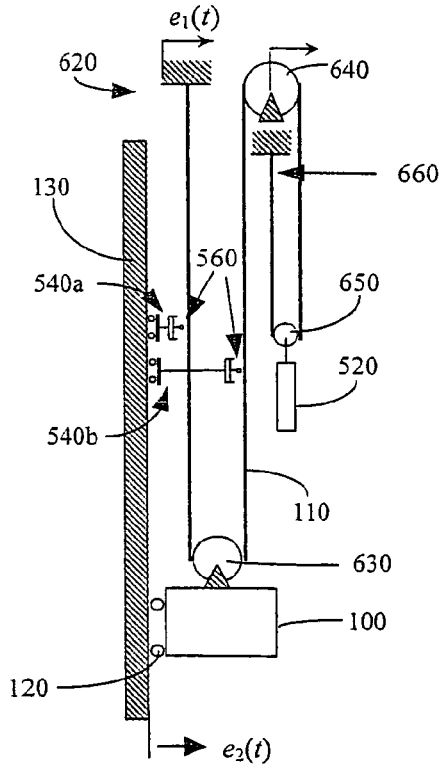
Figure 36B:
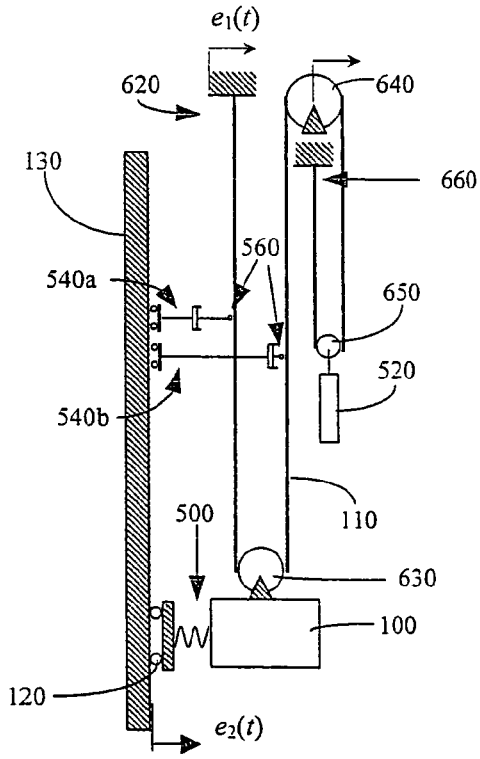
Figure 37A:
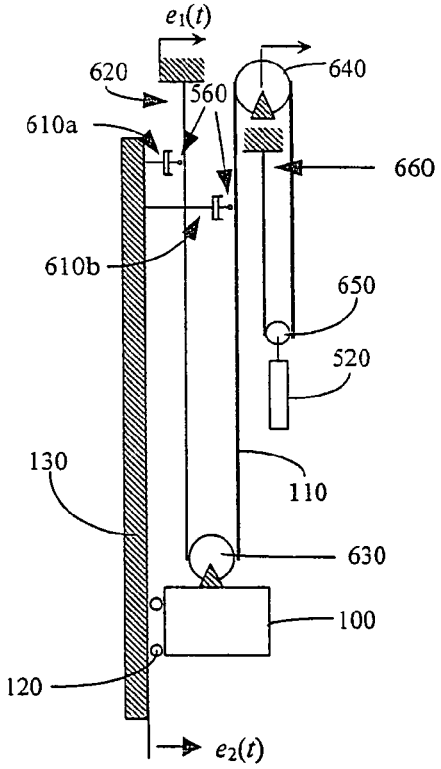
Figure 37B:
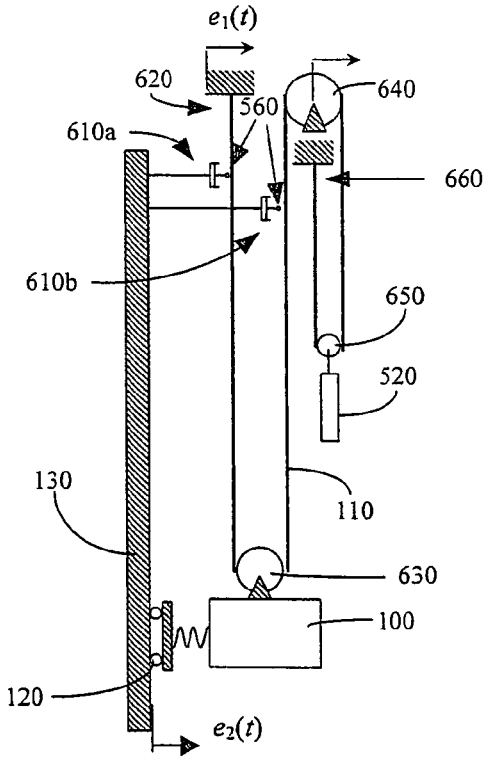
Figure 38A:
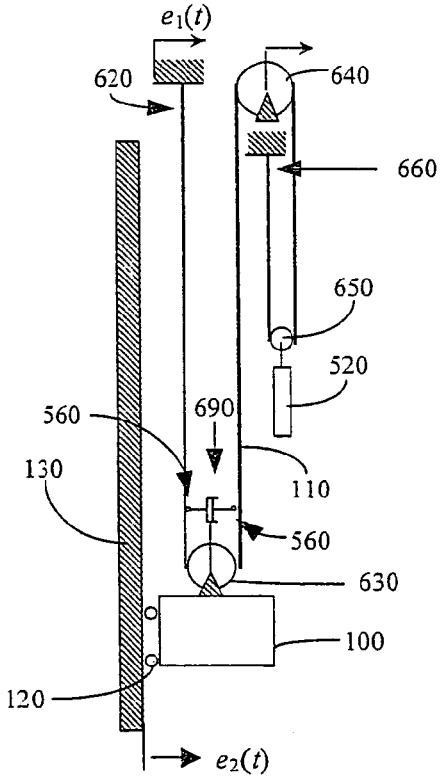
Figure 38B:
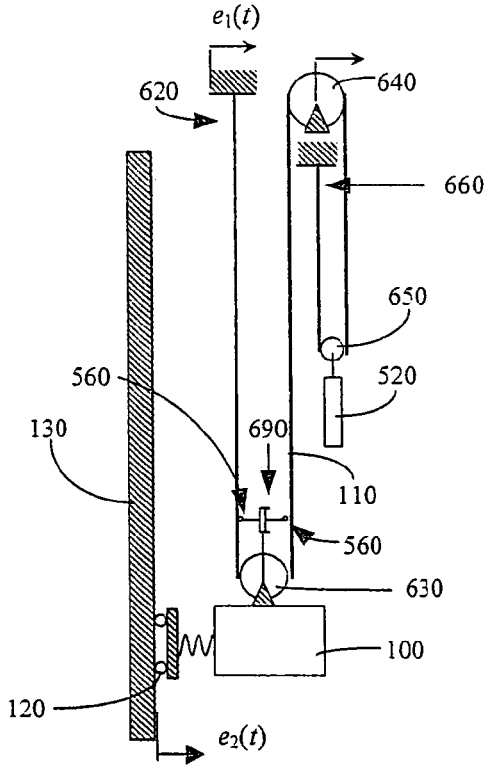
Figure 39:
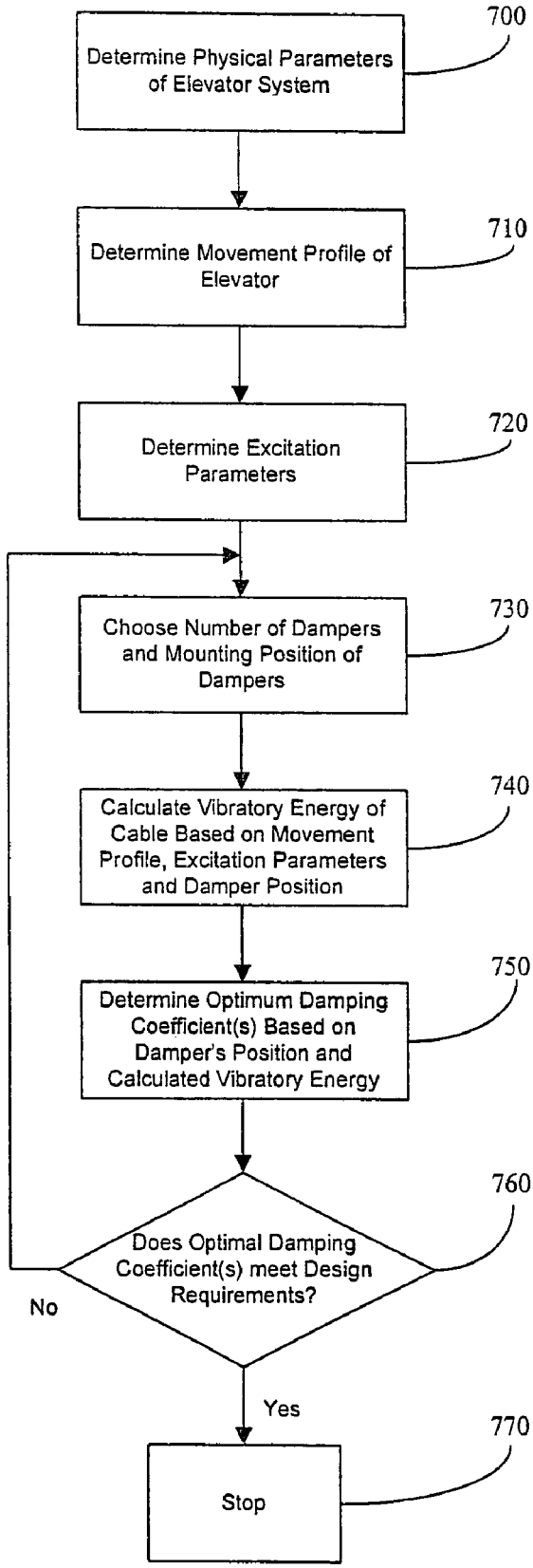

respectively (the solid and dashed lines are indistinguishable);

FIGS. 5(*a*)-5(*c*) are plots of the forced responses of the model in FIG. 1(*a*) with different numbers of included modes (n=2 (dotted line), n=5 (dashed line), and n=20 (solid line)) for y(12,t), $y_t(12,t)$, $E_v(t)$, and $$\left[\frac{dE_v(t)}{dt}\right]_{cv},$$

respectively (the solid and dashed lines are indistinguishable);

FIGS. 6(*a*)-6(*c*) are plots of the forced responses of the model in FIG. 1(*c*) with different numbers of included modes (n=10 (dotted line), n=40 (dashed line), and n=60 (solid line)) for y(12,t), $y_t(12,t)$, $E_v(t)$, and $$\left[\frac{dE_v(t)}{dt}\right]_{cv},$$

respectively (the solid and dashed lines are indistinguishable);

FIGS. 7(*a*)-7(*c*) are plots of the forced responses of a stationary cable 110 with constant tension and fixed boundaries, modeled as a string (solid line, n=20) and beam for y(12,t), $y_t(12,t)$, $E_v(t)$, and $$\left[\frac{dE_v(t)}{dt}\right]_{cv},$$

respectively, where the tensioned (dashed line, n=20) and untensioned (dotted line, n=100) beam eigenfunctions are used as the trial functions for the beam model (the solid and dashed lines are indistinguishable);

FIGS. 8(*a*)-8(*d*) are plots of the forced responses of the three models of FIGS. 1(*a*)-1(*c*) for y(12,t), $y_t(12,t)$, $E_v(t)$, and $$\left[\frac{dE_v(t)}{dt}\right]_{cv},$$

respectively (solid line is for model of FIG. 1(*a*) with n=20; dashed line is for model of FIG. 1(*b*) with n=20; and dotted line is for model of FIG. 1(*c*) with n=60—the solid and dashed lines are indistinguishable);

FIGS. 9(*a*)-9(*d*) are plots of the forced responses of the models of FIGS. 1(*a*) and 1(*c*) under the low excitation frequencies for y(12,t), $y_t$(12,t), $E_v$(t), and $$\left[\frac{dE_v(t)}{dt}\right]_{cv},$$

respectively (solid line is for model of FIG. 1(*a*) with n=20; dashed line is for model of FIG. 1(*c*) with n=30—the solid and dashed lines are virtually indistinguishable);

FIGS. 10(*a*)-10(*d*) are plots of the forced responses of the models in FIGS. 1(*a*) and 1(*c*) under the high excitation frequencies for y(12,t), $y_t$(12,t), $E_v$(t), and $$\left[\frac{dE_v(t)}{dt}\right]_{cv},$$

respectively (solid line is for model of FIG. 1(*a*) with n=20; dashed line is for model of FIG. 1(*c*) with n=60; dashed line is for model of FIG. 1(*c*) with n=200—the solid and dashed lines are virtually indistinguishable);

FIG. 11 is a plot showing the displacements of the string model with constant tension using the modal (dashed line, n=20) and wave (solid line) methods (the solid and dashed lines are indistinguishable);

FIG. 12(*a*) is a contour plot of the damping effect for upper boundary excitation when a damper is fixed to the wall or other rigid supporting structure;

FIG. 12(*b*) is a contour plot of the damping effect for upper boundary excitation when a damper is fixed to the elevator car;

FIG. 12(*c*) is a contour plot of the damping effect for lower boundary excitation when a damper is fixed to the wall or other rigid supporting structure;

FIG. 12(*d*) is a contour plot of the damping effect for lower boundary excitation when a damper is fixed to the car;

FIG. 13 is a schematic of a prototype elevator, in accordance with the present invention;

FIG. 14 is a schematic of a model elevator, in accordance with the present invention;

FIGS. 15(*a*)-15(*d*) are plots showing a movement profile of the prototype elevator, where FIG. 15(*a*) shows position, 15(*b*) shows velocity, 15(*c*) shows acceleration, and 15(*d*) shows jerk;

FIG. 16(*a*) is a plot showing the prototype tension at the top of the car under the movement profile in FIG. 15;

FIGS. 16(*b*) and 16(*c*) are plots of the tension at the top of the car for the full and half models under the movement profiles corresponding to that for the prototype in FIG. 15, respectively, with the motor at the top left (solid), bottom left (dashed), top right (dash-dotted), and bottom right (dotted) positions;

FIGS. 17(*a*) and 17(*b*) are plots of the displacement and velocity, respectively, of the prototype cable (solid) at $x_p$=12 m and those predicted by the half model (dashed) with the motor at the top left position;

FIG. 17(*c*) is a plot of the vibratory energy of the prototype cable (solid) and those predicted by the half models with the motor at the top (dashed) and bottom (dotted) left positions;

FIGS. 18(*a*) and 18(*b*) are plots of the displacement and velocity, respectively, of the prototype cable (solid) at $x_p$=12 m and those predicted by the full model (dashed) with the motor at the top left position;

FIG. 18(*c*) is a plot of the vibratory energy of the prototype cable (solid) and those predicted by the full models with the motor at the top (dashed) and bottom (dotted) left positions;

FIG. 19(*a*) is a contour plot of the average vibratory energy ratio of the prototype cable during upward movement with its isoline values in percentage labeled;

FIG. 19(*b*) is a contour plot of the final vibratory energy ratio of the prototype cable during upward movement with its isoline values in percentage labeled;

FIG. 20(*a*) is the average vibratory energy ratio of the prototype cable during upward movement from the ground to the top of the building with the first 12 modes as the initial disturbance;

FIG. 20(*b*) is the average vibratory energy ratio of the prototype cable during upward movement from the middle to the top of the building with the first 12 modes as the initial disturbance;

FIG. 20(*c*) is the average vibratory energy ratio of the prototype cable during upward movement from the ground to the middle of the building with the first 12 modes as the initial disturbance;

FIG. 20(*d*) is the final vibratory energy ratio of the prototype cable during upward movement from the ground to the top of the building with the first 12 modes as the initial disturbance;

FIGS. 21(*a*) and 21(*b*) are the plots of the displacement and velocity, respectively, of the prototype cable at $x_p$=12 m with the damper mounted 2.5 m above on the car (solid line) and the damper fixed to the wall 2.5 m below the top (dashed line);

FIG. 21(*c*) is a plot of the vibratory energy of the prototype cable with the damper mounted 2.5 m above on the car (solid line) and the damper fixed to the wall 2.5 m below the top (dashed line);

FIG. 22 is a contour plot of the average vibratory energy ratio of the prototype cable during upward movement with its isoline values in J labeled, where the damper is fixed to the wall 2.5 m below the top;

FIGS. 23(*a*) and 23(*b*) are plots showing uncontrolled (solid) and controlled displacements and vibratory energies, respectively, of the prototype cable with natural damping, $K_{vp}$=2050 Ns/m shown with dashed lines and $K_{vp}$=375 Ns/m shown with dotted lines;

FIG. 24 is a schematic of an experimental setup used for a scaled elevator;

FIG. 25 is a plot showing the measured tension difference of the band between upward and downward movements with constant velocity as a function of the position of the car, where the dotted line is the original signal, the dashed line is the filtered signal and the solid line is a linearly curve-fitted, filtered signal;

FIG. 26 is a plot showing the natural damping ratio of the stationary band with varying length, where (□) are experimental data and the line is from the linear curve fit of the data;

FIGS. 27(*a*) and 27(*b*) are plots showing measured (solid line) and calculated (dashed line) responses of the uncontrolled and controlled stationary bands, respectively, with natural damping;

FIGS. 28(*a*)-28(*c*) are plots showing measured (solid lines) and prescribed (dashed lines) movement profiles for position, velocity, and acceleration, respectively;

FIG. 28(*d*) is a plot showing calculated tensions using measured (solid line) and prescribed (dashed line) movement profiles;

FIGS. 29(*a*) and 29(*b*) are plots showing measured (solid lines) and calculated (dashed lines) responses of the uncontrolled and controlled bands, respectively;

FIG. 29(*c*) is a plot showing calculated vibratory energies of the uncontrolled band with (solid line) and without (dotted line) natural damping and the controlled band with natural damping (dashed line);

FIGS. 30(*a*) and 30(*b*) are schematic diagrams of a vibration dampened 1:1 traction elevator system with a rigid and soft suspension, respectively, in which an elevator mounted damper is used for vibration damping, in accordance with the present invention;

FIGS. 31(*a*) and 31(*b*) are schematic diagrams of a vibration dampened 1:1 traction elevator system with a rigid and soft suspension, respectively, in which a movable damper is used for vibration damping, in accordance with the present invention;

FIG. 31(*c*) is a schematic diagram of a preferred embodiment of a movable damper, in accordance with the present invention;

FIGS. 32(*a*) and 32(*b*) are schematic diagrams of a vibration dampened 1:1 traction elevator system with a rigid and soft suspension, respectively, in which the movable damper is moved via an external motor, in accordance with the present invention;

FIGS. 32(*c*) and 32(*d*) are schematic diagrams of a vibration dampened 1:1 traction elevator system with a rigid and soft suspension, respectively, in which the movable damper is moved via a pulley and cable that are driven by the pulley/motor through a transmission, in accordance with the present invention;

FIGS. 32(*e*) and 32(*f*) are schematic diagrams of a vibration dampened 1:1 traction elevator system with a rigid and soft suspension, respectively, in which the movable damper is rigidly attached to the elevator cable and supported by a structure mounted on the car, in accordance with the present invention;

FIGS. 33(*a*) and 33(*b*) are schematic diagrams of a vibration dampened 1:1 traction elevator system with a rigid and soft suspension, respectively, in which a fixed damper is used for vibration damping, in accordance with the present invention;

FIG. 34 is a schematic diagram showing a preferred method of mounting a fixed damper, in accordance with the present invention;

FIGS. 35(*a*) and 35(*b*) are schematic diagrams of a vibration dampened 2:1 traction elevator system with a rigid and soft suspension, respectively, in accordance with the present invention;

FIGS. 36(*a*) and 36(*b*) are schematic diagrams of a vibration dampened 2:1 traction elevator system with a rigid and soft suspension, respectively, in which movable dampers are used for vibration damping, in accordance with the present invention;

FIGS. 37(*a*) and 37(*b*) are schematic diagrams of a vibration dampened 2:1 traction elevator system with a rigid and soft suspension, respectively, in which fixed dampers are used for vibration damping;

FIGS. 38(*a*) and 38(*b*) are schematic diagrams of a vibration damped 2:1 traction elevator system with a rigid and soft suspension, respectively, utilizing a single elevator mounted damper, in accordance with the present invention; and FIG. 39 is a flowchart of a preferred method for determining the optimum damper placement and damping coefficients, in accordance with the present invention.

DETAILED DESCRIPTION OF PREFERRED EMBODIMENTS

The preferred embodiments of the present invention will now be described with reference to the accompanying drawings. All references cited below are incorporated by reference herein where appropriate for appropriate teachings of additional or alternative details, features and/or technical background.

Vibrations in translating media in general, as well as in elevator cable 110*s* specifically, have been studied. Due to small allowable vibrations, the lateral and vertical cable 110 vibrations in elevators can be assumed to be uncoupled. The natural frequencies associated with the vertical vibration of a stationary cable 110 coupled with an elevator car were calculated in R. M. Chi and H. T. Shu, "Longitudinal Vibration of a Hoist Rope Coupled with the Vertical Vibration of an Elevator Car," Journal of Sound and Vibration, Vol. 148, No. 1, pp. 154-159 (1991). The free and forced lateral vibrations of a stationary string with slowly, linearly varying length were analyzed by T. Yamamoto et al., "Vibrations of a String with Time-Variable Length," Bulletin of the Japan Society of Mechanical Engineers, Vol, 21, No. 162, pp. 1677-1684 (1978). The lateral vibration of a traveling string with slowly, linearly varying length and a mass-spring termination was studied in Y. Terumichi et al., "Nonstationary Vibrations of a String with Time-Varying Length and a Mass-Spring System Attached at the Lower End," Nonlinear Dynamics, Vol. 12, pp. 39-55 (1997). General stability characteristics of horizontally and vertically translating beams and strings with arbitrarily varying length and various boundary conditions were studied in W. D. Zhu and J. Ni, "Energetics and Stability of Translating Media with an Arbitrarily Varying Length," ASME Journal of Vibration and Acoustics, Vol. 122, pp. 295-304 (2000).

While the amplitude of the displacement of a translating medium can behave in a different manner depending on the boundary conditions, the amplitude of the velocity and the vibratory energy decrease and increase in general during extension and retraction, respectively. For instance, the amplitude of the displacement of a cantilever beam decreases during retraction, and that of an elevator cable 110 increases first and then decreases during upward movement, as shown in W. D. Zhu and J. Ni, "Energetics and Stability of Translating Media with an Arbitrarily Varying Length," ASME Journal of Vibration and Acoustics, Vol. 122, pp. 295-304 (2000) and in W. D. Zhu and G. Y. Xu, "Vibration of Elevator cable 110*s* with Small Bending Stiffness," Journal of Sound and Vibration, Vol. 263, pp. 679-699 (2003). An active control methodology using a pointwise control force and/or moment was developed to dissipate the vibratory energy of a translating medium with arbitrarily varying length in W. D. Zhu et al., "Active Control of Translating Media with Arbitrarily Varying Length, ASME Journal of Vibration and Acoustics, Vol. 123, pp. 347-358 (2001). The effects of bending stiffness and boundary conditions on the dynamic response of elevator cable 110*s* were examined in W. D. Zhu and G. Y. Xu, "Vibration of Elevator cable 110*s* with Small Bending Stiffness," Journal of Sound and Vibration, Vol. 263, pp. 679-699 (2003). A scaled elevator was designed to simulate the lateral dynamics of a moving cable 110 in a high-rise, high-speed elevator, and is described in W. D. Zhu and L. J. Teppo, "Design and Analysis of a Scaled Model of a High-Rise, High-Speed Elevator," Journal of Sound and Vibration, Vol. 264, pp. 707-731 (2003).

Elevator Cable Dynamics and Damping with Forced Vibration

The lateral response of a moving elevator cable 110 subjected to external excitation due to building sway, pulley eccentricity, and guide-rail irregularity will now be discussed. The cable 110 is modeled as a vertically translating string and tensioned beams following reference, as described in W. D. Zhu and G. Y. Xu, "Vibration of Elevator cable 110*s* with Small Bending Stiffness," Journal of Sound and Vibration, Vol. 263, pp. 679-699 (2003). The displacement at the upper end of the cable 110 and that of the rigid body at the lower end, representing the elevator car 100, are prescribed.

For each model, the rate of change of the energy of the translating medium is analyzed from the control volume and system viewpoints, as described in W. D. Zhu and J. Ni, "Energetics and Stability of Translating Media with an Arbitrarily Varying Length," ASME Journal of Vibration and Acoustics, Vol. 122, pp. 295-304 (2000).

Three spatial discretization schemes are used for each model and the convergence of the model was investigated. To examine the accuracy of the solution from the modal approach, the approximate solution for the case of the translating string with variable length and constant tension was compared with its exact solution using the wave method, following the methodology described in W. D. Zhu and B. Z. Guo, "Free and Forced of an Axially Moving String with an Arbitrary Velocity Profile," Journal of Applied Mechanics, Vol. 65, pp. 901-907 (1998).

Model and Governing Equation

The vertically translating hoist cable 110 in elevators has no sag and can be modeled as a taut string, as shown in FIG. 1(*a*), and tensioned beams with pinned and fixed boundaries, as shown in FIGS. 1(*b*) and 1(*c*), respectively. The elevator car 100 is modeled as a rigid body of mass $m_e$ attached at the lower end of the cable 110. The car 100 includes a slide mechanism 120, that allow the car 100 to travel up and down along guide rails (not shown) that are attached to a rigid supporting structure 130, such as a wall of a building. The suspension of the car 100 against the guide rails is assumed to be rigid. A damper 530 movably attached at one end to the cable 110 and movably attached at a second end to the rigid supporting structure 130. The displacement of the upper end of the cable 110, specified by $e_1(t)$ where t is time, represents external excitation that can arise from building sway and pulley eccentricity. The displacement of the lower end of the cable 110, specified by $e_2(t)$, represents external excitation due to guide-rail irregularity. Since the allowable vibration in elevators is very small, the lateral and longitudinal vibrations of elevator cable 110 can be assumed to be uncoupled and the longitudinal vibration is not considered here.

The equation governing the lateral motion of the translating cable 110 in FIGS. 1(*b*) and 1(*c*) in the x-y plane, subjected to a pointwise damping force at x=θ, where θ can be a constant or depend on time t, is $$\rho(y_{tt}(x,t)+2v(t)y_{xt}(x,t)+v^2(t)y_{xx}(x,t)+\dot{v}(t)y_x(x,t)]+ EIy_{xxxx}(x,t)-T_x(x,t)y_x(x,t)-T(x,t)y_{xx}(x,t)=Q(x,t), \quad 0<x<\theta,\ \theta<x<l(t), \tag{1}$$

where the subscripts x and t denote partial differentiation, the overdot denotes time differentiation, y(x,t) is the lateral displacement of the cable 110 particle instantaneously located at position x at time t, l(t) is the length of the cable 110 at time t, v(t)=l(t) and $\dot{v}(t)=\ddot{l}(t)$ are the axial velocity and acceleration of the cable 110, respectively, ρ and EI are the linear density and bending stiffness of the cable 110, respectively, Q(x,t) is the distributed external force acting on the cable 110, and T(x,t) is the tension at position x at time t given by $$T(x,t)=[m_e+\rho(l(t)-x)][g-\dot{v}(t)], \tag{2}$$

in which g is the acceleration of gravity. Note that when no damping force is applied, the vibration of the cable is governed by (1) with 0<x<l(t). We consider the range of acceleration $\dot{v}<g$ so that the tension in (2) is always positive. The governing equation for the model in FIG. 1(*a*) is given by (1) with EI=0.

When the damping force is applied, the internal condition of the string model is $$f_c=Ty_x(\theta^+,t)-Ty_x(\theta^-,t) \tag{3}$$

and the internal conditions of the beam models are given by ( ) and $$f_c=EIy_{xxx}(\theta^+,t)-EIy_{xxx}(\theta^-,t) \tag{4}$$

where $f_c$ is the damping force.

The initial displacement and velocity of the cable 110 are given by y(x,0) and $y_t(x,0)$, respectively, where 0<x<l(0). The boundary conditions of the cable 110 in FIG. 1(*a*) are $$y(0,t)=e_1(t),\ y(l(t),t)=e_2(t). \tag{5}$$

The boundary conditions of the cable 110 in FIG. 1(*b*) are given by the two conditions in (5) and $$y_{xx}(0,t)=0,\ y_{xx}(l(t),t)=0. \tag{6}$$

The boundary conditions of the cable 110 in FIG. 1(*c*) are given by the two conditions in (5) and $$y_x(0,t)=0,\ y_x(l(t),t)=0. \tag{7}$$

The governing equation (1) with the time-dependent boundary conditions (5) can be transformed to one with the homogeneous boundary conditions. The lateral displacement is expressed in the form $$y(x,t)=u(x,t)+h(x,t), \tag{8}$$

where u(x,t) is selected to satisfy the corresponding homogenous boundary conditions and h(x,t) compensates for the effects in the boundary conditions that are not satisfied by u(x,t). Substituting (8) into (1) yields $$\rho(u_{tt}+2vu_{xt}+v^2u_{xx}+\dot{v}u_x)+EIu_{xxxx}-T_xu_x-Tu_{xx}=f(x,t)+Q(x,t),\ 0<x<\theta,\ \theta<x<l(t), \tag{9}$$

where $$f(x,t)=-\rho(h_{tt}+2vh_{xt}+v^2h_{xx}+\dot{v}h_x)+T_xh_x+Th_{xx} \tag{10}$$

is the additional forcing term induced by transforming the non-homogeneous boundary conditions for y(x,t) to the homogeneous boundary conditions for u(x,t). The corresponding initial conditions for u(x,t) are $$u(x,0)=y(x,0)-h(x,0),\ u_t(x,0)=y_t(x,0)-h_t(x,0). \tag{11}$$

Substituting (8) into (5) and (6) and setting $$h(0,t)=e_1(t),\ h(l(t),t)=e_2(t),\ h_{xx}(0,t)=0,\ h_{xx}(l(t),t)=0 \tag{12}$$

yields the homogeneous boundary conditions for u(x,t) in the model in FIG. 1(*b*). For u(x,t) in the model in FIG. 1(*a*) to satisfy the homogeneous boundary conditions, h(x,t) is selected to satisfy the first two equations in (12). Similarly, substituting (8) into (5) and (7) and setting $$h(0,t)=e_1(t),\ h(l(t),t)=e_2(t),\ h_x(0,t)=0,\ h_x(l(t),t)=0 \tag{13}$$

yields the homogeneous boundary conditions for u(x,t) in the model in FIG. 1(*c*). The function h(x,t) that satisfies (12) or (13) is chosen to be a third polynomial in x:

$$h(x,t)=a_0(t)+a_1(t)\frac{x}{l(t)}+a_2(t)\left(\frac{x}{l(t)}\right)^2+a_3(t)\left(\frac{x}{l(t)}\right)^3, \tag{14}$$

where $a_0(t)$, $a_1(t)$, $a_2(t)$, and $a_3(t)$ are the unknown coefficients that can depend on time. Applying (12) to (14) yields $$a_0(t)=e_1(t),\ a_1(t)=e_2(t)-e_1(t),\ a_2(t)=a_3(t)=0. \tag{15}$$

For the model in FIG. 1(*a*), h(x,t) is chosen to be a first polynomial in x, given by (14) with $a_2(t)=a_3(t)=0$. Applying the first two equations in (12) yields the same h(x,t) for the model in FIG. 1(*a*) as that for the model in FIG. 1(*b*). Similarly, applying (13) to (14) yields $$h(x,t)=e_1(t)-3[e_1(t)-e_2(t)]\left(\frac{x}{l(t)}\right)^2+2[e_1(t)-e_2(t)]\left(\frac{x}{l(t)}\right)^3 \tag{16}$$

for the model in FIG. 1(*c*). The partial derivatives of h(x,t) in (10) and (11) can be obtained once h(x,t) is known. For each model in FIG. 1 the solution for u(x,t) is sought first and y(x,t) is obtained subsequently from (8).

Energy and Rate of Change of Energy

In each model in FIG. 1 the total mechanical energy of the vertically translating cable 110 is $$E_o[y,t]=E_g(t)+E_r(t)+E_v[y,t], \tag{17}$$

where $E_g(t)$ is the gravitational potential energy, $E_r(t)$ is the kinetic energy associated with the rigid body translation, and $E_v[y,t]$ is the energy associated with the lateral vibration. Note that $E_v$ is an integral functional that depends on y(x,t), as will be seen in (20) and (21), and consequently so do $E_o$. When the reference elevation of the cable 110 with zero potential energy is defined at x=0, we have $$E_g(t)=\int_0^{l(t)}\varepsilon_g(x)dx=-\frac{1}{2}\rho g l^2(t), \tag{18}$$

where $\epsilon_g(x)=-\rho gx$ is the gravitational potential energy density. Because the energy density associated with the rigid body translation of the cable 110 is $$\varepsilon_r(t)=\frac{\rho v^2(t)}{2},$$

we have $$E_r(t)=\int_0^{l(t)}\varepsilon_r(t)dx=\frac{1}{2}\rho v^2(t)l(t). \tag{19}$$

The vibratory energy of the cable 110 when it is modeled as a tensioned beam, as shown in FIGS. 1(*b*) and 1(*c*), is $$E_v[y,t]=\int_0^{l(t)}\varepsilon_v dx, \tag{20}$$

where $$\varepsilon_v=\frac{1}{2}\{\rho[y_t+v(t)y_x]^2+T(x,t)y_x^2+EIy_{xx}^2\} \tag{21}$$

is the energy density associated with the lateral vibration. The vibratory energy of the cable 110 when it is modeled as a string, as shown in FIG. 1(*a*), is given by (20) and (21) with EI=0.

The rate of change of the energy of the translating cable 110 can be calculated from the control volume and system viewpoints. The control volume at time t is defined as the spatial domain $0\leqq x\leqq l(t)$, formed instantaneously by the translating cable 110 between the two boundaries, and the system concerned consists of the cable 110 particles of fixed identity, occupying the spatial domain $0\leqq x\leqq l(t)$ at time t. The rate of change of the vibratory energy in (20) from the control volume viewpoint is obtained by differentiating (20) using Leibnitz's rule. For instance, for the model in FIG. 1(*a*), we have $$\left(\frac{dE_{vs}}{dt}\right)_{cv}=\int_0^{l(t)}\left[\rho(y_t+vy_x)(y_{tt}+\dot{v}y_x+vy_{xt})+\frac{1}{2}T_t y_x^2+Ty_xy_{xt}\right]dx+\frac{1}{2}v[\rho(y_t+vy_x)+Ty_x^2]\Big|_{x=l(t)}, \tag{22}$$

where the added subscript s in $E_v$ and the subscript cv denote the string model and the rate of change from the control volume viewpoint, respectively. Differentiating the first and second equations in (5) yields $$y_t(0,t)=\dot{e}_1(t),\ y_t(l(t),t)+v(t)y_x(l(t),t)=\dot{e}_2(t). \tag{23}$$

Using (1) with EI=0 in (22), followed by integration by parts and application of (23) and the internal condition (3), yields $$\begin{aligned}\left(\frac{dE_{vs}}{dt}\right)_{cv}=&-\frac{1}{2}v(t)T(0,t)y_x^2(0,t)+\\&\frac{1}{2}\rho v(t)[\dot{e}_1(t)+vy_x(0,t)]^2-T(0,t)y_x(0,t)\dot{e}_1(t)+\\&T(l,t)y_x(l(t),t)\dot{e}_2(t)-\frac{1}{2}\ddot{v}(t)\int_0^{l(t)}[m_e+\rho(l(t)-x)]y_x^2dx+\\&\int_0^{l(t)}Q(x,t)(y_t+vy_x)dx-\\&f_c(t)\left[y_t(\theta^+,t)+\frac{v+\dot{\theta}}{2}y_x(\theta^+,t)+\frac{v-\dot{\theta}}{2}y_x(\theta^-,t)\right].\end{aligned} \tag{24}$$

Similarly, for the beam models in FIGS. 1(*b*) and 1(*c*), we can obtain respectively the following rates of change of the vibratory energies from the control volume viewpoint:

$$\left(\frac{dE_{vp}}{dt}\right)_{cv} = -\frac{1}{2}v(t)T(0,t)y_x^2(0,t) + \frac{1}{2}\rho v(t)[\dot{e}_1(t) + vy_x(0,t)]^2 - \frac{1}{2}\ddot{v}(t)\int_0^{l(t)}[m_e + \rho(l(t)-x)]y_x^2dx - T(0,t)y_x(0,t)\dot{e}_1(t) + T(l(t),t)y_x(l(t),t)\dot{e}_2(t) - EIy_{xxx}(l(t),t)\dot{e}_2(t) + EIy_{xxx}(0,t)[\dot{e}_1(t) + vy_x(0,t)] + \int_0^{l(t)}Q(x,t)(y_t + vy_x)dx + f_c(t)[y_t(\theta,t) + vy_x(\theta,t)], \tag{25}$$

$$\left(\frac{dE_{vf}}{dt}\right)_{cv} = -\frac{1}{2}v(t)EIy_{xx}^2(0,t) + \frac{1}{2}\rho v(t)\dot{e}_1^2(t) - \frac{1}{2}\ddot{v}(t)\int_0^{l(t)}[m_e + \rho(l(t)-x)]y_x^2dx - EIy_{xxx}(l(t),t)\dot{e}_2(t) + EIy_{xxx}(0,t)\dot{e}_1(t) + \int_0^{l(t)}Q(x,t)(y_t + vy_x)dx + f_c(t)[y_t(\theta,t) + vy_x(\theta,t)], \tag{26}$$

where the added subscripts p and f in $E_v$ denote the pinned and fixed boundary conditions in the models in FIGS. 1(*b*) and 1(*c*), respectively. Note that we have used, similar to (23) in deriving (24), $$y_t(0,t)=\dot{e}_1(t),\ y_t(l(t),t)+v(t)y_x(l(t),t)=\dot{e}_2(t), \tag{27}$$

$$y_{xt}(0,t)=0,\ y_{xt}(l(t),t)+v(t)y_{xx}(l(t),t)=0 \tag{28}$$

along with the boundary conditions in (6) in deriving (25), and (27) and $$y_{xxt}(0,t)=0,\ y_{xxt}(l(t),t)+v(t)y_{xxx}(l(t),t)=0 \tag{29}$$

along with the boundary conditions in (7) in deriving (26).

Because the rate of change of the vibratory energy from the control volume viewpoint describes the instantaneous growth and decay of the vibratory energy of the translating cable 110 with variable length, it can characterize the dynamic stability of the cable 110 in each model in FIG. 1. The first term on the right-hand sides of (24)-(26) is negative and positive definite during downward ($v(t)>0$) and upward ($v(t)<0$) movement of the cable 110, respectively. The second term on the right-hand sides of (24) and (25) is positive and negative definite during downward and upward movement, respectively, competing with the effect of the first term on the right-hand sides of (24) and (25). A positive and negative jerk $\dddot{v}(t)$ has a stabilizing and destabilizing effect, respectively, as observed from the third term on the right-hand sides of (24) and (25) and the second term on the right-hand side of (26). All the other terms on the right-hand sides of (24)-(25) are sign-indefinite.

The rate of change of the total mechanical energy from the control volume viewpoint is obtained for each model in FIG. 1 by differentiating (13) and using (18) and (19):

$$\left(\frac{dE_o}{dt}\right)_{cv} = \frac{1}{2}\rho v^3 - \rho l(t)[g - \dot{v}(t)]v(t) + \left(\frac{dE_v}{dt}\right)_{cv}, \tag{30}$$

where the last term is given by (24)-(26) for the models in FIGS. 1(*a*)-(1c), respectively. The rate of change of the total mechanical energy from the system viewpoint is related to that from the control volume viewpoint through the Reynolds transport theorem:

$$\left(\frac{dE_o}{dt}\right)_{sys} = \left(\frac{dE_o}{dt}\right)_{cv} - v(t)\varepsilon(0,t), \tag{31}$$

where $\epsilon(0,t)=\epsilon_g(0)+\epsilon_r(t)+\epsilon_v(0,t)$ is the total energy density of the cable 110 at x=0 and time t in which $\epsilon_g(0)=0$, and the subscript sys denotes the rate of change from the system viewpoint.

For the models in FIGS. 1(*a*), 1(*b*) and 1(*c*), we obtain respectively the following rates of change of the total mechanical energies from the system viewpoint:

$$\left(\frac{dE_{os}}{dt}\right)_{sys} = -\rho l(t)[g - \dot{v}(t)]v(t) - v(t)T(0,t)y_x^2(0,t) - T(0,t)y_x(0,t)\dot{e}_1(t) + T(l,t)y_x(l(t),t)\dot{e}_2(t) - \frac{1}{2}\ddot{v}(t)\int_0^{l(t)}[m_e + \rho(l(t)-x)]y_x^2dx + \int_0^{l(t)}Q(x,t)[y_t + v(t)y_x]dx - f_c(t)\left[y_t(\theta^+,t) + \frac{v+\dot{\theta}}{2}y_x(\theta^+,t) + \frac{v-\dot{\theta}}{2}y_x(\theta^-,t)\right], \tag{32}$$

$$\left(\frac{dE_{op}}{dt}\right)_{sys} = -\rho l(t)[g - \dot{v}(t)]v(t) - v(t)T(0,t)y_x^2(0,t) - T(0,t)y_x(0,t)\dot{e}_1(t) + T(l,t)y_x(l(t),t)\dot{e}_2(t) - EIy_{xxx}(l(t),t)\dot{e}_2(t) + EIy_{xxx}(0,t)[\dot{e}_1(t) + v(t)y_x(0,t)] + \int_0^{l(t)}Q(x,t)[y_t + v(t)y_x]dx - \frac{1}{2}\ddot{v}(t)\int_0^{l(t)}[m_e + \rho(l(t)-x)]y_x^2dx + f_c(t)[y_t(\theta,t) + vy_x(\theta,t)], \tag{33}$$

$$\left(\frac{dE_{of}}{dt}\right)_{sys} = -\rho l(t)[g - \dot{v}(t)]v(t) - v(t)EIy_{xx}^2(0,t) + EIy_{xxx}(0,t)[\dot{e}_1(t) + vy_x(0,t)] - EIy_{xxx}(l(t),t)\dot{e}_2(t) + \int_0^{l(t)}Q(x,t)[y_t + v(t)y_x]dx - \frac{1}{2}\ddot{v}(t)\int_0^{l(t)}[m_e + \rho(l(t)-x)]y_x^2dx + f_c(t)[y_t(\theta,t) + vy_x(\theta,t)]. \tag{34}$$

The rate of change of the total mechanical energy from the system viewpoint, as calculated above for each model in FIG. 1, is shown to provide an instantaneous work and energy relation for the system of the cable particles, located in the spatial domain $0 \leqq x \leqq l(t)$ at time t. Because the tension in the cable 110 varies with time, the potential energy associated with the tension is time-dependent. The work and energy relation for a system of particles with a time-dependent potential energy states that the rate of change of the total mechanical energy of the system equals the resultant rate of work done by the nonpotential forces plus the partial time derivative of the time-dependent potential energy.

Figures 2A, 2B, 2C:
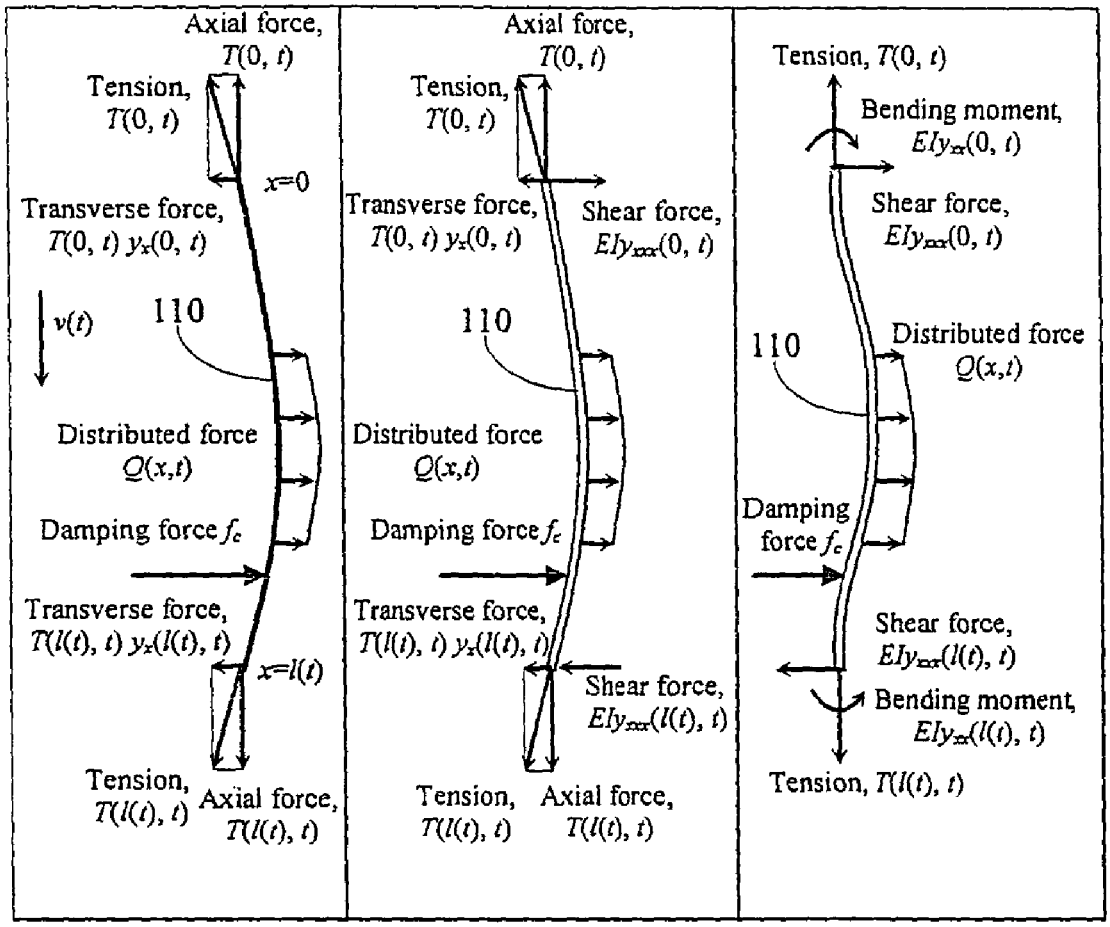
FIGS. 2(*a*)-2(*c*) are schematic diagrams showing nonpotential generalized forces acting on the systems of FIGS. 1(*a*)-1(*c*), respectively, at time t.

The nonpotential generalized forces acting on the system in each model in FIG. 1, as shown in FIG. 2, include forces—such as the axial forces, transverse forces, shear forces, damping force, and distributed external forces—and moments—such as the bending moments in FIG. 2(*c*)—exerted by the cable 110 segment above the system and by the car 100 at the two ends of the system. Note that the standard sign convention for internal forces is used for the tensions, shear forces, and bending moments at the two ends of the system, and the linear theory is used to approximate the axial and transverse forces at the two ends of the system in FIGS. 2(*a*) and 2(*b*).

The rates of work done by nonpotential generalized forces for the model of FIG. 1(*a*) are shown in Table 1 below:

TABLE 1

Rates of work done by nonpotential generalized forces for the model in FIG. 1(a)

| | Generalized force | Generalized velocity | Rate of work |
|---|---|---|---|
| Axial force at x = 0 | $-(m_e + \rho l)(g - \dot{v})$ | $v$ | $-(m_e + \rho l)(g - \dot{v})v$ |
| Transverse force at x = 0 | $-T(0, t)y_x(0, t)$ | $\frac{Dy(0, t)}{Dt} = \dot{e}_1 + vy_x(0, t)$ | $-T(0, t)y_x(0, t)[\dot{e}_1 + vy_x(0, t)]$ |
| Axial force at x = l(t) | $m_e(g - \dot{v})$ | $v$ | $m_e(g - \dot{v})v$ |
| Transverse force at x = l(t) | $T(l, t)y_x(l, t)$ | $\frac{Dy(l, t)}{Dt} = \dot{e}_2$ | $T(l, t)y_x(l, t)\dot{e}_2$ |
| Distributed force | $Q(x, t)$ | $\frac{Dy(x, t)}{Dt} = y_t(x, t) + vy_x(x, t)$ | $Q(x, t)[y_t(x, t) + vy_x(x, t)]$ |
| Damping force at x = θ | $f_c(t)$ | $y_t(\theta^+, t) + \frac{v + \dot{\theta}}{2}y_x(\theta^+, t) + \frac{v - \dot{\theta}}{2}y_x(\theta^-, t)$ | $f_c(t)\left[y_t(\theta^+, t) + \frac{v + \dot{\theta}}{2}y_x(\theta^+, t) + \frac{v - \dot{\theta}}{2}y_x(\theta^-, t)\right]$ |

The rates of work done by nonpotential generalized forces for the model of FIG. 1(*b*) are shown in Table 2 below:

TABLE 2

Rates of work done by nonpotential generalized forces for the model in FIG. 1(b)

| | Generalized force | Generalized velocity | Rate of work |
|---|---|---|---|
| Axial force at x = 0 | $-(m_e + \rho l)(g - \dot{v})$ | $v$ | $-(m_e + \rho l)(g - \dot{v})v$ |
| Transverse force at x = 0 | $-T(0, t)y_x(0, t)$ | $\frac{Dy(0, t)}{Dt} = \dot{e}_1 + vy_x(0, t)$ | $-T(0, t)y_x(0, t)[\dot{e}_1 + vy_x(0, t)]$ |
| Shear force at x = 0 | $EIy_{xxx}(0, t)$ | $\frac{Dy(0, t)}{Dt} = \dot{e}_1 + vy_x(0, t)$ | $EIy_{xxx}(0, t)[\dot{e}_1 + vy_x(0, t)]$ |
| Axial force at x = l(t) | $m_e(g - \dot{v})$ | $v$ | $m_e(g - \dot{v})v$ |
| Transverse force at x = l(t) | $T(l, t)y_x(l, t)$ | $\frac{Dy(l, t)}{Dt} = \dot{e}_2$ | $T(l, t)y_x(l, t)\dot{e}_2$ |
| Shear force at x = l(t) | $-EIy_{xxx}(l, t)$ | $\frac{Dy(l, t)}{Dt} = \dot{e}_2$ | $-EIy_{xxx}(l, t)\dot{e}_2$ |
| Distributed force | $Q(x, t)$ | $\frac{Dy(x, t)}{Dt} = y_t(x, t) + vy_x(x, t)$ | $Q(x, t)[y_t(x, t) + vy_x(x, t)]$ |
| Damping force at x = θ | $f_c(t)$ | $\frac{Dy(\theta, t)}{Dt} = y_t(\theta, t) + vy_x(\theta, t)$ | $f_c(t)[y_t(\theta, t) + vy_x(\theta, t)]$ |

The rates of work done by nonpotential generalized forces for the model of FIG. 1(*c*) are shown in Table 3 below:

TABLE 3

Rates of work done by nonpotential generalized forces for the model in FIG. 1(c)

| | Generalized force | Generalized velocity | Rate of work |
|---|---|---|---|
| Tension at x = 0 | $-(m_e+\rho l)(g-\dot{v})$ | v | $-(m_e+\rho l)(g-\dot{v})v$ |
| Bending moment at x = 0 | $-EIy_{xx}(0, t)$ | $\frac{Dy_x(0, t)}{Dt} = y_{xt}(0, t) + vy_{xx}(0, t) = vy_{xx}(0, t)$ | $-vEIy^2_{xx}(0, t)$ |
| Shear force at x = 0 | $EIy_{xxx}(0, t)$ | $\frac{Dy(0, t)}{Dt} = y_t(0, t) + vy_x(0, t) = \dot{e}_1 + vy_x(0, t)$ | $EIy_{xxx}(0, t)[\dot{e}_1 + vy_x(0, t)]$ |
| Tension at x = l(t) | $m_e(g-\dot{v})$ | v | $m_e(g-\dot{v})v$ |
| Bending moment at x = l(t) | $EIy_{xx}(l, t)$ | $\frac{Dy_x(l, t)}{Dt} = y_{xt}(l, t) + vy_{xx}(l, t) = vy_{xx}(l, t)$ | $T(l, t)y_x(l, t)\dot{e}_2$ |
| Shear force at x = l(t) | $-EIy_{xxx}(l, t)$ | $\frac{Dy(l, t)}{Dt} = \dot{e}_2$ | $-EIy_{xxx}(l, t)\dot{e}_2$ |
| Distributed force | Q(x, t) | $\frac{Dy(x, t)}{Dt} = y_t(x, t) + vy_x(x, t)$ | $Q(x, t)[y_t(x, t) + vy_x(x, t)]$ |
| Damping force at x = θ | $f_c(t)$ | $\frac{Dy(\theta, t)}{Dt} = y_t(\theta, t) + vy_x(\theta, t)$ | $f_c(t)[y_t(\theta, t) + vy_x(\theta, t)]$ |

With the positive directions for the forces along the positive x and y axes and that for the moments along the counterclockwise direction, the rates of work done by the nonpotential generalized forces in FIG. 2 are the products of the generalized forces and the corresponding generalized velocities, as shown in Tables 1-3, where $$\frac{D}{Dt} = \frac{\partial}{\partial t} + v(t)\frac{\partial}{\partial x}.$$

The sum of the rates of work done by the axial forces at the two ends of the system in Tables 1-3 equals the first term on the right-hand sides of (32), (33) and (34) and the rates of work done by the other generalized forces correspond to the other terms on the right-hand sides of (32), (33) and (34) except the term before the last.

Given a linear viscous damper fixed to the cable, $\dot{\theta}=v$ and the damping forces in the string model and in the beam models are chosen to be $$f_c(t)=-K_c[y_t(\theta^+,t)+vy_x(\theta^+,t)] \tag{35}$$

$$f_c(t)=-K_c[y_t(\theta,t)+vy_x(\theta,t)] \tag{36}$$

respectively, where $K_c$ is a positive constant. The damping forces in (35) and (36) render the last terms on the right-hand side of (32), (33), (34) non-positive. In the following spatial discretization schemes, only this case is discussed.

Given a linear viscous damper is fixed to the wall, the damping forces in string model and in the beam models are $$f_c(t)=-K_c y_t(\theta,t) \tag{37}$$

$$f_c(t)=-K_c y_t(\theta,t) \tag{38}$$

respectively, where $K_c$ is a positive constant.

Through discretization of the time-dependent potential energy, $$V_1[y, t] = \frac{1}{2}\int_0^{l(t)} T(x, t)y_x^2\, dx,$$

the term before the last in (32), (33) and (34) has been shown in Zhu and Ni, "Energetics and Stability of Translating Media with an Arbitrary Varying Length," ASME Journal of Vibration and Acoustics, Vol. 122, pp. 295-304 (2000), to be its partial time derivative.

Spatial Discretization

Three spatial discretization schemes are used to obtain the approximate solution for u(x,t) in each model in FIG. 1. In the first scheme a new independent variable $$\xi = \frac{x}{l(t)}$$

is introduced and the time-varying spatial domain [0,l(t)] for x is converted to a fixed domain [0,1] for ξ. The new dependent variable is $\hat{u}(\xi,t)=u(x,t)$ and the new variable for h(x,t) is $\hat{h}(\xi,t)=h(x,t)$. The partial derivatives of u(x,t) with respect to x and t are related to those of $\hat{u}(\xi,t)$ with respect to ξ and t:

$$u_x = \frac{1}{l(t)}\hat{u}_\xi, \tag{39}$$

$$u_{xx} = \frac{1}{l^2(t)}\hat{u}_{\xi\xi},$$

$$u_{xxx} = \frac{1}{l^3(t)}\hat{u}_{\xi\xi\xi},$$

$$u_{xxxx} = \frac{1}{l^4(t)}\hat{u}_{\xi\xi\xi\xi},$$

$$u_t = \hat{u}_t - \frac{v(t)\xi}{l(t)}\hat{u}_\xi,\ u_{xt} = \frac{1}{l(t)}\hat{u}_{\xi t} - \frac{v(t)\xi}{l^2(t)}\hat{u}_{\xi\xi} - \frac{v(t)}{l^2(t)}\hat{u}_\xi,$$

$$u_{tt} = \hat{u}_{tt} - 2\frac{v(t)\xi}{l(t)}\hat{u}_{\xi t} + \frac{v^2(t)\xi^2}{l^2(t)}\hat{u}_{\xi\xi} - \frac{\xi[l(t)\dot{v}(t) - 2\dot{v}(t)]}{l^2(t)}\hat{u}_\xi,$$

where the subscript $\xi$ denotes partial differentiation. Similarly, the partial derivatives of u(x,t) with respect to x and t, which appear in (9), are related to those of $\hat{u}(\xi,t)$ with respect to $\xi$ and t:

$$h_x = \frac{1}{l(t)}\hat{h}_\xi, \tag{40}$$

$$h_{xx} = \frac{1}{l^2(t)}\hat{h}_{\xi\xi},$$

$$h_{xt} = \frac{1}{l(t)}\hat{h}_{\xi t} - \frac{v(t)\xi}{l^2(t)}\hat{h}_{\xi\xi} - \frac{v(t)}{l^2(t)}\hat{h}_\xi,$$

$$h_{tt} = \hat{h}_{tt} - 2\frac{v(t)\xi}{l(t)}\hat{h}_{\xi t} + \frac{v^2(t)\xi^2}{l^2(t)}\hat{h}_{\xi\xi} - \frac{\xi[l(t)\dot{v}(t) - 2\dot{v}(t)]}{l^2(t)}\hat{h}_\xi.$$

Note that unlike u(x,t) the fourth and higher order derivatives of h(x,t) with respect to x vanish because h(x,t) is at most a third order polynomial in x. Substituting (39) and (40) into (9) and (10) yields $$\rho\left\{\hat{u}_{tt} + \frac{2v(t)}{l(t)}(1-\xi)\hat{u}_{\xi t} + \frac{v^2}{l^2(t)}(1-\xi)^2\hat{u}_{\xi\xi} + \left[\frac{\dot{v}(t)}{l(t)} - \frac{2v^2(t)}{l^2(t)}\right](1-\xi)\hat{u}_\xi\right\} + \frac{EI}{l^4(t)}\hat{u}_{\xi\xi\xi\xi} - \frac{1}{l^2(t)}\hat{T}_\xi(\xi,t)\hat{u}_\xi - \frac{1}{l^2(t)}\hat{T}(\xi,t)\hat{u}_{\xi\xi} = \hat{f}(\xi,t) + Q(\xi l(t),t),\ 0<\xi<\frac{\theta}{l(t)},\ \frac{\theta}{l(t)}<\xi<1, \tag{41}$$

where $$\hat{f}(\xi,t) = -\rho\left[\hat{h}_{tt} + \frac{2v(t)}{l(t)}(1-\xi)\hat{h}_{\xi t} + \frac{v^2(t)}{l^2(t)}(1-\xi)^2\hat{h}_{\xi\xi} + \left[\frac{\dot{v}(t)}{l(t)} - \frac{2v^2(t)}{l^2(t)}\right](1-\xi)\hat{h}_\xi\right] + \frac{1}{l^2}\hat{T}_\xi(\xi,t)\hat{h}_\xi + \frac{1}{l^2(t)}\hat{T}(\xi,t)\hat{h}_{\xi\xi},$$

$$\hat{T}(\xi,t) = [m_e + \rho l(t)(1-\xi)][g - \dot{v}(t)]. \tag{42}$$

The solution of (41) and (42) is assumed in the form $$\hat{u}(\xi,t) = \sum_{j=1}^{n}\psi_j(\xi)q_j(t), \tag{43}$$

where $q_j(t)$ are the generalized coordinates, $\psi_j(\xi)$ are the trial functions, and n is the number of included modes. The eigenfunctions of a string with unit length and fixed boundaries are used as the trial functions for the model in FIG. 1(*a*) and are normalized so that $\int_0^{-1}\psi_j^2(\xi)d\xi=1$. Similarly, the normalized eigenfunctions of the pinned-pinned and fixed-fixed beams with unit length are used as the trial functions for the models in FIGS. 1(*b*) and 1(*c*), respectively. These functions satisfy the orthonormality relation, $\int_0^{-1}\psi_i(\xi)\psi_j(\xi)d\xi=\delta_{ij}$, where $\delta_{ij}$ is the Kronecker delta defined by $\delta_{ij}=1$ if i=j and $\delta_{ij}=0$ if i≠j.

Substituting (43) into (41), multiplying the equation by $\psi_i(\xi)$ (i=1, 2, . . . n), integrating it from $\xi=0$ to 1, and using the boundary conditions and the orthonormality relation for $\psi_j(\xi)$ yields the discretized equations for the models in FIGS. 1(*b*) and 1(*c*):

$$M\ddot{q}(t)+C(t)\dot{q}(t)+K(t)q(t)=F(t), \tag{44}$$

where entries of the system matrices and the force vector are $$M_{ij}=\rho\delta_{ij}, \tag{45}$$

$$C_{ij} = 2\rho\frac{v(t)}{l(t)}\int_0^1(1-\xi)\psi_i(\xi)\psi_j'(\xi)\,d\xi + \frac{K_c}{l(t)}\psi_i\left(\frac{\theta}{l(t)}\right)\psi_j\left(\frac{\theta}{l(t)}\right) \tag{46}$$

$$K_{ij} = \rho\left[\frac{\dot{v}(t)}{l(t)}\int_0^1(1-\xi)\psi_i(\xi)\psi_j'(\xi)\,d\xi - \frac{v^2(t)}{l^2(t)}\int_0^1(1-\xi)^2\psi_i'(\xi)\psi_j'(\xi)\,d\xi\right] + \frac{EI}{l^4(t)}\int_0^1\psi_i''(\xi)\psi_j''(\xi)\,d\xi + (g-\dot{v})\left[\frac{m_e}{l^2(t)}\int_0^1\psi_i'(\xi)\psi_j'(\xi)\,d\xi + \frac{\rho}{l(t)}\int_0^1(1-\xi)\psi_i'(\xi)\psi_j'(\xi)\,d\xi\right] + K_c\frac{v(t)[l(t)-\theta]}{l^3(t)}\psi_i\left(\frac{\theta}{l(t)}\right)\psi_j'\left(\frac{\theta}{l(t)}\right), \tag{47}$$

$$F_i = \int_0^1\left[\hat{f}(\xi,t) + Q(\xi l(t),t)\right]\psi_i(\xi)\,d\xi. \tag{48}$$

Note that while the trial functions used in (45)-(48) for the models in FIGS. 1(*b*) and 1(*c*) are different, the discretized equations for the two models have the same form. The discretized equations for the model in FIG. 1(*a*) are given by (45)-(48) with EI=0 in (47). Substituting (43) into the first equation in (11), multiplying the equation by $\psi_i(\xi)$, and using the orthonormality relation for $\psi_j(\xi)$ yields $$q_i(0)=\int_0^1[v(\xi l(0),0)-h(\xi l(0),0)]\psi_i(\xi)d\xi. \tag{49}$$

Differentiating (43) with respect to $\xi$, substituting the expression into the fifth equation in (39), multiplying the equation by $\psi_i(\xi)$, and using the second equation in (11) and the orthonormality relation for $\psi_j(\xi)$ yields $$\dot{q}_i(0) = \frac{v(0)}{l(0)}\sum_{j=1}^{n} q_j(0)\int_0^1 \xi\psi_i(\xi)\psi_j'(\xi)\,d\xi + \int_0^1 [y_t(\xi l(0), 0) - h_t(\xi l(0), 0)]\psi_i(\xi)\,d\xi. \tag{50}$$

Using (8), (39), and (43) in (20) and (21) yields the discretized expression of the vibratory energy for the models in FIGS. 1(*b*) and 1(*c*):

$$E_v(t) = \frac{1}{2}[l(t)\dot{q}^T(t)M\dot{q}(t) + l(t)\dot{q}^T(t)C(t)q(t) + q^T(t)S(t)q(t)] + P^T(t)\dot{q}(t) + R^T(t)q(t) + W(t), \tag{51}$$

where $$S_{ij} = \rho\frac{v^2(t)}{l(t)}\int_0^1 (1-\xi)^2\psi_i'(\xi)\psi_j'(\xi)\,d\xi + \frac{m_e[g-\dot{v}(t)]}{l(t)}\int_0^1 \psi_i'(\xi)\psi_j'(\xi)\,d\xi + \rho[g-\dot{v}(t)]\int_0^1 (1-\xi)\psi_i'(\xi)\psi_j'(\xi)\,d\xi + \frac{EI}{l^3(t)}\int_0^1 \psi_i''(\xi)\psi_j''(\xi)\,d\xi, \tag{52}$$

$$P_i = \rho l(t)\int_0^1 \left[\hat{h}_t + \frac{v(t)}{l(t)}(1-\xi)\hat{h}_\xi\right]\psi_i(\xi)\,d\xi, \tag{53}$$

$$R_i = \rho v(t)\int_0^1 \left[\hat{h}_t + \frac{v(t)}{l(t)}(1-\xi)\hat{h}_\xi\right](1-\xi)\psi_i'(\xi)\,d\xi + \frac{EI}{l^3(t)}\int_0^1 \psi_i''(\xi)\hat{h}_{\xi\xi}\,d\xi + \int_0^1 \left[\frac{m_e}{l(t)} + \rho(1-\xi)\right][g-\dot{v}(t)]\hat{h}_\xi\psi_i'(\xi)\,d\xi, \tag{54}$$

$$W = \frac{1}{2}\left\{\rho l(t)\int_0^1 \left[\hat{h}_t + \frac{v(t)}{l(t)}(1-\xi)\hat{h}_\xi\right]^2 d\xi + \int_0^1 \left[\frac{m_e}{l(t)} + \rho(1-\xi)\right][g-\dot{v}(t)]\hat{h}_\xi^2\,d\xi + \frac{EI}{l^3(t)}\int_0^1 \hat{h}_{\xi\xi}^2\,d\xi\right\}. \tag{55}$$

The discretized expression of the vibratory energy for the model in FIG. 1(*a*) is given by (51)-(55) with EI=0 in (52), (54), and (55). Using (8), (39), and (43) in (25) yields the discretized expression of the rate of change of the vibratory energy from the control volume viewpoint for the model in FIG. 1(*b*):

$$\left(\frac{dE_{vp}}{dt}\right)_{cv} = \dot{q}^T(t)U(t)\dot{q}(t) + \dot{q}^T(t)V(t)q(t) + q^T(t)B(t)q(t) + D^T(t)q(t) + H(t) + N^T(t)\dot{q}(t), \tag{56}$$

where $$U_{ij} = -K_c\psi_i\left(\frac{\theta}{l(t)}\right)\psi_j\left(\frac{\theta}{l(t)}\right) \tag{57}$$

$$V_{ij} = -2K_c\frac{v[l(t)-\theta]}{l^2(t)}\psi_i\left(\frac{\theta}{l(t)}\right)\psi_j'\left(\frac{\theta}{l(t)}\right) \tag{58}$$

-continued $$B_{ij} = \frac{1}{2}\rho\frac{v^3(t)}{l^2(t)}\psi_i'(0)\psi_j'(0) - \frac{1}{2}\frac{v(t)}{l^2(t)}\hat{T}(0,t)\psi_i'(0)\psi_j'(0) + EI\frac{v(t)}{l^4(t)}\psi_i'(0)\psi_j'''(0) - \frac{1}{2}\dot{v}(t)\int_0^1 \left[\frac{m_e}{l} + \rho(1-\xi)\right]\psi_i'(\xi)\psi_j'(\xi)\,d\xi - K_c\frac{v^2[l(t)-\theta]^2}{l^4(t)}\psi_i'\left(\frac{\theta}{l(t)}\right)\psi_j'\left(\frac{\theta}{l(t)}\right), \tag{59}$$

$$D_i = \rho\frac{v^2(t)}{l(t)}\left[\dot{e}_1(t) + \frac{v(t)}{l(t)}\hat{h}_\xi(0,t)\right]\psi_i'(0) + \frac{1}{l}\hat{T}(1,t)\dot{e}_2(t)\psi_i'(1) - \frac{\hat{T}(0,t)}{l(t)}\left[\dot{e}_1(t) + \frac{v(t)}{l(t)}\hat{h}_\xi(0,t)\right]\psi_i'(0) - \dot{v}(t)\int_0^1 \left[\frac{m_e}{l(t)} + \rho(1-\xi)\right]\hat{h}_\xi\psi_i'(\xi)\,d\xi + EI\frac{v(t)}{l^4(t)}\psi_i'(0)\hat{h}_{\xi\xi\xi}(0,t) + \frac{EI}{l^3}\psi_i'''(0)\left[\dot{e}_1(t) + \frac{v(t)}{l(t)}\hat{h}_\xi(0,t)\right] - \frac{EI}{l^3}\psi_i'''(1)\dot{e}_2(t) + v\int_0^1 Q(\xi,t)(1-\xi)\psi_i'(\xi)\,d\xi - 2K_c\frac{v(t)[l(t)-\theta]}{l^2(t)}\hat{h}_t\left(\frac{\theta}{l(t)},t\right)\psi_i'\left(\frac{\theta}{l(t)}\right) - 2K_c\frac{v^2(t)[l(t)-\theta]^2}{l^4(t)}\hat{h}_\xi\left(\frac{\theta}{l(t)},t\right)\psi_i'\left(\frac{\theta}{l(t)}\right) \tag{60}$$

$$H = \frac{1}{2}\rho v\left[\dot{e}_1(t) + \frac{v(t)}{l(t)}\hat{h}_\xi(0,t)\right]^2 + \frac{1}{l(t)}\hat{T}(1,t)\hat{h}_\xi(1,t)\dot{e}_2(t) - \frac{v(t)}{2l^2(t)}\hat{T}(0,t)\hat{h}_\xi^2(0,t) - \frac{1}{l(t)}\hat{T}(0,t)\hat{h}_\xi(0,t)\dot{e}_1(t) - \frac{1}{2}\dot{v}(t)\int_0^1 \left[\frac{m_e}{l(t)}\rho(1-\xi)\right]\hat{h}_\xi^2\,d\xi - \frac{EI}{l^3(t)}\hat{h}_{\xi\xi\xi}(1,t)\dot{e}_2(t) + \frac{EI}{l^3}\hat{h}_{\xi\xi\xi}(0,t)\left[\dot{e}_1(t) + \frac{v(t)}{l(t)}\hat{h}_\xi(0,t)\right] + v(t)\int_0^1 Q(\xi,t)\left[\hat{h}_t + \frac{v(t)}{l(t)}(1-\xi)\hat{h}_\xi\right]d\xi, - K_c\left[\hat{h}_t\left(\frac{\theta}{l(t)},t\right) + \frac{v(t)[l(t)-\theta]}{l^2(t)}\hat{h}_\xi\left(\frac{\theta}{l(t)},t\right)\right]^2 \tag{61}$$

$$N_i = l(t)\int_0^1 Q(\xi,t)\psi_i(\xi)\,d\xi - K_c\left[\hat{h}_t\left(\frac{\theta}{l(t)},t\right) + \frac{v(t)[l(t)-\theta]}{l^2(t)}\hat{h}_\xi\left(\frac{\theta}{l(t)},t\right)\right]\psi_i\left(\frac{\theta}{l(t)}\right). \tag{62}$$

The discretized expression of $$\left(\frac{dE_{vs}}{dt}\right)_{cv}$$

for the model in FIG. 1(*a*) is given by (56)-(62) with EI=0 in (57)-(62). Similarly, the discretized expression of $$\left(\frac{dE_{vf}}{dt}\right)_{cv}$$

for the model in FIG. 1(*c*) is given by (56), where $$B_{ij} = -\frac{1}{2}\ddot{v}(t)\int_0^1\left[\frac{m_e}{l(t)} + \rho(1-\xi)\right]\psi_i'(\xi)\psi_j'\,d\xi - \frac{1}{2}EI\frac{v(t)}{l^4(t)}\psi_i''(0)\psi_j''(0) - K_c\frac{v^2[l(t)-\theta]^2}{l^4(t)}\psi_i'\left(\frac{\theta}{l(t)}\right)\psi_j'\left(\frac{\theta}{l(t)}\right), \tag{63}$$

$$D_i = -\ddot{v}(t)\int_0^1\left[\frac{m_e}{l(t)} + \rho(1-\xi)\right]\hat{h}_\xi\psi_i'(\xi)\,d\xi - EI\frac{v(t)}{l^3(t)}\psi_i'''(1)\dot{e}_2(t) + \frac{EI}{l^3(t)}\psi_i'''(1)\dot{e}_1(t) - EI\frac{v(t)}{l^4(t)}\psi_i''(0)\hat{h}_{\xi\xi}(0,t) + v(t)\int_0^1 Q(\xi,t)(1-\xi)\psi_i'(\xi)\,d\xi - 2K_c\frac{v(t)[l(t)-\theta]}{l^2(t)}\hat{h}_t\left(\frac{\theta}{l(t)},t\right)\psi_i'\left(\frac{\theta}{l(t)}\right) - 2K_c\frac{v^2(t)[l(t)-\theta]^2}{l^4(t)}\hat{h}_\xi\left(\frac{\theta}{l(t)},t\right)\psi_i'\left(\frac{\theta}{l(t)}\right), \tag{64}$$

$$H = \frac{1}{2}\rho v\dot{e}_1^2(t) - \frac{1}{2}\ddot{v}(t)\int_0^1\left[\frac{m_e}{l(t)} + \rho(1-\xi)\right]\hat{h}_\xi^2\,d\xi - \frac{EI}{l^3(t)}\hat{h}_{\xi\xi\xi}(1,t)\dot{e}_2(t) - \frac{EIv(t)}{2l^4(t)}\hat{h}_{\xi\xi}^2(0,t) + \frac{EI}{l^3(t)}\hat{h}_{\xi\xi\xi}(0,t)\dot{e}_1(t) + v(t)\int_0^1 Q(\xi,t)\left[\hat{h}_t + \frac{v(t)}{l(t)}(1-\xi)\hat{h}_\xi\right]d\xi - K_c\left[\hat{h}_t\left(\frac{\theta}{l(t)},t\right) + \frac{v(t)[l(t)-\theta]}{l^2(t)}\hat{h}_\xi\left(\frac{\theta}{l(t)},t\right)\right]^2, \tag{65}$$

and entries of U, V and N are given by (57), (58) and (62).

Direct spatial discretization of (9) and (10) is adopted in the second and third schemes. The solution of (9) and (10) is assumed in the form $$u(x,t) = \sum_{j=1}^{n}\phi_j(x,t)\tilde{q}_j(t), \tag{66}$$

where $\tilde{q}_j(t)$ are the generalized coordinates and $\phi_j(x,t)$ are the time-dependent trial functions. The instantaneous eigenfunctions of a stationary string with variable length l(t) and fixed boundaries are used as the trial functions for the model in FIG. 1(*a*). The instantaneous eigenfunctions of a stationary beam with variable length l(t) and pinned boundaries are used as the trial functions for the model in FIG. 1(*b*), and those of a stationary beam with variable length l(t) and fixed boundaries are used as the trial functions for the model in FIG. 1(*c*). Note that the instantaneous eigenfunctions of a stationary string and beam with variable length l(t) can be obtained from the eigenfunctions of the corresponding string and beam with constant length l and the same boundaries by replacing l with l(t).

In the second scheme the trial functions used are normalized so that $$\int_0^{l(t)}\phi_j^2(x,t)\,dx = 1,$$

and they satisfy the orthonormality relation, $$\int_0^{l(t)}\phi_i(x,t)\phi_j(x,t)\,dx = \delta_{ij}.$$

It is noted that the normalized eigenfunctions of the string and beam with variable length l(t) can be expressed as $$\phi_j(x,t) = \frac{1}{\sqrt{l(t)}}\psi_j\left(\frac{x}{l(t)}\right) = \frac{1}{\sqrt{l(t)}}\psi_j(\xi), \tag{67}$$

where $\psi_j(\xi)$ are the normalized eigenfunctions of the corresponding string and beam with unit length, as used in the first scheme. Substituting (66) and (67) into (9), multiplying the equation by $$\frac{1}{\sqrt{l(t)}}\psi_i(\xi),$$

integrating it from x=0 to l(t), and using the boundary conditions and the orthonormality relation for $\psi_j(\xi)$ yields the discretized equations for the models in FIGS. 1(*b*) and 1(*c*):

$$\tilde{M}\ddot{\tilde{q}}(t)+\tilde{C}(t)\dot{\tilde{q}}(t)+\tilde{K}(t)\tilde{q}(t)=\tilde{F}(t), \tag{68}$$

where entries of the system matrices and the force vector are $$\tilde{M}_{ij} = \rho\delta_{ij}, \tag{69}$$

$$\tilde{C}_{ij} = \rho\frac{v(t)}{l(t)}\left[2\int_0^1(1-\xi)\psi_i(\xi)\psi_j'(\xi)\,d\xi - \delta_{ij}\right] + \frac{K_c}{l(t)}\psi_i\left(\frac{\theta}{l(t)}\right)\psi_j\left(\frac{\theta}{l(t)}\right) \tag{70}$$

$$\tilde{K}_{ij} = \rho\frac{v^2(t)}{l^2(t)}\left[\frac{1}{4}\delta_{ij} - \int_0^1(1-\xi)^2\psi_i'(\xi)\psi_j'(\xi)\,d\xi\right] + \frac{EI}{l^4(t)}\int_0^1\psi_i''(\xi)\psi_j''(\xi)\,d\xi + \frac{m_e[g-\dot{v}(t)]}{l^2(t)}\int_0^1\psi_i'(\xi)\psi_j'(\xi)\,d\xi + \rho\frac{g-\dot{v}(t)}{l(t)}\int_0^1(1-\xi)\psi_i'(\xi)\psi_j'(\xi)\,d\xi + \rho\left[\frac{v^2(t)}{l^2(t)} - \frac{\dot{v}(t)}{l(t)}\right]\left[\frac{1}{2}\delta_{ij} - \int_0^1(1-\xi)\psi_i(\xi)\psi_j(\xi)\,d\xi\right] + K_c\frac{v(t)}{l^2(t)}\left[\frac{1}{2}\psi_i\left(\frac{\theta}{l(t)}\right)\psi_j\left(\frac{\theta}{l(t)}\right) - \frac{l(t)-\theta}{l(t)}\psi_i\left(\frac{\theta}{l(t)}\right)\psi_j'\left(\frac{\theta}{l(t)}\right)\right], \tag{71}$$

$$\tilde{F}_i = \sqrt{l(t)}\int_0^1\left[\hat{f}(\xi,t) + Q(\xi l(t),t)\right]\psi_i(\xi)\,d\xi. \tag{72}$$

Substituting (66) and (67) into the first equation in (11), multiplying the equation by $\psi_i(\xi)$, and using the orthonormality relation for $\psi_j(\xi)$ yields $$\tilde{q}_i(0)=\sqrt{l(0)}\int_0^1[v(\xi l(0),0)-h(\xi l(0),0)]\psi_i(\xi)\,d\xi. \tag{73}$$

Differentiating (66) with respect to t using (67), substituting the expression into the second equation in (11), multiplying the equation by $\psi_i(\xi)$, and using the orthonormality relation for $\psi_j(\xi)$ yields $$\dot{\tilde{q}}_i(0) = \frac{v(0)}{l(0)}\sum_{j=1}^{n}\tilde{q}_j(0)\int_0^1 \xi\psi_i(\xi)\psi_j'(\xi)d\xi + \frac{v(0)}{2l(0)}\tilde{q}_i(0) + \sqrt{l(0)}\int_0^1 [y_t(\xi l(0), 0) - h_t(\xi l(0), 0)]\psi_i(\xi)d\xi. \tag{74}$$

Using (8), (66), and (67) in (20) and (21) yields the discretized expression of the vibratory energy for the models in FIGS. 1(*b*) and 1(*c*):

$$E_v(t) = \frac{1}{2}\left[\dot{\tilde{q}}^T(t)\tilde{M}(t)\dot{\tilde{q}}(t) + \dot{\tilde{q}}^T(t)\tilde{C}(t)\tilde{q}(t) + \tilde{q}^T(t)\tilde{S}(t)\tilde{q}(t)\right] + \tilde{P}^T(t)\dot{\tilde{q}}(t) + \tilde{R}^T(t)\tilde{q}(t) + \tilde{W}(t), \tag{75}$$

where $$\tilde{S}_{ij} = \rho\left[-\frac{1}{4}\frac{v^2(t)}{l^2(t)}\delta_{ij} + \frac{v^2(t)}{l^2(t)}\int_0^1 (1-\xi)^2\psi_i'(\xi)\psi_j'(\xi)d\xi + \frac{g-\dot{v}(t)}{l(t)}\int_0^1 (1-\xi)\psi_i'(\xi)\psi_j'(\xi)d\xi\right] + \frac{EI}{l^4(t)}\int_0^1 \psi_i''(\xi)\psi_j''(\xi)d\xi + m_e\frac{g-\dot{v}(t)}{l^2(t)}\int_0^1 \psi_i'(\xi)\psi_j'(\xi)d\xi, \tag{76}$$

$$\tilde{P}_i = \rho\sqrt{l(t)}\int_0^1\left[\hat{h}_t + \frac{v(t)}{l(t)}(1-\xi)\hat{h}_\xi\right]\psi_i(\xi)d\xi, \tag{77}$$

$$\tilde{R}_i = \rho\frac{v(t)}{\sqrt{l(t)}}\left\{\int_0^1\left[\hat{h}_t + \frac{v(t)}{l(t)}(l-\xi)\hat{h}_\xi\right](1-\xi)\psi_i'(\xi)d\xi - \frac{1}{2}\int_0^1\left[\hat{h}_t + \frac{v(t)}{l(t)}(1-\xi)\hat{h}_\xi\right]\psi_i(\xi)d\xi\right\} + \frac{EI}{l^{7/2}(t)}\int_0^1 \psi_i''(\xi)\hat{h}_{\xi\xi}d\xi + \frac{1}{\sqrt{l(t)}}\int_0^1\left[\frac{m_e}{l(t)} + \rho(1-\xi)\right][g-\dot{v}(t)]\hat{h}_\xi\psi_i'(\xi)d\xi, \tag{78}$$

$$\tilde{W} = \frac{1}{2}\left\{\rho l(t)\int_0^1\left[\hat{h}_t + \frac{v(t)}{l(t)}(1-\xi)\hat{h}_\xi\right]^2 d\xi + \int_0^1\left[\frac{m_e}{l(t)} + \rho(1-\xi)\right][g-\dot{v}(t)]\hat{h}_\xi^2 d\xi + \frac{EI}{l^3(t)}\int_0^1 \hat{h}_{\xi\xi}^2 d\xi\right\}. \tag{79}$$

The discretized expression of the vibratory energy for the model in FIG. 1(*a*) is given by (75)-(79) with EI=0 in (76), (78), and (79). Using (8), (66), and (67) in (25) and (26) yields, for each model in FIG. 1, the discretized expression of the rate of change of the vibratory energy from the control volume viewpoint:

$$\left(\frac{dE_v}{dt}\right)_{cv} = \dot{\tilde{q}}^T(t)\tilde{U}(t)\dot{\tilde{q}}(t) + \dot{\tilde{q}}^T(t)\tilde{V}(t)\tilde{q}(t) + \tilde{q}^T(t)\tilde{B}(t)\tilde{q}(t) + \tilde{D}^T(t)\tilde{q}(t) + \tilde{H}(t) + \tilde{N}^T(t)\dot{\tilde{q}}(t) \tag{80}$$

where entries of the matrices and the vector and $\tilde{H}(t)$ are related to those from the first scheme in (57)-(62) for each model in FIG. 1:

$$\tilde{U}_{ij} = \frac{1}{l(t)}U_{ij},$$

$$\tilde{V}_{ij} = \frac{1}{l(t)}V_{ij} - \frac{v(t)}{l^2(t)}U_{ij}, \tag{81}$$

-continued $$\tilde{B}_{ij} = \frac{1}{l(t)}B_{ij} + \frac{v^2(t)}{4l^3(t)}U_{ij} - \frac{v(t)}{2l^2(t)}V_{ij},$$

$$\tilde{D}_i = \frac{D_i}{\sqrt{l(t)}} - \frac{v(t)}{2}l^{-\frac{3}{2}}(t)N_i,$$

$$\tilde{N}_i = \frac{1}{\sqrt{l(t)}}N_i,$$

$$\tilde{H} = H.$$

Introducing the new generalized coordinates, $$\hat{q}_j(t) = \frac{\tilde{q}_j(t)}{\sqrt{l(t)}}, \tag{82}$$

in the third scheme, (66) and (67) become $$u(x, t) = \sum_{j=1}^{n}\psi_j\left(\frac{x}{l(t)}\right)\tilde{q}_j(t) = \sum_{j=1}^{n}\psi_j(\xi)\tilde{q}_j(t). \tag{83}$$

Note that a similar form to that in (83) can be obtained when one uses unnormalized, instantaneous eigenfunctions of a stationary string and beam with variable length l(t) as the trial functions in (66). This provides the physical explanation for the expansion in (83). Substituting (82) into (9), multiplying the equation by $\psi_i(\xi)$, integrating it from x=0 to l(t), and using the boundary conditions and the orthonormality relation for $\psi_j(\xi)$ yields the discretized equations for the models in FIGS. 1(*b*) and 1(*c*):

$$\hat{M}(t)\ddot{\hat{q}}(t) + \hat{C}(t)\dot{\hat{q}}(t) + \hat{K}(t)\hat{q}(t) = \hat{F}(t), \tag{84}$$

where entries of the system matrices and the force vector are related to those from the first scheme in (44)-(48):

$$\hat{M}_{ij} = l(t)M_{ij},\ \hat{C}_{ij} = l(t)C_{ij},\ \hat{K}_{ij} = l(t)K_{ij},\ \hat{F}_i = l(t)F_i. \tag{85}$$

The discretized equations for the model in FIG. 1(*a*) are given by those for the model in FIG. 1(*b*) with EI=0; entries of the system matrices and the force vector from the third scheme are also related to those from the first scheme through (85) for the model in FIG. 1(*a*). Using an approach similar to that in the second scheme, we obtain the initial conditions for the new generalized coordinates, given by (49) and (50) with $q_i(0)$ and $\dot{q}_i(0)$ replaced with $\hat{q}_i(0)$ and $\dot{\hat{q}}_i(0)$, respectively. Similarly, the discretized expressions of the vibratory energy and the rate of change of the vibratory energy from the control volume viewpoint are $$E_v(t) = \frac{1}{2}\left[\dot{\hat{q}}^T(t)\hat{M}\dot{\hat{q}}(t) + \dot{\hat{q}}^T(t)\hat{C}(t)\hat{q}(t) + \hat{q}^T(t)\hat{S}(t)\hat{q}(t)\right] + \hat{P}^T(t)\dot{\hat{q}}(t) + \hat{R}^T(t)\hat{q}(t) + \hat{W}(t), \tag{86}$$

$$\left(\frac{dE_v}{dt}\right)_{cv} = \dot{\hat{q}}^T(t)\hat{U}(t)\dot{\hat{q}}(t) + \dot{\hat{q}}^T(t)\hat{V}(t)\hat{q}(t) + \hat{q}^T(t)\hat{B}(t)\hat{q}(t) + \hat{D}^T(t)\hat{q}(t) + \hat{H}(t) + \hat{N}^T(t)\dot{\hat{q}}(t) \tag{87}$$

where $\hat{S}(t)$, $\hat{P}(t)$, $\hat{R}(t)$, $\hat{W}(t)$, $\hat{U}(t)$, $\hat{V}(t)$, $\hat{B}(t)$, $\hat{D}(t)$, $\hat{H}(t)$, and $\hat{N}(t)$ equal S(t), P(t), R(t), W(t), U(t), V(t), B(t), D(t), H(t), and N(t) in (51) and (56), respectively, for each model in FIG. 1.

Dividing (84) by l(t) and noting (85), we find that (84) is equivalent to (44). Since the initial conditions for $\hat{q}_i$ are the same as those for $q_i$, $\hat{q}_i(t)=q_i(t)$ for all t. In addition, the vibratory energy and the rate of change of the vibratory energy in (86) and (87) are the same as those in (51) and (56), respectively. Hence the first and third schemes yield the same results. While the second and third schemes are equivalent as (83) is related to (66) and (67) through (82), the discretized equations from the two schemes have different forms, and so do the initial conditions, the vibratory energy, and the rate of change of the vibratory energy. The numerical results confirm that the two schemes yield the same results. Note that the discretized equations in (44) to (48) can be obtained from those in (84) and (85) by using (82), and so do the initial conditions, the vibratory energy, and the rate of change of the vibratory energy. The second scheme is used in references 1 through 5.

While the first scheme yields the same discretized equations as the third scheme, it is a less physical approach. Some physical explanation associated with the discretized equations from the third scheme is provided here. Since a translating medium gains mass when l(t) increases, the nonzero diagonal elements in the mass matrix M in (84) increase during extension. Similarly, the diagonal elements in M decrease during retraction when l(t) decreases, because the translating medium loses mass. Entries of the matrix C in (85) can be written as $$C_{ij} = 2\rho v(t)\int_0^1 (1-\xi)\psi_i(\xi)\psi_j'(\xi)d\xi = G_{ij} + A_{ij}, \tag{88}$$

where $$G_{ij} = 2\rho v(t)\int_0^1 \psi_i(\xi)\psi_j'(\xi)d\xi - \rho v(t)\left[2\int_0^1 \xi\psi_i(\xi)\psi_j'(\xi)d\xi + \delta_{ij}\right],\ A_{ij} = \rho v(t)\delta_{ij} \tag{89}$$

are entries of the skew-symmetric gyroscopic matrix and the symmetric damping matrix induced by mass variation, respectively. Note that entries of the gyroscopic matrix associated with a translating medium with constant length are given by the first term in the first equation in (89). Gaining mass during extension (i.e., v(t)>0) introduces a negative thrust, which tends to slow down the lateral motion, and hence a positive damping effect, as shown by the second equation in (89). Similarly, losing mass during retraction (i.e., v(t)<0) introduces a negative damping effect. The normalization procedure in the second scheme, however, renders the mass matrix $\tilde{M}$ in (68) a constant matrix. Consequently, the damping effect due to mass variation does not exist and the resulting matrix C in (68) is the skew-symmetric gyroscopic matrix.

Calculated Forced Responses

Figures 3A, 3B, 3C, 3D:
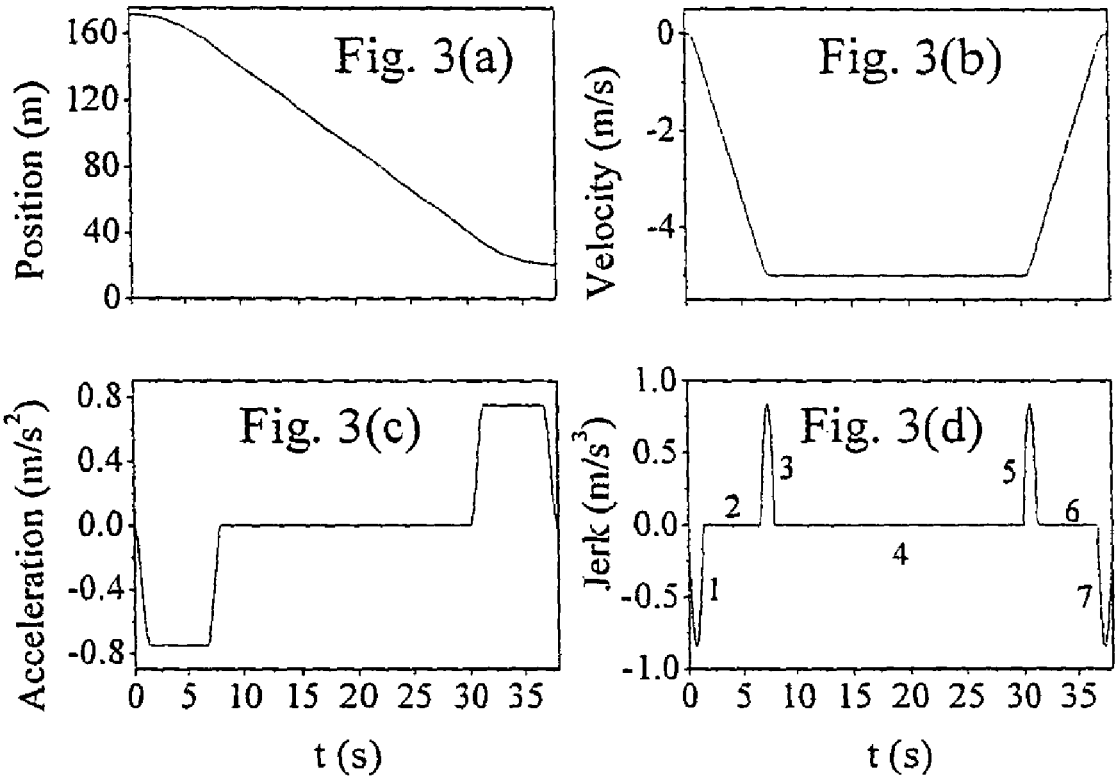
FIGS. 3(*a*)-3(*d*) are plots of the upward movement profile of the elevator for l(t), v(t), $\dot{v}(t)$, and $\ddot{v}(t)$, respectively, with the seven regions marked in FIG. 3(*d*)

Forced responses are calculated for a hoist cable 110 in a high-speed elevator. The parameters used are ρ=1.005 kg/m, $m_e$=756 kg, EI=1.39 $Nm^2$ for the models in FIGS. 1(*b*) and 1(*c*), and EI=0 for the model in FIG. 1(*a*). The cable 110 is assumed to be at rest initially, hence y(x,0)=0 and $y_t(x,0)=0$. The upward movement profile, as shown in FIG. 3, is divided into seven regions. In the region k (k=1, 2, . . . , 7) the function l(t) is given by a polynomial, $$l(t)=L_0^{(k)}+L_1^{(k)}(t-t_{i-1})+L_2^{(k)}(t-t_{i-1})^2+L_3^{(k)}(t-t_{i-1})^3+L_4^{(k)}(t-t_{i-1})^4+L_5^{(k)}(t-t_{i-1})^5, \tag{90}$$

where $t_{k-1} \leqq t \leqq t_k$ and $L_m^{(k)}$ (m=0, 1, . . . , 5) are given in Table 4 below:

TABLE 4

Upward movement profile regions and polynomial coefficients

| Region k | $t_k$ (s) | $L_0^{(k)}$ (m) | $L_1^{(k)}$ (m/s) | $L_2^{(k)}$ ($m/s^2$) | $L_3^{(k)}$ ($m/s^3$) | $L_4^{(k)}$ ($m/s^4$) | $L_5^{(k)}$ ($m/s^5$) |
|---|---|---|---|---|---|---|---|
| 1 | 1.33 | 171.0 | 0 | 0 | 0 | −0.106 | 0.0316 |
| 2 | 6.67 | 170.8 | −0.5 | −0.375 | 0 | 0 | 0 |
| 3 | 8 | 157.5 | −4.5 | −0.375 | 0 | 0.106 | −0.0316 |
| 4 | 30 | 151.0 | −5 | 0 | 0 | 0 | 0 |
| 5 | 31.33 | 41.0 | −5 | 0 | 0 | 0.106 | −0.0316 |
| 6 | 36.67 | 34.5 | −4.5 | 0.375 | 0 | 0 | 0 |
| 7 | 38 | 21.2 | −0.5 | 0.375 | 0 | −0.106 | 0.0316 |

The initial and final lengths of the cable 110 are 171 m and 21 m, respectively. The maximum velocity, acceleration, and jerk are 5 m/s, 0.75 $m/s^2$, and 0.845 $m/s^3$, respectively, and the total travel time is 38 s. The fundamental frequencies of the cable 110 with the initial and final lengths are around 0.25 Hz and 2.05 Hz, respectively. The boundary excitation is given by $e_1(t)=Z_1 \sin(\omega_1 t)$ and $e_2(t)=Z_2 \sin(\omega_2 t+\pi)$, respectively, where $Z_1$=0.1 m and $Z_2$=0.05 m.

Different excitation frequencies are used: $\omega_1$=3.14 rad/s (0.5 Hz) and $\omega_2$=6.28 rad/s (1 Hz) are referred to as the mid frequencies, $\omega_1$=1.884 rad/s (0.3 Hz) and $\omega_2$=3.768 rad/s (0.6 Hz) the low frequencies, and $\omega_1$=6.28 rad/s (1 Hz) and $\omega_2$=12.56 rad/s (2 Hz) the high frequencies. In all the examples the displacement and velocity of the cable 110 at x=12 m are calculated.

To improve the accuracy of the solution all the integrals in the discretized equations are evaluated analytically and the expressions for the models in FIGS. 1(*a*) and 1(*b*) are as follows:

$$\int_0^1 (1-\xi)\psi_i(\xi)\psi_j'(\xi)d\xi = \begin{cases} \frac{1}{2} & i=j \\ \frac{2ij}{i^2-j^2} & i\neq j \end{cases}, \tag{91}$$

$$\int_0^1 \psi_i'(\xi)\psi_j'(\xi)d\xi = \begin{cases} i^2\pi^2, & i=j \\ 0, & i\neq j \end{cases},$$

$$\int_0^1 (1-\xi)^2\psi_i'(\xi)\psi_j'(\xi)d\xi = \begin{cases} \frac{1}{2}+\frac{i^2\pi^2}{3}, & i=j \\ \frac{2ij}{(i-j)^2}+\frac{2ij}{(i+j)^2}, & i\neq j \end{cases},$$

$$\int_0^1 (1-\xi)\psi_i'(\xi)\psi_j'(\xi)d\xi = \begin{cases} \frac{i^2\pi^2}{2}, & i=j \\ \frac{2ij}{(i-j)^2}+\frac{2ij}{(i+j)^2}, & i\neq j \text{ and } i+j=\text{enen} \\ 0, & i\neq j \text{ and } i+j=\text{odd} \end{cases},$$

-continued $$\int_0^1 \xi\psi_i(\xi)\psi_j'(\xi)d\xi = \begin{cases} -\frac{1}{2}, & i = j \\ (-1)^{i+j+1}\frac{2ij}{i^2 - j^2}, & i \neq j \end{cases},$$

$$\int_0^1 \psi_i''(\xi)\psi_j''(\xi)d\xi = \begin{cases} (i\pi)^4, & i = j \\ 0, & i \neq j \end{cases}.$$

Due to the complexity of the expressions for the model in FIG. 1(*c*), they are not given here. Unless stated otherwise, n=20.

Figures 4A, 4B, 4C, 4D:
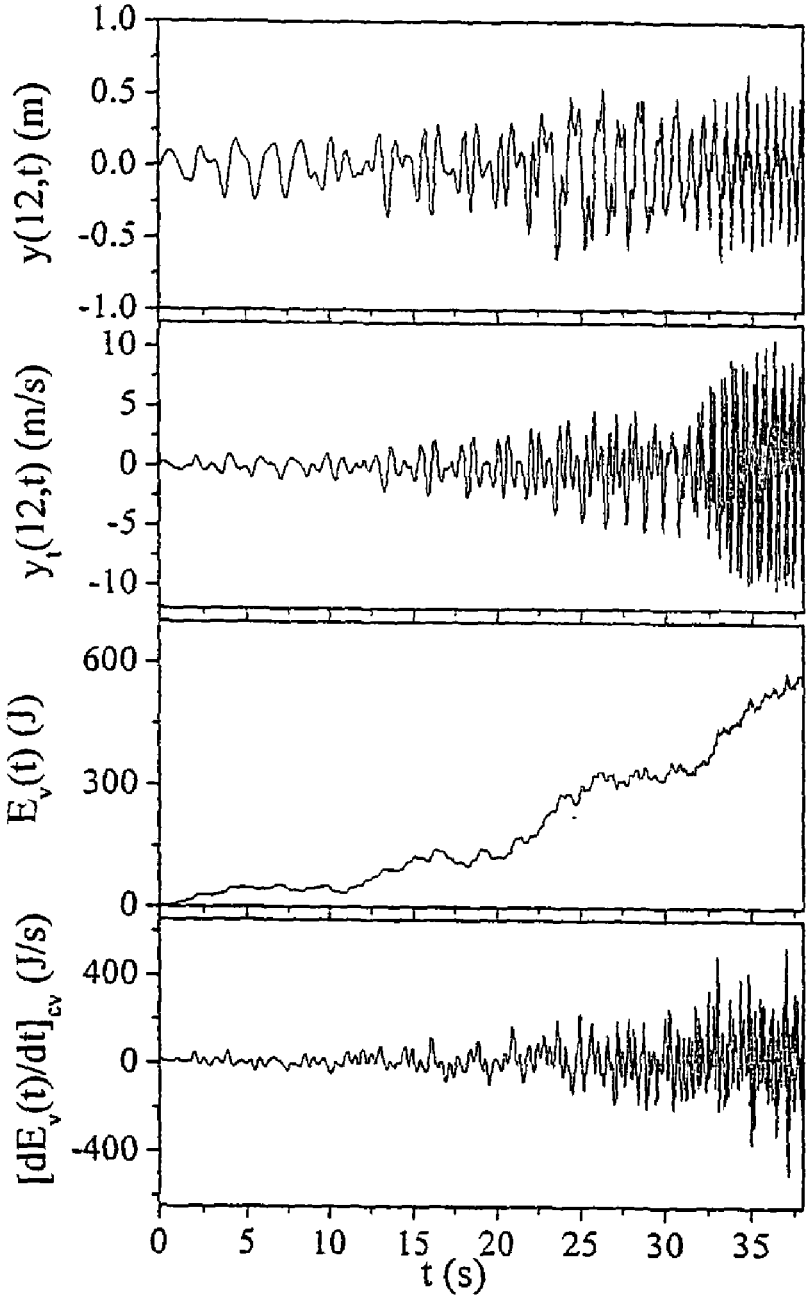
FIGS. 4(*a*)-4(*d*) are plots of the forced responses of the model in FIG. 1(*a*) using the second (dashed line) and third (solid line) spatial discretization schemes with n=20 for y(12, t), $y_t(12,t)$, $E_v(t)$; and $$\left[\frac{dE_v(t)}{dt}\right]_{cv},$$

Consider first the mid excitation frequencies. Responses from the second and third schemes for the model in FIG. 1(*a*), shown in dashed and solid lines in FIG. 4, respectively, coincide, as expected. The rates of change of the vibratory energies are calculated using the discretized expressions in (80) and (87), respectively, in the second and third schemes. They can also be calculated from the vibratory energies in FIG. 5(*c*) by using the finite difference method.

Similarly, the two schemes yield the same results for the models in FIGS. 1(*b*) and 1(*c*) (not shown). While the trial functions used for the model in FIG. 1(*b*) are the eigenfunctions of both the untensioned and tensioned beams with pinned boundaries, those for the beam model in FIG. 1(*c*) are the eigenfunctions of the untensioned beam with fixed boundaries and hence cannot be used to determine the high-order derivative terms, $y_{xx}$ and $y_{xxx}$ at x=0 and x=l(t), in (25).

The rate of change of the vibratory energy for the model in FIG. 1(*c*) cannot be calculated from (76) because $y_{xx}(0,t)$ in (26) cannot be determined, but can be calculated from the vibratory energy by using the finite difference method. While the terms involving $EIy_{xxx}(0,t)$ and $EIy_{xxx}(l(t),t)$ in (26) have negligible contributions, those in (26) can have significant contributions as the transverse force at the fixed ends of the beam model in FIG. 1(*c*) equals the shear force. In what follows the third scheme is used.

The convergence of the solution for each model in FIG. 1 is examined by varying the number of included modes. Since the convergence of the model in FIG. 1(*b*) is similar to that of the model in FIG. 1(*a*), only the results for the models in FIGS. 1(*a*) and 1(*c*) are presented, as shown in FIGS. 5 and 6, respectively. The model in FIG. 1(*a*) converges much faster than the model in FIG. 1(*c*); convergence is basically achieved with n=5 for the model in FIG. 1(*a*) and n=40 for the model in FIG. 1(*c*). As seen from FIGS. 4(*c*) and 5(*c*), the convergence is generally reached from below for the model in FIG. 1(*a*) and from above for the model in FIG. 1(*c*).

The slower convergence of the model in FIG. 1(*c*) is due to the small bending stiffness of the cable 110 relative to the tension, which leads to the boundary layers at the fixed ends. While the use of the eigenfunctions of the untensioned beam as the trial functions for the model in FIG. 1(*c*) does not introduce much problem in calculating the natural frequencies and the free response, it causes some convergence difficulty for the forced response.

To examine the effects of the trial functions on convergence, we consider a stationary cable 10 of length l=171 m, with uniform tension $T=m_e g$ and fixed boundaries; the weight of the cable 110 is neglected so that the exact eigenfunctions of the beam model can be obtained analytically and used as the trial functions for comparison purposes. Since the mid excitation frequencies are close to the second and fourth natural frequencies of the stationary cable 110, we consider the excitation frequencies, $\omega_1$=1.884 rad/s (0.3 Hz) and $\omega_2$=3.768 rad/s (0.6 Hz), and the other parameters remain unchanged.

The solution is expressed in (66) with $\phi_j(x,t)$ replaced with the time-independent trial functions $\phi_j(x)$. The results using the untensioned and tensioned beam eigenfunctions as the trial functions for the beam model are compared. Since the bending stiffness of the cable 110 is very small relative to the tension, the string model yields essentially the same response in FIG. 7 as the beam model using the tensioned beam eigenfunctions: the response from the beam model using the untensioned beam eigenfunctions and n=100 has not fully converged (FIG. 7(*c*)). The mass matrices that result from the two different types of the trial functions for the beam model are the same, and the differences between the diagonal entries of the stiffness matrices decrease with n, and are less than 2% when n>18 and less than 1% when n>36.

The differences between the values of the integrals in the entries of the forcing vector, such as $\int_0^1\phi_i(x)dx$, $\int_0^1 x\phi_i(x)dx$, $\int_0^1 x^2\phi_i(x)dx$, and $\int_0^1 x^3\phi_i(x)dx$, reach 30-40% however, when n>7. This explains the slower convergence of the forced response of the beam model when the untensioned beam eigenfunctions are used as the trial functions. Note that the forced response of the moving cable 110 converges faster than that of the stationary cable 110, because the energy increase due to the shortening cable 110 behavior dominates the energy variation due to the forcing terms for the moving cable 110 and the relative bending stiffness of the cable 110 to the tension increases as the length of the cable 110 shortens during upward movement.

The responses from the three models in FIG. 1 are compared, as shown in FIG. 8, where n=60 for the model in FIG. 1(*c*). Due to the small bending stiffness of the cable 110 the results from the three models are essentially the same. Some different behavior can occur at the boundaries between the models in FIGS. 1(*a*) and 1(*b*) and that in FIG. 1(*c*).

Similarly, for the low and high excitation frequencies, the responses from the two models in FIGS. 1(*a*) and 1(*c*), as shown in FIGS. 9 and 10, respectively, are essentially the same. Note that the finite difference method is used to calculate the rate of change of the vibratory energy in FIGS. 8(*d*), 9(*d*), and 10(*d*), for the model in FIG. 1(*c*), because $y_{xx}(0,t)$ in (26) cannot be determined by using the untensioned beam eigenfunctions as the trial functions.

For the model in FIG. 1(*c*), while convergence is reached when n=30 for the low excitation frequencies, it is not fully reached when n=60 for the high excitation frequencies as more modes need to be included to account for the high frequency response. Under the low excitation frequencies the vibratory energy has an oscillatory behavior during the initial and middle stages of upward movement because the energy variation is dominated by the forcing terms in (24) and (26), which are sign-indefinite, and it increases at the final stage of movement. Under the high excitation frequencies the vibratory energy increases in general during upward movement because the energy variation is dominated by the terms that result in the shortening cable 110 behavior.

For the model in FIG. 1(*a*) with constant tension $T=m_e g$, the exact solution can be obtained using the wave method. With the other parameters remaining unchanged, the displacement of the cable 110 from the modal approach, under the excitation $e_1(t)=0.1\sin(3.14t)$ and $e_2(t)=0$, is in good agreement with that from the wave method, as shown in FIG. 11, thus validating the modal approach.

Thus, the three models in FIG. 1 yield essentially the same results for the forced response of the elevator cable 110 due to its small bending stiffness. The model in FIG. 1(*c*), using the untensioned beam eigenfunctions as the trial functions, converges more slowly for the forced response than for the free response. The rate of change of the vibratory energy from the control volume viewpoint can characterize the dynamic stability of the cable 110, and that of the total mechanical energy from the system viewpoint establish an instantaneous work and energy relation.

The three spatial discretization schemes yield the same results and the third scheme is the most physical approach. While the vibratory energy of the cable 110 can have an oscillatory behavior with the low excitation frequencies, it increases in general with the higher excitation frequencies during upward movement of the elevator.

Effects of Damping

There are three excitation sources: (1) building sway; (2) pulley eccentricity; and (3) guide-rail irregularity. Excitation can also arise from concentrated and/or distributed external forces that can result from aerodynamic or wind excitation. Theses are included in the formulation, but not considered in the examples. The displacement of the upper end of the cable represents external excitation that can arise from building sway and/or pulley eccentricity. The displacement of the lower end of the cable represents external excitation due to guide-rail irregularity and/or building sway. Based on this geometric viewpoint, the excitations considered in the examples can be simplified into two sources: the excitation from the upper end and the excitation from the lower end.

A damper can be mounted either on the passenger car, on the wall or other rigid supporting structure, or on a small car moving along the guide rail with the cable or relative to the cable, as will be described in more detail below. The cases with the damper attached to the passenger car and to the wall are investigated in what follows. When mounted on the wall, the damper is preferably installed close to the top of the hoist way, so that the passenger car will not collide with it.

A damper can be mounted either on the passenger car, on the wall or other rigid supporting structure, or on a small car moving along the guide rail with the cable or relative to the cable, as will be described in more detail below. The cases with the damper attached to the passenger car and to the wall are investigated in what follows. When mounted on the wall, the damper is installed close to the top of the hoist way, otherwise the passenger car may collide with it.

The contour plot of the damping effect for each of the above four cases is obtained by varying the excitation frequency and damping coefficient, where the damping effect is defined as the percentage ratio of the damped average vibratory energy during upward movement of the elevator to the undamped average vibratory energy. The average energy is defined as $$E_{average} = \frac{\int_0^{t_{total}} E_v dt}{t_{total}}.$$

Upper Boundary Excitation with the Damper Fixed to the Wall

FIG. 12(*a*) is a contour plot of the damping effect for the upper boundary excitation with the damper fixed to the wall. When the boundary excitation comes from the upper end and the damper is fixed to the wall, the damper can effectively reduce the vibratory energy. A damper with a larger damping coefficient can reduce more vibratory energy.

This result can be explained as follows. An incident wave generated by the upper boundary propagates to the damper and generates a transmitted wave and a reflected wave. The damper also dissipates some energy of the incident wave. When the damping coefficient is large, while the damper does not dissipate much energy, the reflected wave has much more energy than the transmitted wave. The reflected wave reflects from the upper boundary and can generate another pair of transmitted and reflected waves when it gets to the damper. Similarly, the transmitted wave reflects from the lower boundary and can generate another pair of transmitted and reflected waves when it gets to the damper.

Much of the energy in the system is concentrated in the main reflected wave component that propagates back and forth between the upper boundary and the damper. This part of the string has constant length and the energy will not grow. The lower part of the string between the damper and the lower boundary has variable length and the energy can increase dramatically during upward movement of the elevator due to the unstable shortening cable behavior. When the damping coefficient is increased, the energy is distributed mostly in the upper part of the string, and little energy exists in the lower part of the string. The damper serves as a vibration isolator in this case.

However, the principle of this type of vibration isolator differs from that of the traditional vibration isolator. Because the energy dissipated at the damper with a large damping coefficient is small, a spring with a large stiffness can also be used in this case in place of the damper. The larger the damping coefficient or the spring stiffness, the less the energy integral during upward movement.

Upper Boundary Excitation with the Damper Fixed to the Passenger Car

FIG. 12(*b*) is a contour plot of the damping effect for the upper boundary excitation with the damper fixed to the passenger car. When the boundary excitation comes from the upper end and the damper is fixed to the elevator car, the optimal damping coefficient decreases from 1000 to 200 Ns/m when the excitation frequency is increased from 0 to 3 Hz.

This result differs from that shown in FIG. 12(*a*). The wave approach can no longer be applied to explain this result. The length of the upper part of the string between the upper boundary and the damper decreases during upward movement of the elevator and is subjected to the shortening cable behavior, where the energy increase occurs at the upper boundary. The energy increase in the shortening cable behavior occurs at the damper in this case. When the damper is designed to allow an incident wave from the upper boundary to easily be transmitted through the damper, the transmitted wave reflects from the lower boundary and can be transmitted back into the upper part of the string again, since the distribution of the energy between the transmitted and reflected waves at the damper when an incident wave travels upwards is similar to that when an incident wave travels downwards.

The modal method is used to explain the result in this case. The vibration of the cable can be decomposed into a series of instantaneous modes. The low frequency excitation from the upper boundary excites more lower modes and the high frequency excitation excites more higher modes. Since the damper is close to the lower boundary, for the lower modes the vibration at the damper's position is relatively small, and a damper with a relatively large damping coefficient will increase the damping force and dissipate more energy.

Since there is no excitation at the lower boundary, the resulting term in the rate of change of vibratory energy from the presence of the damper is always non-positive, which means the damper always dissipates the energy.

Lower Boundary Excitation with the Damper Fixed to the Wall

FIG. 12(*c*) is a contour plot of the damping effect for the lower boundary excitation with the damper fixed to the wall. When the boundary excitation comes from the lower end and the damper is fixed to the wall, the optimal damping coefficient decreases from 1000 to 200 Ns/m with the increase of the excitation frequency.

A similar explanation as that for the result in FIG. 12(*b*) can be applied. The energy increase for the shortening cable behavior at the lower part of the string occurs at the damper. The optimal damping coefficient for a given damper position is obtained by minimizing the energy integral during upward movement.

Lower Boundary Excitation with the Damper Fixed to the Passenger Car

FIG. 12(*d*) is a contour plot of the damping effect for the lower boundary excitation with the damper fixed to the elevator car. When the excitation comes from the lower boundary and the damper is fixed to the elevator car, the optimal damping coefficient decreases from 1000 to 200 Ns/m with the increase of the excitation frequency.

A similar explanation as that for the result in FIG. 12(*b*) can be applied. The energy increase for the shortening cable behavior at the upper part of the string occurs at the upper boundary. The optimal damping coefficient for a given damper position is obtained by minimizing the energy integral during upward movement.

As shown in FIGS. 12(*a*)-12(*d*), a damper can effectively dissipate the vibratory energy, especially for the higher frequency excitation, up to 90%. The damper is more effective for the higher frequency than for the lower frequency. Since the rate of the energy growth is lower for the lower excitation frequency, the shortening cable behavior at the lower frequency excitation is less severe than that for the high frequency excitation. The method of designing the optimal damper for the higher excitation frequency is very attractive.

In the two ways of mounting the damper discussed above, by increasing the distance between the damper and the upper or the lower boundary, the damper will be more effective at the lower frequencies. If the excitation comes from the upper boundary, such as the motor, a damper with a large damping coefficient fixed to the wall could be used as a vibration isolator to isolate the source of vibration.

Elevator Cable Dynamics and Damping with Free Vibration

Theoretical Investigation

Consider the lateral vibration of a hoist cable in an idealized, prototype elevator, shown in FIG. 13, traveling the first 46 stories in a 54-story building. Each story is assumed to be 3 meters, and the longitudinal vibration of the cable is not considered. The key parameters of the prototype elevator are shown in Table 5 below.

TABLE 5

Key prototype parameters

| Parameter | Description | Value |
|---|---|---|
| $l_{0p}$ | Cable length above the elevator car at the start of movement | 162 m |
| $l_{endp}$ | Cable length above the elevator car at the end of movement | 24 m |
| $m_{ep}$ | Mass of the elevator car supported by the cable | 957 kg |
| $T_{0p}$ | Nominal cable tension at the top of the elevator car | 9380 N |
| $\rho_p$ | Mass per unit length of the cable | 1.005 kg/m |
| $v_{maxp}$ | Maximum velocity of the elevator | 5 m/s |
| $a_{maxp}$ | Maximum acceleration of the elevator | 0.66 m/s$^2$ |
| $(EI)_p$ | Bending stiffness of the cable | 1.39 Nm$^2$ |
| $t_{totalp}$ | Total travel time | 42 s |
| $l_{dp}$ | Distance between the damper and the elevator car | 2.5 m |
| $K_{vp}$ | Damping coefficient of the linear viscous damper | 2050 Ns/m |
| $c_p$ | Natural damping coefficient | 0.0375 Ns/m$^2$ |

Note that the last subscript p of any variable denotes prototype. The prescribed length of the cable at time $t_p$ is $l_p(t_p)$. The prescribed velocity and acceleration of both the cable and car are $$v_p(t_p) = \frac{dl_p}{dt_p} \text{ and } a_p(t_p) = \frac{d^2 l_p}{dt_p^2},$$

respectively. A positive and negative velocity $v_p(t_p)$ indicates downward and upward movement of the elevator, respectively. A linear viscous damper, located at $\theta_p(t_p)=l_p(t_p)-l_{dp}$, is attached to and moves with the cable 110. The response of the cable 110 with and without the damper 530 is referred to as the controlled and uncontrolled response, respectively. The natural damping of the cable 110, including air and material damping, is modeled as distributed, linear viscous damping. The damping coefficient $K_{vp}$ of the damper 530 in Table 4 is the optimal damping coefficient that minimizes the average vibratory energy of the cable during upward movement, as will be discussed below, and the natural damping coefficient $c_p$ in Table 5 is scaled from that for the half model in Table 6 below.

TABLE 6

Key parameters for the half and full models

| Parameter | Description | Half model | Full model |
|---|---|---|---|
| $l_{0m}$ | Band length between the elevator car and band guide at the start of movement | 1.35 m | 2.531 m |
| $l_{endm}$ | Band length between the elevator car and band guide at the end of movement | 0.20 m | 0.375 m |
| $m_{em}$ | Mass of the elevator car | 0.8 kg | |
| $T_{0m}$ | Nominal band tension at the top of the elevator car | 142.5 N | |
| $\rho_m$ | Mass per unit length of the band | 0.037 kg/m | |
| $v_{maxm}$ | Maximum velocity of the elevator | 3.20 m/s$^2$ | |
| $a_{maxm}$ | Maximum acceleration of the elevator | 30.0 m/s$^2$ | 17.305 m/s$^2$ |
| $(EI)_m$ | Bending stiffness of the band | $0.966 \times 10^{-2}$ Nm$^2$ | |
| $t_{totalm}$ | Total travel time | 0.547 s | 1.025 s |
| $l_{dm}$ | Distance between the damper and car | 7 cm | 13.1 cm |
| $K_{vm}$ | Damping coefficient of the linear viscous damper | 48.5 Ns/m | |
| $c_m$ | Natural damping coefficient | 0.106 Ns/m$^2$ | 0.057 Ns/m$^2$ |

The cable tension at spatial position $x_p$ at time $t_p$ is $$T_p(x_p,t_p)=T_{0p}+\rho_p[l_p(t_p)-x_p]g+\{m_{ep}+\rho_p[l_p(t_p)-x_p]\}a_p(t_p) \tag{92}$$

where $g=9.81$ m/s$^2$ is the gravitational constant, and $T_{0p}=m_{ep}g$ is the tension at the top of the car when the elevator is stationary or moving at constant velocity. The cable 110 is modeled as a vertically translating, tensioned beam. Its governing equation and internal conditions at $x_p=\theta_p$ are $$\begin{aligned}
&\rho_p\frac{D^2y_p}{Dt_p^2}-\frac{\partial}{\partial x_p}\left[T_p(x_p,t_p)\frac{\partial y_p}{\partial x_p}\right]+(EI)_p\frac{\partial^4 y_p}{\partial x_p^4}+c_p\frac{Dy_p}{Dt_p}=0,\quad x_p\neq\theta_p\\
&y_p(\theta_p^-,t_p)=y_p(\theta_p^+,t_p),\quad \frac{\partial y_p(\theta_p^-,t_p)}{\partial x}=\frac{\partial y_p(\theta_p^+,t_p)}{\partial x},\\
&\frac{\partial^2 y_p(\theta_p^-,t_p)}{\partial x^2}=\frac{\partial^2 y_p(\theta_p^+,t_p)}{\partial x^2}(EI)_p\frac{\partial^3 y_p(\theta_p^+,t_p)}{\partial x_p^3}-(EI)_p\frac{\partial^3 y_p(\theta_p^-,t_p)}{\partial x_p^3}=K_{vp}\frac{Dy_p(\theta_p,t_p)}{Dt_p}
\end{aligned} \tag{93}$$

where $y_p(x_p,t_p)$ is the lateral displacement of the cable particle instantaneously located at spatial position $x_p$ at time $t_p$, and $$\begin{aligned}
&\frac{D}{Dt_p}=\frac{\partial}{\partial t_p}+v_p(t_p)\frac{\partial}{\partial x_p},\\
&\frac{D^2}{Dt_p^2}=\frac{\partial^2}{\partial t_p^2}+a_p(t_p)\frac{\partial}{\partial x_p}+2v_p(t_p)\frac{\partial^2}{\partial x_p\partial t_p}+v_p^2(t_p)\frac{\partial^2}{\partial x_p^2}
\end{aligned} \tag{94}$$

are material derivatives. The boundary conditions are $$y_p(0,t_p)=y_p(l_p(t_p),t_p)=\frac{\partial y_p(0,t_p)}{\partial x_p}=\frac{\partial y_p(l_p(t_p),t_p)}{\partial x_p}=0 \tag{95}$$

The initial displacement of the cable 110 is specified along the spatial domain $0<x_p<l_{0p}$, where $l_{0p}=l_p(0)$ is the initial cable length, and the initial velocity is assumed to be zero.

The vibratory energy of the cable is $$E_{vp}(t_p)=\frac{1}{2}\int_0^{l_p(t_p)}\left[\rho_p\left(\frac{Dy_p}{Dt_p}\right)^2+T_p(x_p,t_p)\left(\frac{\partial y_p}{\partial x_p}\right)^2+(EI)_p\left(\frac{\partial^2 y_p}{\partial x_p^2}\right)^2\right]dx_p \tag{96}$$

The time rate of change of the energy in (96) is $$\begin{aligned}
\frac{dE_{vp}}{dt_p}=&-\frac{1}{2}(EI)_p v_p(t_p)\left[\frac{\partial y_p(0,t_p)}{\partial x_p}\right]^2-\frac{1}{2}j_p(t_p)\int_0^{l_p(t_p)}\{m_{ep}+\rho_p[l_p(t_p)-x_p]\}\left(\frac{\partial y_p}{\partial x_p}\right)^2dx_p-\\
&\int_0^{l_p(t_p)}c_p\left(\frac{Dy_p}{Dx_p}\right)^2dx_p-K_{vp}\left[\frac{Dy_p(\theta_p,t_p)}{Dt_p}\right]^2
\end{aligned} \tag{97}$$

where $$j_p(t_p) = \frac{da_p}{dt_p}$$

is the jerk. In the absence of the damper 530 and natural damping ($K_{vp}=c_p=0$), the vibratory energy of a uniformly accelerating or decelerating ($j_p=0$) cable 110 decreases and increases monotonically during downward ($v_p>0$) and upward ($v_p<0$) movement of the elevator 100, respectively. While a positive jerk can introduce a stabilizing effect, it is generally not large enough to suppress the inherent destabilizing effect during upward movement of the elevator 100. The results indicate that an initial disturbance in a parked elevator 100 can lead to a greatly amplified vibratory energy during its subsequent upward movement. The damper 530 can dissipate the vibratory energy because the last term in (97) is non-positive. A similar result is obtained below for the nonlinear damper used in the experimental study.

Scaled Model Design

A scaled elevator was designed to simulate the uncontrolled and controlled lateral responses of the prototype cable 110 with natural damping. Excluding the initial conditions, the lateral displacement of the cable 110 is a function $f$ of 14 variables:

$$y_p=f(x_p,t_p,l_{0p},l_{dp}(t),l_p(t),v_p(t),a_p(t),\rho_p,(EI)_p K_{vp},c_p,T_{0p},g,m_{ep}) \tag{98}$$

Note that $T_{0p}$ is included in (86) because extra tension, in addition to the car weight, needs to be applied to the model elevator. Using $l_{0p}$, $\rho_p$, and $T_{0p}$ as the repeating parameters and the Buckingham pi theorem, the 15 dimensional variables in (98) are converted into 12 dimensionless groups:

$$\prod_{1p} = \frac{y_p(x_p, t_p)}{l_{0p}} \quad \prod_{2p} = \frac{x_p}{l_{0p}} \tag{99}$$

$$\prod_{3p} = \frac{t_p}{l_{0p}}\sqrt{\frac{T_{0p}}{\rho_p}} \quad \prod_{4p} = \frac{l_p(t_p)}{l_{0p}} \quad \prod_{5p} = \frac{l_{dp}(t_p)}{l_{0p}}$$

$$\prod_{6p} = v_p(t_p)\sqrt{\frac{\rho_p}{T_{0p}}} \quad \prod_{7p} = a_p(t_p)\frac{\rho_p l_{0p}}{T_{0p}}$$

$$\prod_{8p} = K_{vp}\sqrt{\frac{1}{\rho_p T_{0p}}} \quad \prod_{9p} = c_p l_{0p}\sqrt{\frac{1}{\rho_p T_{0p}}}$$

$$\prod_{10p} = \frac{(EI)_p}{T_{0p} l_{0p}^2} \quad \prod_{11p} = \frac{g\rho_p l_{0p}}{T_{0p}} \quad \prod_{12p} = \frac{m_{ep}}{\rho_p l_{0p}}$$

While the pi terms for $v_p$ and $a_p$ can be obtained by differentiating that for $l_p$ with respect to $t_p$, they are included in (99) for convenience. If the pi terms $\Pi_{2m}, \Pi_{3m}, \ldots, \Pi_{12m}$ of the model, with the last subscript m of any variable denoting model in this paper, equal the corresponding pi terms $\Pi_{2p}, \Pi_{3p}, \ldots, \Pi_{12p}$ of the prototype, the model and prototype will be completely similar. For a reasonably sized model, all the pi terms in (99) can be fully scaled between the model and prototype except the last three ones, which describe the scaling of the bending stiffness ($\Pi_{10}$), the tension change due to gravity ($\Pi_{11}$), and the tension change due to acceleration ($\Pi_{12}$). Since $\Pi_{10p}$ is extremely small, a steel band of width 12.7 mm, thickness 0.38 mm, and elastic modulus 180 GPa was used for the model cable because its area moment of inertia $I_m$ is considerably smaller than that of a round cable for a given $\rho_m$. It can also constrain the lateral vibration of the cable 110 to a single plane for model validation purposes. The linear density and bending stiffness of the band are $\rho_m=0.03726$ kg/m and $(EI)_m=0.966\times10^{-2}$ Nm$^2$, respectively.

A model elevator consisting of a steel frame approximately three meters tall was fabricated. $\Pi_{10m}$ was minimized by using a flat band. The model configuration is shown in FIG. 14, where $l_m(t_m)$, $l_{im}$ (i=2, 3, . . . , 6), and $l_{7m}(t_m)$ are the lengths of the corresponding band segments and $T_{im}$ (i=1, 2, . . . , 13) are the tensions at the ends of all the band segments. A closed band loop is used to provide the nominal tension required by the scaling laws. Because the tension in the closed band loop has different characteristics from that in the prototype, the scaling of the tension change due to acceleration between the model and prototype is no longer governed by $\Pi_{12}$. While $\Pi_{11p}\Pi_{12p}=1$ because $T_{0p}=m_{ep}g$, $\Pi_{11m}$ is independent of $\Pi_{12m}$.

A tensioning pulley 200 was designed on a tension plate (not shown). Threaded rods with nuts move the plate upward and downward to adjust the tension in the band. Chrome steel hydraulic cylinders were used as the guide rails 135 for the model car to provide the straightness, rigidity, and smoothness of operation required. They are 25.4 mm in diameter and set 152 mm apart. Supported on a float plate (not shown), the guide rails 135 are adjustable. The model car 100 is a block of aluminum with two linear bearings 120 that slide on the guide rails 135. The bearings 120 are assumed to be rigid. The counterweight is not used in the model in order to reduce the total inertia of the system, and consequently, band slippage.

Due to the small band weight, the model is run upside-down, with the upward movement of the elevator car 100 corresponding to the decreasing band length between the car 100 and band guide 210. References to the top of the car 100 in what follows mean the side closest to the floor of the building.

The inversion of the model offers two advantages: first, it allows easier placement of and access to the sensors in the experiments, and second, it reduces band slip because during acceleration the weight of the car 100 acts in the same direction as acceleration, and during deceleration the friction force between the car 100 and guide rails 135 helps decelerate the system. The band was bolted to the top of the car 100, giving it a fixed boundary condition. The position where the band passes through the band guide 210 corresponds to $x_m=0$. The band guide 210 consists of two rollers pressed against the band to isolate the vibration of the two adjacent band segments. The shaft of one roller is fixed to the support structure and that of the other is fastened tightly to the fixed shaft through rubber bands. Due to its small dimensionless bending stiffness, the fixed and pinned boundaries yield essentially the same band response. It is assumed here that the band has a fixed boundary at the band guide 210. The model car 100 can travel a maximum distance of 2.156 m with 0.375 m of band between the car 100 and band guide 210 at the end of movement. This is referred to as the full model. By varying the position of the band guide 210, the model car 100 can travel a shorter distance. In the experiments described below, the model car 100 travels 1.15 m with 0.20 m of band between the car 100 and band guide 210 at the end of travel. This referred to as the half model. Both the half and full models are considered and their accuracies in representing the dynamic behavior of the prototype are compared.

A Kollmorgen GOLDLINE brushless servomotor (Model B-204-A-21) (not shown), with a maximum rotational speed of 1120 rpm, is used to run the model. It is mounted on a 65 mm diameter motor pulley, which allows a maximum elevator velocity of 3.76 m/s. To avoid running the motor at its absolute maximum speed, we choose $v_{max\ m}$=3.20 m/s. The nominal model tension is determined from $\Pi_{6m}=\Pi_{6p}$:

$$T_{0m} = T_{0p}\frac{v_{\max m}^2\rho_m}{v_{\max p}^2\rho_p} = 142.5\ N \tag{100}$$

Setting $\Pi_{3m}=\Pi_{3p}$ yields $$t_m = t_p\frac{l_{0m}}{l_{0p}}\sqrt{\frac{T_{0p}\rho_m}{T_{0m}\rho_p}} \tag{101}$$

This allows calculation of times in the models that correspond to those in the prototype. Setting $\Pi_{7m}=\Pi_{7p}$ yields the maximum acceleration $a_{max\ m}$ for the half and full models. Table 5 above lists the key parameters for the half and full models, where the damping coefficient $K_{vm}$ is scaled from that for the prototype in Table 4, the natural damping coefficient $c_m$ for the half model was determined experimentally, as will be discussed below, and $c_m$ for the full model is scaled from that for the prototype in Table 4.

Movement Profile

Given the maximum velocity $v_{max\ p}$, maximum acceleration $a_{max\ p}$, initial position $l_{0p}$, final position $l_{endp}$, and total travel time $t_{totalp}$ of the prototype elevator 100, a movement profile $l_p(t_p)$ is created. It differs from that in W. D. Zhu and Teppo, "Design and Analysis of a Scaled Model of a High-Rise, High-Speed Elevator," Journal of Sound and Vibration, Vol. 264, pp. 707-731 (2003), as the total travel time is not specified there. The movement profile is divided into seven regions, shown in Table 7 below, and has a continuous and finite jerk in the entire period of motion.

TABLE 7

Prototype movement profile regions

| Region | Duration | Description |
|---|---|---|
| 1 | $t_{jp}$ | Increasing acceleration to $a_p = a_{maxp}$ |
| 2 | $t_a$ | Constant acceleration at $a_{maxp}$ |
| 3 | $t_j$ | Decreasing acceleration to a = 0, $v = v_{maxp}$ |
| 4 | $t_v$ | Constant velocity at $v_{maxp}$ |
| 5 | $t_j$ | Increasing deceleration to $a = -a_{maxp}$ |
| 6 | $t_a$ | Constant deceleration at $a = -a_{maxp}$ |
| 7 | $t_j$ | Decreasing deceleration to a = 0, v= 0 |

Let $t_{0p}$ be the start time of region 1, and $t_{1p}$ through $t_{7p}$ be the times at the ends of regions 1 through 7, respectively. Similarly, let $l_{0p}$ through $l_{7p}$, $v_{0p}$ through $v_{7p}$, $a_{0p}$ through $a_{7p}$, and $i_{0p}$ through $i_{7p}$ be the positions, velocities, accelerations, and jerks of the elevator at times $t_{0p}$ through $t_{7p}$, respectively. In each region i (i=1, 2, . . . , 7), the function $l_p(t_p)$ is given by a fifth order polynomial $$l_p(t_p) = C_{0p}^{(i)} + C_{1p}^{(i)}(t_p - t_{(i-1)p}) + C_{2p}^{(i)}(t_p - t_{(i-1)p})^2 + C_{3p}^{(i)}(t_p - t_{(i-1)p})^3 + C_{4p}^{(i)}(t_p - t_{(i-1)p})^4 + C_{5p}^{(i)}(t_p - t_{(i-1)p})^5 \tag{102}$$

where $t_{(i-1)p} \leqq t_p \leqq t_{ip}$ and $C_{np}^{(i)}$ (n=0, 1, . . . , 5) are unknown constants to be determined. A symmetric profile is designed, in which the durations of regions 1, 3, 5, and 7 are denoted by $t_{ip}$, the durations of regions 2 and 5 by $t_{ap}$, and the duration of region 4 by $t_{vp}$. The relationship among $t_{totalp}$, $t_{ip}$, $t_{ap}$, and $t_{vp}$ is $$t_{totalp}=4t_{jp}+2t_{ap}+t_{vp} \tag{103}$$

The jerk function in region 1 is assumed to be given by a second order polynomial, $j_p(t_p)=\alpha_p(t_p-t_{0p})+\beta_p(t_p-t_{0p})^2$, where $\alpha_p$ and $\beta_p$ are unknown constants. Since the jerk at the end of region 1, i.e., $t_p-t_{0p}=t_{jp}$, is zero, we have $$\beta_p = -\frac{\alpha_p}{t_{ip}}.$$

So in region 1, $$i_p(t_p) = \alpha_p(t_p - t_{0p}) - \frac{\alpha_p}{t_{jp}}(t_p - t_{0p})^2 \tag{104}$$

Since the elevator 100 starts from position $l_{0p}$ with zero velocity and acceleration, we have by integrating (104)

$$a_p(t_p) = \frac{\alpha_p(t_p - t_{0p})^2}{2} - \frac{\alpha_p(t_p - t_{0p})^3}{3t_{jp}} \tag{105}$$

$$v_p(t_p) = \frac{\alpha_p(t_p - t_{0p})^3}{6} - \frac{\alpha_p(t_p - t_{0p})^4}{12t_{jp}}$$

$$l_p(t_p) = l_{0p} + \frac{\alpha_p(t_p - t_{0p})^4}{24} - \frac{\alpha_p(t_p - t_{0p})^5}{60t_{jp}}$$

Comparing the coefficients of the last equation in (105) with those in (102) yields $$C_{0p}^{(1)} = l_{0p} \tag{106}$$

$$C_{1p}^{(1)} = C_{2p}^{(1)} = C_{3p}^{(1)} = 0$$

$$C_{4p}^{(1)} = \frac{\alpha_p}{24}$$

$$C_{5p}^{(1)} = -\frac{\alpha_p}{60t_{ip}}$$

At the end of region 1, i.e., $t_p-t_{0p}=t_{jp}$, we have from (104) and (105)

$$j_{1p} = 0 \tag{107}$$

$$a_{1p} = \frac{\alpha t_{ip}^2}{6}$$

$$v_{1p} = \frac{\alpha t_{jp}^3}{12}$$

$$l_{1p} = l_{0p} - \frac{\alpha t_{ip}^4}{40}$$

Region 2 has constant acceleration, so $$C_{3p}^{(2)} = C_{4p}^{(2)} = C_{5p}^{(2)} = 0 \tag{108}$$

and $$l_p(t_p) = l_{1p} + v_{1p}(t_p - t_{1p}) + \frac{a_{1p}(t_p - t_{1p})^2}{2}$$

Comparing the coefficients in (108) with those in (102) yields $$C_{0p}^{(2)} = l_{1p} \tag{109}$$
$$C_{1p}^{(2)} = v_{1p}$$
$$C_{2p}^{(2)} = \frac{a_{1p}}{2}$$

At the end of region 2, i.e., $t_p - t_{1p} = t_{ap}$, we have from (108)

$$j_{2p} = 0 \tag{110}$$
$$a_{2p} = \frac{\alpha t_{ip}^2}{6} = a_{\max p}$$
$$v_{2p} = v_{1p} + \frac{\alpha_p t_{jp}^2 t_{ap}}{6}$$
$$l_{2p} = l_{1p} + \frac{\alpha_p t_{jp}^3 t_{ap}}{12} + \frac{\alpha_p t_{jp}^2 t_{ap}^2}{12}$$

The jerk function in region 3 is assumed to be $$i_p(t_p) = -\alpha_p(t_p - t_{2p}) + \frac{\alpha_p}{t_{jp}}(t_p - t_{2p})^2 \tag{111}$$

Since the values of $l_p$, $\dot{l}_p$, $\ddot{l}_p$, and $\dddot{l}_p$ at $t_p = t_{2p}$ are $l_{2p}$, $v_{2p}$, $a_{2p}$, and zero, respectively, we have by integrating (111)

$$l_p(t_p) = l_{2p} + v_{2p}(t_p - t_{2p}) + \frac{a_{2p}(t_p - t_{2p})^2}{2} - \frac{\alpha_p(t_p - t_{2p})^4}{24} + \frac{\alpha_p(t_p - t_{2p})^5}{60 t_{jp}} \tag{112}$$

Comparing the coefficients in (112) with those in (102) yields $$C_{0p}^{(3)} = l_{2p} \tag{113}$$
$$C_{1p}^{(3)} = v_{2p}$$
$$C_{2p}^{(3)} = \frac{a_{2p}}{2}$$
$$C_{3p}^{(3)} = 0$$
$$C_{4p}^{(3)} = -\frac{\alpha_p}{24}$$
$$C_{5p}^{(3)} = \frac{\alpha_p}{60 t_{ip}}$$

At the end of region 3, i.e., $t_p - t_{2p} = t_{ap}$, we have from (112)

$$j_{3p} = 0 \tag{114}$$
$$a_{3p} = 0$$
$$v_{3p} = v_{\max p} = \frac{\alpha_p t_{jp}^3}{6} + \frac{\alpha_p t_{jp}^2 t_{ap}}{6}$$
$$l_{3p} = l_{2p} + \frac{17\alpha_p t_{jp}^4}{120} + \frac{\alpha_p t_{jp}^3 t_{ap}}{6}$$

By the second equation in (110) and the third equation in (114), we have $$t_{ap} = \frac{v_{\max p}}{a_{\max p}} - t_{jp} \tag{115}$$

Since region 4 has constant velocity $v_{max\ p}$, we have $$l_p(t_p) = l_{3p} + v_{max\ p}(t_p - t_{3p}) \tag{116}$$

Comparing the coefficients in (116) with those in (102) yields $$C_{2p}^{(4)} = C_{3p}^{(4)} = C_{4p}^{(4)} = C_{5p}^{(4)} = 0,$$
$$C_{1p}^{(4)} = v_{\max p}, \text{ and } C_{0p}^{(4)} = l_{3p}.$$

At the end of region 4, i.e., $t_p - t_{3p} = t_{vp}$, we have from (116)

$$j_{4p} = 0 \quad a_{4p} = 0 \quad v_{4p} = v_{max\ p} \quad l_{4p} = l_{3p} + v_{max\ p} t_{vp} \tag{117}$$

Region 5 has a jerk function similar to that in region 3

$$i_p(t_p) = -\alpha_p(t_p - t_{4p}) + \frac{\alpha_p}{t_{jp}}(t_p - t_{4p})^2 \tag{118}$$

Since the values of $l_p$, $\dot{l}_p$, $\ddot{l}_p$, and $\dddot{l}_p$ at $t_p = t_{4p}$ are $l_{4p}$, $v_{4p}$, $a_{4p}$, and zero, respectively, we have by integrating (118)

$$l_p(t_p) = l_{4p} + v_{4p}(t_p - t_{4p}) - \frac{\alpha_p(t_p - t_{4p})^4}{24} + \frac{\alpha_p(t_p - t_{4p})^5}{60 t_{jp}} \tag{119}$$

Comparing the coefficients in (119) with those in (102) yields $$C_{0p}^{(5)} = P_{4p} \tag{120}$$
$$C_{1p}^{(5)} = v_{4p} = v_{\max p}$$
$$C_{2p}^{(5)} = 0$$
$$C_{3p}^{(5)} = 0$$
$$C_{4p}^{(3)} = -\frac{\alpha_p}{24}$$
$$C_{5p}^{(3)} = \frac{\alpha_p}{60 t_{ip}}$$

At the end of region 5, i.e., $t_p - t_{4p} = t_{jp}$, we have from (119)

$$j_{5p} = 0 \tag{121}$$
$$a_{5p} = -\frac{\alpha t_{jp}^2}{6} = -a_{\max p}$$
$$v_{5p} = \frac{\alpha_p t_{jp}^3}{12} + \frac{\alpha_p t_{jp}^2 t_{ap}}{6}$$
$$l_{5p} = l_{4p} + \frac{17\alpha_p t_{jp}^4}{120} + \frac{\alpha_p t_{jp}^3 t_{ap}}{6}$$

Region 6 has constant acceleration, so $C_{3p}^{(6)} = C_{4p}^{(6)}) = C_{5p}^{(6)} = 0$ and $$l_p(t_p) = l_{5p} + v_{5p}(t_p - t_{5p}) + \frac{a_{5p}(t_p - t_{5p})^2}{2} \tag{122}$$

Comparing the coefficients in (122) with those in (102) yields $$C_{0p}^{(6)} = l_{5p} \tag{123}$$
$$C_{1p}^{(6)} = v_{5p}$$
$$C_{2p}^{(6)} = \frac{a_{5p}}{2}$$

At the end of region 6, i.e., $t_9 - t_{5p} = t_{ap}$, we have from (122)

$$j_{6p} = 0 \tag{124}$$
$$a_{6p} = -\frac{\alpha_p t_{jp}^2}{6} = -a_{\max p}$$
$$v_{6p} = v_{5p} - \frac{\alpha_p t_{jp}^2 t_{ap}}{6} = \frac{\alpha_p t_{jp}^3}{12}$$
$$l_{6p} = l_{5p} + \frac{\alpha_p t_{jp}^3 t_{ap}}{12} + \frac{\alpha_p t_{jp}^2 t_{ap}^2}{12}$$

Region 7 has a jerk function similar to that in region 1

$$j_p(t_p) = \alpha_p(t_p - t_{6p}) - \frac{\alpha_p}{t_{jp}}(t_p - t_{6p})^2 \tag{125}$$

Since the values of $l_p$, $\dot{l}_p$, $\ddot{l}_p$, and $\dddot{l}_p$, at $t_p = t_{6p}$ are $l_{6p}$, $v_{6p}$, $a_{6p}$, and zero, respectively, we have by integrating (125)

$$l_p(t_p) = l_{6p} + v_{6p}(t_p - t_{6p}) + \frac{a_{6p}(t_p - t_{6p})^2}{2} + \frac{\alpha_p(t_p - t_{6p})^4}{24} - \frac{\alpha_p(t_p - t_{6p})^5}{60 t_{jp}} \tag{126}$$

Comparing the coefficients in (125) with those in (102) yields $$C_{0p}^{(7)} = l_{6p} \tag{127}$$
$$C_{1p}^{(7)} = v_{6p}$$

-continued $$C_{2p}^{(7)} = \frac{a_{6p}}{2}$$
$$C_{3p}^{(7)} = 0$$
$$C_{4p}^{(7)} = \frac{\alpha_p}{24}$$
$$C_{5p}^{(7)} = -\frac{\alpha_p}{60 t_{ip}}$$

At the end of region 7, i.e., $t_9 - t_{6p} = t_{jp}$, we have from (126)

$$j_{7p} = 0 \tag{128}$$
$$a_{7p} = 0$$
$$v_{7p} = 0$$
$$l_{7p} = l_{6p} + \frac{\alpha_p t_{jp}^4}{40}$$

Since, $l_{7p} - l_{0p} = l_{endp} - l_{0p}$, we have by using the last equation in (107), (110), (114), (117), (121), (124), and (128)

$$\frac{\alpha_p t_{jp}^4}{3} + \frac{\alpha_p t_{jp}^3 t_{ap}}{2} + \frac{\alpha_p t_{jp}^2 t_{ap}^2}{6} + \frac{\alpha_p t_{jp}^3 t_{vp}}{6} + \frac{\alpha_p t_{jp}^2 t_{ap} t_{vp}}{6} = l_{endp} - l_{0p} \tag{129}$$

Using (103), (121), and the second equation in (121), we have from (129)

$$\alpha_p = \frac{6 a_{\max\ p}^3 v_{\max\ p}^2}{[t_{totalp} v_{\max p} a_{\max p} - a_{\max p}(l_{0p} - l_{endp}) - v_{\max p}^2]^2} \tag{130}$$

and subsequently have $$t_{ip} = \sqrt{\frac{6 a_{\max p}}{\alpha_p}} \tag{131}$$
$$t_{ap} = \frac{v_{\max p}}{a_{\max p}} - t_{jp}$$
$$t_{vp} = t_{totalp} - 4t_{jp} - 2t_{ap}$$

The movement profile of the prototype elevator in Table 4 is shown FIG. 15, and that for a model can be obtained using the scaling laws.

Analysis of Model Tension

The closed band loop is a statically indeterminate system. The statistically indeterminate analysis in W. D. Zhu and Teppo, "Design and Analysis of a Scaled Model of a High-Rise, High-Speed Elevator," Journal of Sound and Vibration, Vol. 264, pp. 707-731 (2003) is used to determine the model tension. The longitudinal vibration of the band is neglected. The model frame and pulleys are assumed to be rigid, and the total elongation $\Delta l_m$ of the band remains constant. The elongation of the segment of the band that wraps around each pulley is neglected. While the friction forces are neglected in the prototype, they are considered in the model.

Since the coefficient of friction between the motor pulley and the band is smaller than the minimum coefficient of friction required to prevent band slip, the motor pulley is coated with a plastic substance used to coat tool handles to control band slip, and it works well. It is assumed that the band does not slip on the tensioning and idler pulleys and rollers in the band guide. Because the static frictions at the elevator car, band guide, and pulleys can act in either direction and assume different values when the model is at rest, the tension $T_{0vm}$ of the band at the top of the car 100, when the car 100 is at its start position ($l_{7m}$=0.3 m) of an upward (towards the band guide) movement with constant velocity, is set to the nominal tension $T_{0m}$. The kinetic frictions are assumed to remain constant when the model is in motion, and the idler and tensioning pulleys have the same friction. Because the motor is driving the system, the friction at the motor pulley does not affect the tension in the band.

Denote the elevator car friction by $F_e$, pulley friction by $F_u$, which is expressed as a tension difference across the surface, and band guide friction by $F_g$. When the motor is placed at the top left position (between $T_{9m}$ and $T_{10m}$) in FIG. 14, the tensions at all the other locations during constant velocity movement are determined successively from $$T_{1vm}=T_{0vm}-\rho_m l_m g \quad T_{2vm}=T_{1vm}+F_g \quad T_{3vm}=T_{2vm}-\rho_m l_{2m} g$$
$$T_{4vm}=T_{3vm}+F_p$$

$$T_{5vm}=T_{4vm} \quad T_{6vm}=T_{5vm}+F_p \quad T_{7vm}=T_{6vm} \quad T_{8vm}=T_{7vm}+F_p$$
$$T_{9vm}=T_{8vm}+\rho_m l_{5m} g$$

$$T_{13vm}=T_{0vm}+m_{em}g-F_e \quad T_{12vm}=T_{13vm}+\rho_m l_{7m} g$$
$$T_{11vm}=T_{12vm}-F_p \quad T_{10vm}=T_{11vm} \tag{132}$$

Equating the total elongation of the band to $\Delta l_m$ yields $$\begin{aligned} T_{0vm} l_{totalm} = & \\ & (EA)_m \Delta l_m + \frac{1}{2}\rho_m g l_m^2 + \left[\rho_m g l_m + \frac{1}{2}\rho_m g l_{2m} - F_g\right] l_{2m} + \\ & [\rho_m g l_m + \rho_m g l_{2m} - F_g - F_p] l_{3m} + \\ & [\rho_m g l_m + \rho_m g l_{2m} - F_g - 2F_p] l_{4m} + \\ & \left[\rho_m g l_m + \rho_m g l_{2m} - \frac{1}{2}\rho_m g l_{5m} - F_g - 3F_p\right] l_{5m} - \\ & [m_{em} g + \rho_m g l_{7m} - F_u - F_e] l_{6m} - \left[m_{em} g + \frac{1}{2}\rho_m g l_{7m} - F_e\right] l_{7m} \end{aligned} \tag{133}$$

where $$l_{totalm} = l_m + \sum_{i=2}^{7} l_i$$

is the total length of the band. The lengths of various band segments, the axial stiffness $(EA)_m$ of the band, and the friction forces determined experimentally (discussed below) are given in Table 8 below.

TABLE 8

Additional parameters for the half and full models

| Parameter | Half model | Full model |
|---|---|---|
| $l_{2m}$ | 1.24 m | 0.14 m |
| $l_{3m}$ | 0.23 m | |
| $l_{4m}$ | 0.23 m | |
| $l_{5m}$ | 2.90 m | |
| $l_{6m}$ | 0.41 m | |
| $l_{7m}$ | 0.3 m + $l_m$ | |
| $m_{um}$ | 0.085 kg | |
| $(EA)_m$ | 870966 N | |
| $F_e$ | 10.1 N | |
| $F_g$ | 1.5 N | |
| $F_u$ | 3.2 N | |
| $m_g$ | 0.050 kg | |

At the start of movement with constant velocity, $T_{0vm}=T_{0m}$ and the total elongation of the band determined from (133) is $\Delta l_m$=1.136 mm for the half model and $\Delta l_m$=1.125 mm for the full model. When the car 100 reaches any other position with constant velocity, $T_{0vm}$ is determined from (133), where $\Delta l_m$ remains unchanged for either model.

During acceleration, the tension changes at all the locations in the band over the constant velocity case can be determined. They arise from acceleration of the band ($\Delta T_{9m}^{band}$), elevator car ($\Delta T_{9m}^{car}$) idler and tensioning pulleys ($\Delta T_{9m}^{pulley}$), and rollers in the band guide ($\Delta T_{9m}^{guide}$). Using the condition that the total change of the elongation of the band equals zero, we obtain the tension change over $T_{9vm}$ due to acceleration $a_m$:

$$\begin{aligned} \Delta T_{9m} = & \Delta T_{9m}^{band} + \Delta T_{9m}^{car} + \Delta T_{9m}^{pulley} + \Delta T_{9m}^{guide} = \\ & \frac{\rho_m l_{totalm} a_m}{2} + \frac{m_{em} a_m (l_{6m} + l_{7m})}{l_{totalm}} + \\ & \frac{(3l_m + 3l_{2m} + 2l_{3m} + l_{4m} + 4l_{6m} + 3l_{7m})}{l_{totalm}} m_u a_m + \\ & \frac{(l_m + l_{6m} + l_{7m})}{l_{totalm}} m_g a_m \end{aligned} \tag{134}$$

where $m_u$ is the effective mass of each pulley, and $m_g=m_r$, with $m_r$ being the mass of each roller, is the effective mass of the two rollers in the band guide. Note that $m_g$ and $m_u$ are determined in a similar manner and their values are given in Table 8 above. The tension change at any other location is calculated successively by subtracting from $\Delta T_{9m}$ the amount of tension difference required to accelerate each associated component:

$$\Delta T_{8m}=\Delta T_{9m}-\rho_m l_{5m} a_m \quad \Delta T_{7m}=\Delta T_{8m}-m_{um} a_m$$
$$\Delta T_{6m}=\Delta T_{7m}-\rho_m l_{4m} a_m$$

$$\Delta T_{5m}=\Delta T_{6m}-m_{um} a_m \quad \Delta T_{4m}=\Delta T_{5m}-\rho_m l_{3m} a_m$$
$$\Delta T_{3m}=\Delta T_{4m}-m_{um} a_m$$

$$\Delta T_{2m}=\Delta T_{3m}-\rho_m l_{2m} a_m \quad \Delta T_{1m}=\Delta T_{2m}-m_g a_m$$
$$\Delta T_{0m}=\Delta T_{1m}-\rho_m l_m a_m$$

$$\Delta T_{13m}=\Delta T_{0m}-m_{em} a_m \quad \Delta T_{12m}=\Delta T_{13m}-\rho_m l_{7m} a_m$$
$$\Delta T_{11m}=\Delta T_{12m}-m_{um} a_m$$

$$\Delta T_{10m}=\Delta T_{11m}-\rho_m l_{6m} a_m \tag{135}$$

Specifically, we have $$\Delta T_{0m} = \frac{\rho_m l_{totalm} a_m}{2} + \frac{m_{em} a_m (l_{6m} + l_{7m})}{l_{totalm}} + \frac{(3l_m + 3l_{2m} + 2l_{3m} + l_{4m} + 4l_{6m} + 3l_{7m})}{l_{totalm}} m_{um} a_m + \frac{(l_m + l_{6m} + l_{7m})}{l_{totalm}} m_g a_m - \rho_m a_m (l_m + l_{2m} + l_{3m} + l_{4m} + l_{5m}) - 4m_{um} a_m - m_g a_m \tag{136}$$

The tension at the top of the car during acceleration, $T_{0am}=T_{0vm}+\Delta T_{0m}$, under the movement profile corresponding to that for the prototype in FIG. 15, is shown as a solid line in FIGS. 16(*b*) and 16(*c*) for the half and full models, respectively. When the motor is placed at the bottom left position (between $T_{7m}$ and $T_{8m}$) in FIG. 14, the tension $T_{0am}$ under the same movement profile is shown as a dashed line in FIGS. 16(*b*) and 16(*c*) for the half and full models, respectively. The tensions in FIGS. 16(*b*) and 16(*c*) are compared with the prototype tension at the top of the car, $T_{0ap}=m_{ep}(g+a_p)$, under the movement profile in FIG. 15, as shown in FIG. 16(*a*). The prototype tension $T_{0ap}$ increases and decreases by 6.73%, respectively, during acceleration in region 2 and deceleration in region 6. When the motor is at the bottom left position, the model tension $T_{0am}$ increases by 11.85-11.91% in region 2 and decreases by 15.68-15.73% in region 6 for the half model, and increases by 6.29-6.35% in region 2 and decreases by 10.11-10.17% in region 6 for the full model. When the motor is at the top left position, $T_{0am}$ decreases by 3.49-3.55% and 0.27-0.35% in regions 2 and 6, respectively, for the half model, and by 1.69-1.74% and 2.08-2.15% in regions 2 and 6, respectively, for the full model.

The top right position (between $T_{11m}$ and $T_{12m}$) in FIG. 14 is a less superior position for the motor than the top left position, as it leads to more deviation of the model tension relative to the prototype tension (see FIG. 16). Similarly, the bottom right position (between $T_{3m}$ and $T_{4m}$) in FIG. 14 is a less superior position for the motor than the bottom left position. While the tension change due to acceleration ($\Pi_{12}$) is fully scaled between the model and prototype, it has a secondary effect on the response, as will be discussed below.

Dynamic Model

The damper 530 used for the model elevator satisfies approximately the velocity-squared damping law with the damping coefficient $K_{nm}$. When the mass of the damper $m_{dm}$ is included in the theoretical model, the internal condition for the model band, corresponding to the third equation in (93) for the prototype cable, is $$(EI)_m \frac{\partial^3 y_m(\theta_m^+, t_m)}{\partial x_m^3} - (EI)_m \frac{\partial^3 y_m(\theta_m^-, t_m)}{\partial x_m^3} = m_{dm} \frac{D^2 y_m(\theta_m, t_m)}{Dt_m^2} + \tag{137}$$

-continued $$K_{vm} \frac{Dy_m(\theta_m, t_m)}{Dt_m} + K_{nm} \left[\frac{Dy_m(\theta_m, t_m)}{Dt_m}\right]^2 sgn\left(\frac{Dy_m(\theta_m, t_m)}{Dt_m}\right)$$

where sgn(•) is the sign function, $K_{nm}=0$ for the linear damper, and $K_{vm}=0$ for the nonlinear damper. The corresponding energy expression is given by (96) with the subscript p replaced by m and an additional term $$\frac{1}{2} m_{dm} \left[\frac{Dy_m(\theta_m, t_m)}{Dt_m}\right]^2.$$

When the damper 530 is linear, the rate of change of energy is given by (97) with the subscript p replaced by m. When the damper 530 is nonlinear, the rate of change of energy is given by (97) with the subscript p replaced by m and the last term replaced by $$-K_{nm} \left[\frac{Dy_m(\theta_m, t_m)}{Dt_m}\right]^2 \left|\frac{Dy_m(\theta_m, t_m)}{Dt_m}\right|,$$

which is non-positive. Hence the nonlinear damper will dissipate the vibratory energy.

The discretized equations of the model band with the linear or nonlinear damper 530 are given below and those of the prototype cable can be similarly obtained. The response of the model band is assumed in the form $$y_m(x_m, t_m) = \sum_{i=1}^{N} q_{im}(t_m) \phi_{im}(x_m, t_m),$$

where $q_{im}(t_m)$ are the generalized coordinates, $\phi_{im}(x_m,t_m)$ are the instantaneous, orthonormal eigenfunctions of an untensioned, stationary beam with variable length $l_m(t_m)$ and fixed boundaries, and N is the number of included modes. In the calculations below, we use N=30. A key observation is that $\phi_{im}(x_m,t_m)$ can be expressed as $$\phi_{im}(x_m, t_m) = \frac{1}{\sqrt{l_m(t_m)}} \psi_i(\xi) \tag{138}$$

where $\xi=x_m/l_m(t_m)$, and $\psi_i(\xi)$, having the same form for the model and prototype, are the orthonormal eigenfunctions of an untensioned, stationary beam with unit length and fixed boundaries. The discretized equations of the controlled band are $$[M + A(t_m)]\ddot{q}(t_m) + [D(t_m) + P(t_m)]\dot{q}(t_m) + [W(t_m) + Q(t_m)]q(t_m) + F(q, \dot{q}, t_m) = 0 \tag{139}$$

where $$M_{ij} = \rho_m \delta_{ij}$$

$$A_{ij} = m_{dm} l_m^{-1}(t_m)\psi_i\left(\frac{\theta_m(t_m)}{l_m(t_m)}\right)\psi_j\left(\frac{\theta_m(t_m)}{l_m(t_m)}\right)$$

$$D_{ij} = -\rho_m l_m^{-1}(t_m)\dot{l}_m(t_m)\left[\delta_{ij} - 2\int_0^1 (1-\xi)\psi_i'(\xi)\psi_j'(\xi)d\xi\right] + c_m\int_0^1 \psi_i(\xi)\psi_j(\xi)d\xi$$

$$P_{ij} = m_{dm}\dot{l}_m(t_m) l_m^{-2}(t_m)\left[2(l_m - \theta_m)l_m^{-1}(t)\psi_i\left(\frac{\theta_m(t_m)}{l_m(t_m)}\right)\psi_j'\left(\frac{\theta_m(t_m)}{l_m(t_m)}\right) - \psi_i\left(\frac{\theta_m(t_m)}{l_m(t_m)}\right)\psi_j\left(\frac{\theta_m(t_m)}{l_m(t_m)}\right)\right] + K_{vm} l_m^{-1}(t_m)\psi_i\left(\frac{\theta_m(t_m)}{l_m(t_m)}\right)\psi_j\left(\frac{\theta_m(t_m)}{l_m(t_m)}\right)$$

$$W_{ij} = \rho_m l_m^{-2}(t)\dot{l}_m^2(t_m)\left[\frac{1}{4}\delta_{ij} - \int_0^1 (1-\xi)^2\psi_i'(\xi)\psi_j'(\xi)d\xi\right] + \rho_m l_m^{-1}(t_m)[g - \ddot{l}_m(t_m)]\int_0^1 (1-\xi)\psi_i'(\xi)\psi_j'(\xi)d\xi + T_{0am}(t_m)l_m^{-2}(t_m)\int_0^1 \psi_i'(\xi)\psi_j'd\xi + EIl_m^{-4}(t_m)\int_0^1 \psi_i''(\xi)\psi_j''(\xi)d\xi + \rho_m[l_m^{-2}(t_m)\dot{l}_m^2(t_m) - l_m^{-1}(t_m)\ddot{l}_m(t_m)]\left[\frac{1}{2}\delta_{ij} - \int_0^1 (1-\xi)\psi_i(\xi)\psi_j(\xi)d\xi\right]$$

$$Q_{ij} = m_{dm}\left[\frac{3}{4}\dot{l}_m^2(t_m) - \frac{1}{2}l_m(t_m)\ddot{l}_m(t_m)\right] l_m^{-3}(t_m)\psi_i\left(\frac{\theta_m(t_m)}{l_m(t_m)}\right)\psi_j\left(\frac{\theta_m(t_m)}{l_m(t_m)}\right) + m_{dm}[l_m(t_m) - \theta_m(t_m)][l_m(t_m)\ddot{l}_m(t_m) - 3\dot{l}_m^2(t_m)] l_m^{-4}(t_m)\psi_i\left(\frac{\theta_m(t_m)}{l_m(t_m)}\right)\psi_j'\left(\frac{\theta_m(t_m)}{l_m(t_m)}\right) + m_{dm}[l_m(t_m) - \theta_m(t_m)]^2 \dot{l}_m^2(t_m)l_m^{-5}(t_m)\psi_i\left(\frac{\theta_m(t_m)}{l_m(t_m)}\right)\psi_j''\left(\frac{\theta_m(t_m)}{l_m(t_m)}\right) - K_{vm}\dot{l}_m(t_m)l_m^{-2}(t_m)\left[\frac{1}{2}\psi_i\left(\frac{\theta_m(t_m)}{l_m(t_m)}\right)\psi_j\left(\frac{\theta_m(t_m)}{l_m(t_m)}\right) - \frac{l_m(t_m) - \theta_m(t_m)}{l_m(t_m)}\psi_i\left(\frac{\theta_m(t_m)}{l_m(t_m)}\right)\psi_j'\left(\frac{\theta_m(t_m)}{l_m(t_m)}\right)\right]$$

$$F_i = K_{nm}[q^T X(t_m)q + \dot{q}^T Y(t_m)q + \dot{q}^T Z(t_m)\dot{q}]l_m^{-\frac{3}{2}}(t_m)\psi_i\left(\frac{\theta_m(t_m)}{l_m(t_m)}\right) sgn\left\{l_m^{-\frac{1}{2}}(t_m)\psi_i\left(\frac{\theta_m(t_m)}{l_m(t_m)}\right)\dot{q} + l_m^{-\frac{5}{2}}(t_m)\dot{l}(t_m)[l_m(t_m) - \theta_m(t_m)]\psi_i'\left(\frac{\theta_m(t_m)}{l_m(t_m)}\right)q - \frac{1}{2}l_m^{-\frac{3}{2}}(t_m)\dot{l}(t_m)\psi_i\left(\frac{\theta_m(t_m)}{l_m(t_m)}\right)q\right\} \tag{140}$$

in which $\delta_{ij}$ the Kronecker delta and entries of X, Y, and Z are $$X_{kl} = \left[-2\theta_m(t_m)l_m^{-1}(t_m)\psi_k\left(\frac{\theta_m(t_m)}{l_m(t_m)}\right)\psi_l\left(\frac{\theta_m(t_m)}{l_m(t_m)}\right) + \frac{1}{4}\psi_k\left(\frac{\theta_m(t_m)}{l_m(t_m)}\right)\psi_l\left(\frac{\theta_m(t_m)}{l_m(t_m)}\right) + \theta_m^2(t_m)l_m^{-2}(t_m)\psi_k'\left(\frac{\theta_m(t_m)}{l_m(t_m)}\right)\psi_l'\left(\frac{\theta_m(t_m)}{l_m(t_m)}\right) + \psi_k'\left(\frac{\theta_m(t_m)}{l_m(t_m)}\right)\psi_l'\left(\frac{\theta_m(t_m)}{l_m(t_m)}\right) + \theta_m(t_m)l_m^{-1}(t_m)\psi_k\left(\frac{\theta_m(t_m)}{l_m(t_m)}\right)\psi_l'\left(\frac{\theta_m(t_m)}{l_m(t_m)}\right) - \psi_k\left(\frac{\theta_m(t_m)}{l_m(t_m)}\right)\psi_l'\left(\frac{\theta_m(t_m)}{l_m(t_m)}\right)\right]\dot{l}_m^2(t_m)l_m^{-2}(t_m) \tag{141}$$

$$Y_{kl} = \left[2\psi_k\left(\frac{\theta_m(t_m)}{l_m(t_m)}\right)\psi_l'\left(\frac{\theta_m(t_m)}{l_m(t_m)}\right) - \psi_k\left(\frac{\theta_m(t_m)}{l_m(t_m)}\right)\psi_l\left(\frac{\theta_m(t_m)}{l_m(t_m)}\right) - 2\theta_m(t_m)l_m^{-1}(t_m)\psi_k\left(\frac{\theta_m(t_m)}{l_m(t_m)}\right)\psi_l'\left(\frac{\theta_m(t_m)}{l_m(t_m)}\right)\right]\dot{l}_m(t_m)l_m^{-1}(t_m)$$

$$Z_{ij} = \psi_i\left(\frac{\theta_m(t_m)}{l_m(t_m)}\right)\psi_j\left(\frac{\theta_m(t_m)}{l_m(t_m)}\right)$$

Note that the use of (138) renders the component matrices of M, D, and W, which involve integration, time-invariant. This greatly simplifies the analysis. While the component matrices of other matrices, such as A, P, and Q, depend on time, they do not involve integration.

When the damper 530 is linear, $K_{nm}=0$ and consequently F=0 in (140). When the damper is nonlinear, $K_{vm}=0$ in the entries of P, W, and Q in (140). The discretized expression of the energy associated with the lateral vibration of the band is $$E_m(t_m) = \frac{1}{2}[\dot{q}^T(t_m)M\dot{q}(t_m) + \dot{q}^T(t_m)R(t_m)q(t_m) + q^T(t_m)S(t_m)q(t_m)] \tag{142}$$

where $$R_{ij} = -\rho_m l_m^{-1}(t_m)\dot{l}_m(t_m)\delta_{ij} + 2\rho_m l_m^{-1}(t_m)\dot{l}_m(t_m)\int_0^1 (1-\xi)\psi_i(\xi)\psi_j'(\xi)d\xi - m_{dm}\dot{l}_m(t_m)l_m^{-2}(t_m)\psi_i\left(\frac{\theta_m(t_m)}{l_m(t_m)}\right)\psi_j\left(\frac{\theta_m(t_m)}{l_m(t_m)}\right) + 2m_{dm}\dot{l}_m(t_m)\frac{l_m(t_m) - \theta_m(t_m)}{l_m^3(t_m)}\psi_i\left(\frac{\theta_m(t_m)}{l_m(t_m)}\right)\psi_j'\left(\frac{\theta_m(t_m)}{l_m(t_m)}\right)$$

$$S_{ij} = \rho_m\left[-\frac{1}{4}l_m^{-2}(t_m)\dot{l}_m^2(t_m)\delta_{ij} + \dot{l}_m^2(t_m)l_m^{-2}(t_m)\int_0^1 (1-\xi)^2\psi_i'(\xi)\psi_j'(\xi)d\xi + l_m^{-1}(t_m)[g - \ddot{l}_m(t_m)]\int_0^1 (1-\xi)\psi_i'(\xi)\psi_j'(\xi)d\xi\right] + EIl_m^{-4}(t_m)\int_0^1 \psi_i''(\xi)\psi_j''(\xi)d\xi + T_{0am}(t_m)l_m^{-2}(t_m)\int_0^1 \psi_i'(\xi)\psi_j'(\xi)d\xi + \frac{1}{4}m_{dm}l_m^{-3}(t_m)\dot{l}_m^2(t_m)\psi_i\left(\frac{\theta_m(t_m)}{l_m(t_m)}\right)\psi_j\left(\frac{\theta_m(t_m)}{l_m(t_m)}\right) + m_{dm}\dot{l}_m^2(t_m)\frac{l_m(t_m) - \theta_m(t_m)}{l_m^4(t_m)}\psi_j'\left(\frac{\theta_m(t_m)}{l_m(t_m)}\right)\left[\frac{l_m(t_m) - \theta(t_m)}{l_m(t_m)}\psi_i'\left(\frac{\theta_m(t_m)}{l_m(t_m)}\right) - \psi_i\left(\frac{\theta_m(t_m)}{l_m(t_m)}\right)\right] \tag{143}$$

Dynamic Response

Consider the prototype elevator in Table 5 with $c_p=K_{vp}=0$. The parameters of the corresponding model elevator are given in Table 6 with $c_m=K_{vm}=0$; $m_{dm}=K_{nm}=0$. The first four natural frequencies of the prototype cable at the start of movement, and those predicted by the half and full models, are calculated from the discretized models of the stationary cables using 30 modes and the tensioned beam eigenfunctions, as shown in Table 9 below.

TABLE 9

Natural frequencies of the stationary prototype cable at the start of movement and those predicted by the half and full models

| Mode | Prototype | Half model | Error (%) | Full model (Hz) | Error |
|---|---|---|---|---|---|
| 1 | 0.31 | 0.302 | 2.83 | 0.300 | 3.47 |
| 2 | 0.621 | 0.604 | 2.78 | 0.600 | 3.46 |
| 3 | 0.932 | 0.906 | 2.69 | 0.899 | 3.44 |
| 4 | 1.242 | 1.210 | 2.57 | 1.200 | 3.40 |

Similarly, the first four natural frequencies of the prototype elevator at the end of movement, and those predicted by the half and full models, are shown in Table 10 below.

TABLE 10

Natural frequencies of the stationary prototype cable at the end of movement and those predicted by the half and full models

| Mode | Prototype (Hz) | Half Model (Hz) | Error | Full model | Error (%) |
|---|---|---|---|---|---|
| 1 | 2.027 | 2.212 | 9.1 | 2.110 | 4.1 |
| 2 | 4.055 | 4.532 | 11.7 | 4.250 | 4.8 |
| 3 | 6.083 | 7.057 | 16.0 | 6.449 | 6.0 |
| 4 | 8.111 | 9.868 | 21.7 | 8.736 | 7.7 |

While the prototype tension increases 17.1% from the top of the car to the sheave due to cable weight, the model tension decreases 0.34% and 0.64%, respectively, for the half and full models. The dimensionless bending stiffness of the prototype cable is $\Pi_{10p}=5.65\times10^{-9}$, and that for the half and full models is $\Pi_{10m}=3.72\times10^{-5}$ and $\Pi_{10m}=1.06\times10^{-5}$, respectively. While the dimensionless bending stiffness ($\Pi_{10}$) and the tension change due to cable weight ($\Pi_{11}$) are not fully scaled between the model and prototype, they have a secondary effect on the scaling between the model and prototype.

The half and full models under-estimate slightly the natural frequencies of the prototype cable when the cable is long (Table 9), because the effect of a larger tension increase in the prototype cable due to cable weight exceeds that of a relatively larger dimensionless bending stiffness of the model band. The half and full models over-estimate the natural frequencies of the prototype cable when the cable is short (Table 10), because the effect of a relatively larger dimensionless bending stiffness of the model band exceeds that of a larger tension increase in the prototype cable due to cable weight.

The error for the half model is smaller and larger than that for the full model in Tables 9 and 10, respectively, because the half model has a larger dimensionless bending stiffness than the full model. The dimensionless bending stiffness of the model band has a larger effect on the natural frequencies of the higher modes (Table 10).

The dynamic response of the prototype cable under the movement profile in FIG. 15, and that predicted by the model band, are calculated and compared. The initial displacement for the half model is the displacement of the band of length $l_{0m}=1.35$ m under uniform tension $T_{0m}$, subjected to a concentrated force at $x_m=b_m=0.3$ m with a deflection of 2.09 mm at the same location. The initial displacement of the prototype cable is scaled from that for the half model, with a maximum deflection of 0.25 m at $x_p=b_p=36$ m. The initial displacement for the full model is scaled from that of the prototype cable, with a maximum deflection of 3.91 mm at $x_m=b_m=0.5625$ m. The initial velocity is zero.

When the motor is at the top left position, the displacement and velocity of the prototype cable at $x_p=12$ m and those predicted by the half model are shown in FIGS. 17(*a*) and 17(*b*), respectively. The displacement and velocity of the prototype cable at $x_p=12$ m and those predicted by the full model are shown in FIGS. 18(*a*) and 18(*b*), respectively. While the amplitude of the displacement of a cantilever beam decreases during retraction, that of an elevator cable increases first and then decreases during upward movement.

The vibratory energy of the prototype cable and that predicted by the half model with the motor at the top or bottom left position are shown in FIG. 17(*c*). The vibratory energy of the prototype cable and that predicted by the full model with the motor at the top or bottom left position are shown in FIG. 18(*c*). The initial vibratory energy of the prototype cable is slightly higher than those predicted by the models because of a larger tension increase in the prototype cable due to its weight. The smaller the $b_p$ the larger the differences between the initial energy of the prototype cable and those predicted by the models.

In the initial stage of upward movement, the instantaneous frequency of the prototype cable is slightly higher than those predicted by the models, in agreement with Table 9. During upward movement the effect of a larger tension increase in the prototype cable due to its weight decreases and that of a larger dimensionless bending stiffness of the model band increases; the instantaneous frequencies and energies of the prototype cable, predicted by the models, increase faster in general than its actual values. In the final stage of upward movement, the instantaneous frequencies of the prototype cable, predicted by the models, exceed its actual values, in agreement with Table 10.

Depending on the differences between the initial energy of the prototype cable and those predicted by the models, the final energies of the prototype cable, predicted by the models, can be higher or lower than its actual value. The final energies of the prototype cable, predicted by the half models, as shown in FIG. 17(*c*), are slightly higher than those predicted by the full models in FIG. 18(*c*) because the half models have a relatively larger dimensionless bending stiffness. With $E_p(t_p)$ and $E_{mp}(t_p)$ denoting the energy of the prototype cable and that predicted by a model, the error, defined by $$\varepsilon = \frac{\|E_{mp}(t_p) - E_p(t_p)\|}{\|E_p(t_p)\|},$$

where $\|\bullet\|$ is the $L_2$-norm evaluated in the entire period of motion, is 7.5% and 5.9%, respectively, for the half and full models with the motor at the top left position, and 5.8% and 6.7%, respectively, for the half and full models with the motor at the bottom left position.

When $c_p=0$ the dependence of the average vibratory energy, $$\frac{1}{t_{totalp}}\int_0^{t_{totalp}} E_p(t_p)\,dt_p,$$

of the prototype cable during upward movement on the damper location $l_{dp}$ and damping coefficient $K_{vp}$ is shown in FIG. 19(*a*), and the average vibratory energy of the uncontrolled cable is 32.425 J. The dependence of the final energy $E_p(t_{totalp})$ on $l_{dp}$ and $K_{vp}$ can be similarly obtained and $E_p(t_{totalp})$=80.465 J for the uncontrolled cable. With $l_{dp}$=2.5 m the optimal damping coefficient that minimizes the average energy is $K_{vp}$=2050 Ns/m, and the damper dissipates 83.8% and 88.6% of the average and final energy, respectively. With $l_{dp}$=2.5 m the optimal damping coefficient that minimizes the final energy is $K_{vp}$=375 Ns/m, and the damper dissipates 75.9% and 100% of the average and final energy, respectively. When $c_p$=0.0375 Ns/m the natural damping alone dissipates 62.4% and 79.1% of the average and final energy, respectively. The damper with $K_{vp}$=2050 Ns/m dissipates 72.2% and 99.9% of the average and final energy of the cable with natural damping, respectively, and is more effective when the cable is long (FIG. 8). The damper with $K_{vp}$=375 Ns/m dissipates 61.1% and 100% of the average and final energy of the cable with natural damping, respectively, and is more effective when the cable is short, as shown in FIGS. 23(*a*) and 23(*b*).

Optimal Damper

Two criteria can be used to design the optimal damper. One is to minimize the average energy during upward movement $$\left(E_{average} = \frac{\int_0^{t_{total}} E_v \, dt}{t_{total}}\right)$$

as discussed earlier for the forced vibration, and the other is to minimize the energy of the cable at the end of upward movement.

Any initial disturbance to the cable can be decomposed into a series of modes of the stationary cable with the initial length. Since the system is linear, the free vibration of the cable is the sum of the response to the initial disturbance for each mode. For a given damper location, the optimal damping coefficients that minimize the average energy during upward movement (or the final energy for the second criterion) for the initial displacements corresponding to the first 12 mode shapes of the stationary cable with the initial length is investigated. The initial velocity is assumed to be zero. The amplitude of the initial displacement corresponding to the first mode is 0.1 m and those for the higher modes are selected such that the undamped average energy during upward movement is the same as that for the first mode. Consider the case with the damper mounted at 2.5 m above the passenger car and the damping effects for different damping coefficients are calculated numerically based on the two criteria, as shown in FIGS. 20 (*a*) and 20 (*d*), based on the two criteria, where the damping effect is defined as the percent ratio of the damped average and final energy to and the undamped average and final energy.

From FIG. 20(*d*) the optimal damping coefficient based on the final energy varies from 400 to 150 Ns/m for disturbances corresponding to different modes of the cable, while the corresponding value based on the average energy during upward movement varies significantly more—from 2475 to 750 Ns/m, shown in FIG. 20(*a*). The damping effect varies with the mode number. The optimal damping coefficient to dissipate the first mode response is 2475 Ns/m, and it can dissipate about 77% of the average energy during upward movement and 99% of the final energy.

The average energy ratio and final energy ratio contours are obtained by varying the damper location and damping coefficient, as shown in FIGS. 19(*a*) and 19(*b*), respectively, where the initial disturbance corresponds to the $6^{th}$ mode of the stationary cable with the initial length. The results for the initial disturbances corresponding to other modes can be obtained similarly.

When there is no damper attached, the corresponding average energy and final energy are 300.7 J and 754.3 J, respectively. From the average energy viewpoint, the optimal damping coefficient for the damper location at 2.5 m above the passenger car is around 2500 Ns/m, and the higher the damper location the better the damping effect. In reality, the location of the damper is restricted due to space limitation and mounting difficulty. While from the final energy viewpoint, there exist several optimal locations and all of them can achieve minimum final energy. As shown in FIG. 19(*b*), the damping effect is almost 99% in a wide range, and the final energy is below 0.1 J. Practically, 95% damping effect is good enough, which implies the damper location and coefficient can be chosen from a wide range.

The simulations indicate that the average energy during upward movement is much harder to reduce and is more sensitive to the damper parameters than the final energy. The final energy can be effectively dissipated. The key question now is how to design an optimal damper based on the average energy criterion. It is more difficult to reduce the energy of the first mode first mode that those for the higher modes. Increasing the distance between the damper and car within the space limit can increase the damping effect.

The effect of the movement profile on the damping effect is also considered. FIGS. 20(*c*) and 20(*d*) show the average energy and final energy of the elevator cable, respectively, when the elevator moves upward from the ground floor to the mid floor of the building. FIGS. 20(*c*) and 20(*d*) show the average energy and final energy of the elevator cable, respectively, when the elevator moves upward from the mid floor to the top of the building. The initial disturbances considered correspond to the first 12 individual mode shapes, as discussed earlier, and the damper is installed at 2.5 m above the car. Note that the top floor here refers to the end floor of movement discussed earlier and the results for upward movement from the ground floor to the top floor of the building have been shown.

The optimal damping coefficients based on the average energy criterion for movement from the mid to the top floor of the building are lower than those from the ground to the top floor, because of the closer position of the damper in the former relative to the car. Similarly, when the elevator moves from the ground to the mid floor of the building, since the length of the cable is still quite large at the end of movement, the position of the damper is relatively close to the car and the optimal damping coefficients increase, as shown in FIG. 20(*c*). Generally speaking, the longer the final cable length the higher the optimal damping coefficient. This is confirmed for the cases in FIGS. 20(*b*) and 20(*c*), where the final cable lengths are 24 m and 81 m, respectively.

A damper installed close to the top of the building is also considered where one end of the damper is fixed to the wall and the other end contacts the cable. When the damper is 2.5 m away from the motor at the top of the building, the displacement and velocity of the cable at x=12 m and the vibratory energy are compared to those with the damper at 2.5 m above the car. The initial disturbance corresponds to the third mode shape of the cable and the movement profile is shown in FIG. 15. The results from the two methods, shown in FIG. 21, are close to each other and the damper above the car is slightly better than that below the motor pulley, because the presence of the damper guarantees a non-positive term in the rate of change of energy. The average energy ratio contour is, as shown in FIG. 22, obtained by varying the damper location and damping coefficient respectively, where the initial disturbance corresponds to the $6^{th}$ mode of the stationary cable with the initial length. The damping effect shown in FIG. 22 is slightly worse than that in FIG. 19(*a*).

The advantage of mounting the damper to the wall below the motor is that the method allows the damper to be mounted farther away from the top of the building. The distance between the damper and car is limited when the damper is mounted to the car because of the mounting difficulty. The disadvantage of the former is that there is relative slide between the damper and cable, which may cause friction related problems, such as abrasion.

Since the first mode response is the hardest one to reduce, the damping coefficient should be primarily determined by it. From the simulation, the optimal damping coefficient for the first mode is 2475 N·s/m, and the related damping effect is 76.6%. The corresponding damping effects of all the other modes are great than 88%. In FIG. 20(*a*) the ratio of the average energy versus the damping coefficient curve for the first mode becomes very flat when the damping effect exceeds 70%, which means the damping effect is not sensitive to the damping coefficient.

The damping effects for the higher modes are more sensitive to the damping coefficients than that for the first mode. The optimal damping coefficients of the higher modes vary from 600 to 2200 N·s/m. While the optimal damping coefficient can achieve at least 94% of the damping effect for the 6th and higher modes, by reducing slightly the damping coefficient, it can achieve at least 96% of the damping effect for those modes. For instance, when the damping coefficient is 1000Ns/m, the damping effect of the first mode is 74% and those of the 6th and higher modes will increase to 96%.

One could define two ranges of damping coefficients. The first one satisfies the required damping effect for the interested lower modes and the second one satisfies that for the interested higher modes. The intersection of the two ranges is the optimal region for the damping coefficient. For the higher mode response, it is easy to achieve over 95% of the damping effect.

Experimental Setup

A schematic of the experimental setup is shown in FIG. 24. The scaled elevator was instrumented and the half model was used in the experiments. The motor 300 was installed at the top left position in FIG. 14 and controlled by a controller 310, suitably an Acroloop controller board (Model ACR2000). A movement profile with a piecewise constant jerk function—−396.3 m/s$^3$ in regions 1 and 7, 396.3 m/s$^3$ in regions 3 and 5, and zero elsewhere—was prescribed using the motion control software Acroview. The calculated positions, velocities, and accelerations at the ends of regions 1 through 7 were also prescribed, and Acroview automatically generated the movement profile.

A PCB capacitive accelerometer 320 (Model 3701M28) was attached to the car 100 to measure its actual acceleration; the actual velocity and position of the car 100 were obtained by integrating the acceleration signal. An initial displacement device 330 was designed and fabricated. It provides a controlled initial displacement to the band, corresponding to the static deflection of the tensioned band under a line-force across its width at $x_m=b_m$, with a specified deflection $d_m$ at $x_m=b_m$. It uses two electromagnets: one attracts the device to a guide rail and the other locks the band in its initial deformation before movement.

At the start of movement the Acroloop controller 310 sends out two signals: one to the motor 300 to control its motion and the other to the dSPACE DS1103 PPC controller board 340. The dSPACE board 340 sends subsequently a signal to turn off the electromagnets in the initial displacement device 330, which simultaneously release the initial deformation of the band and attraction of the car 100 to the guide rail. The car 100 then falls along the guide rail under gravity. Note that $b_m$ is chosen to be sufficiently smaller than $l_{0m}$, so that the car 100 will not hit the initial displacement device 330 during movement.

The lateral displacement of the band at a spatially fixed point, $x_m=o_m$, was measured with a laser sensor 350, suitably a Keyence laser sensor (Model LC-2440), or a Lion Precision capacitance probe (Model C1-A) (not shown). The capacitance probe has a measurement range of 2 mm from peak to peak; the laser sensor 350 is used when the measured displacement exceeds this range. The dSPACE board 340 is also used as the data acquisition system for the capacitive accelerometer 320, the laser sensor 350, and the capacitance probe to record the time signals.

It was noted that when the power was turned off, the coils in the electromagnets in the initial displacement device generated an electrical impulse, which could affect the measurement from the capacitance probe. A diode was connected between the two poles of the electromagnets to release that impulse. It was also noted that the response of the electromagnets lags that of the motor by 0.027 s. To synchronize the motion of the motor 300 and the initial displacement device 330, a delay of 0.027 s was set for the motor 300. The same delay was also used for the capacitance accelerometer 320, the laser sensor 350, and the capacitance probe. The sampling rate and the record length of the dSPACE board 340 were set to 5000 Hz and 0.6 s, respectively.

The elastic modulus of the band was determined from a tensile test. The tension changes due to added weights were measured from a strain gage adhered to the band using a strain indicator. By using the measured natural frequencies of the stationary band for the half model, the band tension can be determined from its frequency equation. The tensioner in the scaled elevator was first adjusted so that the stationary band has a tension around the nominal value $T_{0m}$. The tensioner was further adjusted so that the frequencies of the measured response from the laser sensor 350 during upward movement match those of the calculated one using the measured movement profile and the associated tension, shown as solid lines in FIG. 25. The tension $T_{0vm}$ at the start of upward movement with constant velocity is hence set to $T_{0m}$.

Because a linear damper was not readily available, an Airpot damper (Model 2K160), satisfying approximately the velocity-squared damping law, was used as the damper 530. To attach the damper 530 to the car 100, an aluminum mount bolted to the car was created. It allows vertical adjustment of the damper 530 so that the location $l_{dm}$ can be varied.

Friction Estimation

The model frictions, $F_u$, $F_e$, and $F_g$, are estimated using the tension relations discussed above. A strain gage was adhered to the band at the top of the car and a Spectral Dynamics dynamic signal analyzer (Siglab) was used to record the strain measurement. The absolute band tension cannot be determined from the strain gage, as the state of zero band tension cannot be found. This occurs because the band is initially wound with a pre-curvature; some tension is needed to straighten it. The elevator 100 was run upward and downward with a slow, constant velocity around 0.1 m/s in the region $l_m \in [0.5, 1.2]$ m. Let $T_{0vm}^{up}$ and $T_{0vm}^{down}$ be the tensions at the top of the car 100 during upward and downward movements, respectively.

The relation between $T_{0vm}^{up}$ and $l_m$ is given by (133), with $T_{0vm}$ replaced by $T_{0vm}^{up}$. The relation between $T_{0vm}^{down}$ and $l_m$ is given by (133), with $T_{0vm}$ replaced by $T_{0vm}^{down}$ and the signs of $F_u$, $F_e$, and $F_g$ reversed. When the car 100 travels to the same location during upward and downward movements, $l_m$ is the same in the two relations. Since $\Delta l_m$ remains unchanged, subtracting one relation from the other yields $$(T_{0vm}^{up}-T_{0vm}^{down})l_{totalm}=2F_e(l_{6m}+l_{7m})-2F_g(l_{2m}+l_{3m}+l_{4m}+l_{5m})-2F_u(l_{3m}+2l_{4m}+3l_{5m}-l_{6m}) \quad (144)$$

We first dismount the band guide. Hence $F_g=0$ and (144) becomes $$(T_0^{up}-T_{0vm}^{down})=2F_e(l_{6m}+l_{7m})-2F_u(l_{3m}+2l_{4m}+3l_{5m}-l_{6m}) \quad (145)$$

The tension difference $\Delta T=T_{0vm}^{up}-T_{0vm}^{down}$ was measured nine times using the strain gage and its average as a function of $l_{7m}$ is shown in FIG. 25 as a dotted line. Since this signal contains the effects of the longitudinal vibration of the band and the non-smooth motion of the motor 300, which have higher frequencies and are not modeled in the tension relations, a low-pass filter with a corner frequency of 10 Hz was used and the filtered signal is shown as a dashed line in FIG. 25. A linear curve-fit of the filtered signal yields a straight line, $\Delta T=2.46\, l_{7m}-2.26$, shown as a solid line in FIG. 22.

By $$\frac{2F_e}{l_{totalm}} = 2.46 \text{ and } 2[(F_e + F_u)l_{6m} - F_u(l_{3m} + 2l_{4m} + 3l_{5m})] = -2.26,$$

from which we obtain $F_e=10.1$ N and $F_u=3.2$ N. The above procedure is then applied to the model with the band guide. Since the sensitivity of the strain gage is around 1 N and $F_g$ is very small, $F_g$ cannot be accurately determined. An estimate of 1.5 N is used for $F_g$.

Damping Estimation

The natural damping coefficient for the half model is determined experimentally from essentially the first mode response of the stationary band. The damping coefficient of the band of length $l_m$ is expressed in the form $$c_m(l_m)=2\zeta_m(l_m)\omega_{1m}(l_m) \quad (146)$$

where $\zeta_m(l_m)$ is the damping ratio and $\omega_{1m}(l_m)$ is the first natural frequency. For each value of $l_m$ from 0.55 m to 1.35 m with a 0.05 m increment, the band was provided with an initial displacement through the initial displacement device at the center of the band, with a deflection of 1.1 mm at that location. The lateral displacement of the band at $x_m=0.1$ m, which is dominated by the first mode, was measured with the laser sensor. By matching the frequency of the calculated response with that of the measured one, one can determine the band tension. By matching the amplitudes of the calculated response with those of the measured one, one can determine $\zeta_m(l_m)$, as shown in FIG. 26.

For instance, when $l_m=0.9$ m, the band tension and $\zeta_m$ are found to be 138 N and 0.0025, respectively, and the measured response is in good agreement with the calculated one (FIG. 13(*a*)). When $l_m=1.35$ m, the band tension and $\zeta_m$ are 147 N and 0.0015, respectively. The tensions are different in the two cases due to different static frictions. A linear curve-fit of the data in FIG. 26 yields $$\zeta_m(l_m)=0.00561-0.00303l_m \quad (147)$$

The natural damping coefficient given by (134) and (135), where $\omega_{1m}(l_m)$ is determined from the frequency equation of the stationary band of length $l_m$ under uniform tension $T_{0am}$, is used in the entries of D in (128) to predict the response of the moving band with natural damping. A constant natural damping coefficient, $c_m=0.1425$ Ns/m$^2$, which can yield a similar response of the moving band, is considered as the averaged natural damping coefficient and used for the half model in Table 6.

The damping coefficient $K_{nm}$ of the damper 530 is determined similarly from a stationary band with an average length of 0.7 m during movement. It was subjected to an initial displacement through the initial displacement device at the center of the band, with a deflection of 1.6 mm at that location. The lateral response of the band at $x_m=0.1$ m, which is dominated by the first mode, was measured with the laser sensor. Due to the relatively large damping the frequency of the response is affected by $K_{nm}$. By matching simultaneously the frequency and the amplitudes of the calculated response with those of the measured one, we found the band tension and $K_{nm}$ to be 161 N and 120 Ns$^2$/m$^2$, respectively, and the measured response is in good agreement with the calculated one when the natural damping is included, as shown in FIGS. 27(*a*) and 27(*b*).

Results

The measured and prescribed movement profiles of the band are shown as solid and dashed lines in FIG. 28(*a-c*), respectively. The calculated tension $T_{0am}$ using the measured and prescribed movement profile is shown as the solid and dashed line in FIG. 28(*d*), respectively. When $T_{0m}=142.5$ N, $b_m=0.3$ m, $d_m=1.6$ mm, and $o_m=0.1$ m, the measured, uncontrolled displacement of the band from the laser sensor, under the movement profile in FIG. 28(*a-c*), is shown as a solid line in FIG. 29(*a*). With $l_{dm}=0.07$ m and $m_{dm}=0.004$ kg the measured, controlled response of the band is shown as a solid line in FIG. 29(*b*).

The calculated, uncontrolled displacement of the band at $x_m=0.1$ m, using the measured movement profile and the associated calculated tension in FIG. 28, is shown as a dashed line in FIG. 29(*a*) and is in good agreement with the measured one. Because the band wobbles slightly during the movement, some torsional vibration was measured from the laser sensor 350, as indicated in FIG. 29(*a*).

The torsional vibration is less manifested in the measurement from the capacitance probe because it has a larger measurement area. By matching the calculated, controlled displacement of the band at $x_m=0.1$ m, using the measured movement profile and the associated calculated tension, with the measured one, we found $T_{0vm}=150$ N. The nominal tension of the controlled band differs slightly from that of the uncontrolled one because the two experiments were conducted at different times and some tilt of the band can result in a different tension. The calculated, controlled response, shown as a dashed line in FIG. 29(*b*), is in good agreement with the measured one. While the calculated displacement vanishes when $t_m>0.45$ s, some residual vibration arising from ambient excitation during movement exists in the measured one.

The vibratory energy of the uncontrolled band with and without natural damping, using the measured movement profile and the associated calculated tension in FIG. 28, is shown as the solid and dotted line in FIG. 29(*c*), respectively. While the natural damping dissipates 50.1% of the average energy of the band during upward movement, the average energy density of the band defined by $$\frac{E_m(t_m)}{l_m(t_m)}$$

is six times higher at the end of movement than that at the start of movement. The damper 530 dissipates 86.9% of the average energy of the band with natural damping, and the average energy density at the end of movement is 0.006% of that at the start of movement.

Damper for Elevator System

Based on the above analysis, different damper configurations for an elevator cable will now be presented. FIGS. 30(*a*) and 30(*b*) are schematic diagrams of a vibration dampened 1:1 traction elevator system with a rigid and soft suspension, respectively, in which an elevator mounted damper is used for vibration damping, in accordance with the present invention. In the elevator system of FIG. 30(*a*), the elevator car 100 is rigidly mounted to the guide rails (not shown) on the rigid member 130 via a slide mechanism 120. In the elevator system of FIG. 30(*b*), a soft suspension system 500 is used between the car 100 and the slide mechanism 120.

In both systems, the cable 110 is fed through a single pulley/motor 510, and a counterweight 520 is attached to the end of the cable 110. The general operation of this type of elevator system is well known in the art, and thus will not be discussed.

An elevator mounted damper 530 is used to dampen vibrations in the elevator cable 110. One end of the elevator mounted damper 530 is attached to the cable 110, and the other end of the elevator mounted damper 530 is attached to the elevator car 100. The elevator mounted damper 530 is preferably attached to the cable 110 at a position such so as to not unduly limit the height that the car 100 can be lifted to due to interference between the elevator mounted damper 530 and any other devices, such as other dampers and/or the pulley/motor 510. However, this consideration should be balanced with the need to dampen vibrations, as low frequency vibrations can typically be better dampened by making the distance between the elevator mounted damper 530 and the elevator car 100 relatively large (e.g., greater than 2.5 meters).

FIGS. 31(*a*) and 31(*b*) are schematic diagrams of a vibration dampened 1:1 traction elevator system with a rigid and soft suspension, respectively, in which a movable damper 540 is used for vibration damping, in accordance with the present invention. FIG. 31(*c*) is a schematic diagram of a preferred embodiment of the movable damper 540.

The movable damper 540 includes a damper 550, a slider mechanism 560 attached to one end of the damper 550 for movably attaching the movable damper 550 to the cable 110, and a car 570 attached to another end of the damper 550. The slider mechanism 560 preferably comprises a frame 562 and a pair of rollers 564, with the two rollers 564 positioned on opposite sides of the cable 110.

The car 570 rides on the elevator guide rails 580 via a slide mechanism 120, such as bearings. The car 570 preferably moves the damper up and down the cable 110 in response to signals from a controller 590. The controller 590 communicates with the power source that moves the car 570 via a communication link 600, which can be a wireless or wired link. The controller 590 preferably controls the position of the movable damper 540 so as to achieve optimum dissipation of vibratory energy in the cable.

The car 570 can include a motor (not shown) so that it is self-powered under guidance from the controller 590. However, other methods can be used to move the car 570, as shown FIGS. 32(*a*)-32(*f*).

FIGS. 32(*a*) and 32(*b*) are schematic diagrams of the vibration dampened 1:1 traction elevator system with a rigid and soft suspension, respectively, in which the movable damper 540 is moved via an external motor, in accordance with the present invention. In this embodiment, the car 570 is moved by motor 602 and cable 604 under control of the controller 590 (shown in FIG. 28(*c*)).

FIGS. 32(*c*) and 32(*d*) are schematic diagrams of the vibration dampened 1:1 traction elevator system with a rigid and soft suspension, respectively, in which the movable damper 540 is moved via a pulley 606 and cable 604 that are driven by the pulley/motor 510 through a transmission 608, in accordance with the present invention.

FIGS. 32(*e*) and 32(*f*) are schematic diagrams of the vibration dampened 1:1 traction elevator system with a rigid and soft suspension, respectively, in which the movable damper 540 is rigidly attached to the elevator cable 110, in accordance with the present invention. Unlike the embodiments shown in FIGS. 32(*a*)-32(*d*), the movable dampers 540 in these embodiments do not move independently of the elevator car 100.

In the embodiments of FIGS. 32(*e*) and 32(*f*), the movable damper 540 is supported by a rod 609 that is connected to the elevator car 100 and the car 570 with pin connects 612. The movable damper 540 moves on the guide rails 580 (shown in FIG. 31(*c*)) as the elevator car 100 moves up and down.

FIGS. 33(*a*) and 33(*b*) are schematic diagrams of a vibration dampened 1:1 traction elevator system with a rigid and soft suspension, respectively, in which a fixed damper 610 is used for vibration damping, in accordance with the present invention. As shown in FIG. 34, the fixed damper 610 includes a damper 550, with one side of the fixed damper 610 rigidly attached to the rigid member 130 and the other side of the rigid damper 610 attached to the cable 110 with a slide mechanism 560, similar to the slide mechanism 560 shown in FIG. 31(*c*).

The fixed damper 610 is preferably attached to the rigid member 130 at a position so as to not unduly limit the height that the car 100 can be lifted to due to interference between any other devices, such as the fixed damper 610, any other dampers and the elevator car 100. However, as discussed above, this consideration should be balanced with the need to dampen vibrations, as low frequency vibrations can typically be better dampened by making the distance between the pulley/motor 510 and the fixed damper 610 relatively large (e.g., greater than 2.5 meters). During movement of the elevator car 100, the cable 110 slides up and down the slide mechanism 560 thereby allowing the fixed damper 610 to remain in one position relative to the rigid member 130.

FIGS. 35(*a*) and 35(*b*) are schematic diagrams of a vibration dampened 2:1 traction elevator system with a rigid and soft suspension, respectively, in accordance with the present invention. In the elevator system of FIG. 35(*a*), the elevator car 100 is rigidly mounted to the guide rails (not shown) on the rigid member 130 via a slide mechanism 120. In the elevator system of FIG. 35(*b*), a soft suspension system 500 is used between the car 100 and the slide mechanism 120.

In both systems, the cable 110 is rigidly attached at a first end 620, is fed through pulley 630, pulley/motor 640, pulley 650, and is rigidly attached at a second end 660. Pulley 630 is attached to the elevator car 100, and pulley 650 is attached to the counterweight 520. The general operation of this type of elevator system is well known in the art, and thus will not be discussed.

In the embodiments of FIGS. 35(*a*) and 35(*b*), two elevator mounted dampers 670 and 680 are used for vibration damping. One side of damper 670 is attached to the cable 110 at one side of the pulley 630 and one side of damper 680 is attached to the cable 110 at an opposite side of the pulley 630. Both dampers 670 and 680 are preferably attached to the cable 110 using the same type of slide mechanism 560 shown and described in connection with FIG. 34. The other side of the dampers 670 and 680 are rigidly attached to the elevator car 100, using any method know in the art.

The elevator mounted dampers 670 and 680 are preferably attached to the cable 110 at positions so as to not unduly limit the height that the car 100 can be lifted to due to interference between the elevator mounted dampers 670 and 680 and any other devices, such as the structure to which the first end 620 of the cable 110 is attached, as well as the pulley/motor 640 and any other dampers used. However, as discussed above, this consideration should be balanced with the need to dampen vibrations, as low frequency vibrations can typically be better dampened by making the distance between the elevator mounted dampers 670 and 680 and the elevator car 100 relatively large (e.g., greater than 2.5 meters).

FIGS. 36(*a*) and 36(*b*) are schematic diagrams of a vibration dampened 2:1 traction elevator system with a rigid and soft suspension, respectively, in which movable dampers 540*a* and 540*b* are used for vibration damping, in accordance with the present invention. An explanation of the operation and attachment of the movable dampers 540*a* and 540*b* was provided above in connection with FIG. 31(*c*). Movable dampers 540*a* and 540*b* are attached to the cable 110 at opposing sides of pulley 630 using the slider mechanism 560 discussed above.

Referring back to FIG. 31(*c*), the car 570 preferably moves the movable dampers 540*a* and 540*b* up and down the cable 110 in response to signals from a controller 590. The controller 590 communicates with the car 570 via a communication link 600, which can be a wireless or wired link. The controller 590 preferably controls the position of the movable dampers 540*a* and 540*b* so as to achieve optimum dissipation of vibratory energy in the cable.

The car 570 can be powered/moved using any of the methods discussed above in connection with the 1:1 traction elevator system.

FIGS. 37(*a*) and 37(*b*) are schematic diagrams of a vibration dampened 2:1 traction elevator system with a rigid and soft suspension, respectively, in which fixed dampers 610*a* and 610*b* are used for vibration damping. The fixed dampers 610*a* and 610*b* are of the same type as that shown in FIG. 34. The fixed dampers 610*a* and 610*b* are attached to the cable 110 at opposing sides of the pulley 630 using the slide mechanism 560 discussed above in connection with FIG. 31(*c*).

The fixed dampers 610 are preferably attached to the rigid member 130 at a position so as to not unduly limit the height that the car 100 can be lifted to due to interference between the fixed damper 610*b* (the fixed damper farthest away from the first end 620 of the cable 110) and any other devices, such as the elevator car 100 and any other dampers used. However, as discussed above, this consideration should be balanced with the need to dampen vibrations, as low frequency vibrations can typically be better dampened by making the distance between the first end 620 of the cable 110 and fixed dampers 610*a* and 610*b* relatively large (e.g., greater than 2.5 meters). During movement of the elevator car 100, the cable 110 slides up and down the slide mechanisms 560 thereby allowing the fixed dampers 610*a* and 610*b* to remain in one position relative to the rigid member 130.

FIGS. 38(*a*) and 38(*b*) are schematic diagrams of a vibration damped 2:1 traction elevator systems with a rigid and soft suspension, respectively, utilizing a single elevator mounted damper 560, in accordance with the present invention. Each side of the single elevator mounted damper 690 is attached to the cable 110, with slider mechanisms 560, at opposing sides of the pulley 630. The elevator mounted damper 690 is preferably attached to the cable 110 at a position so as to not unduly limit the height that the car 100 can be lifted to due to interference between the elevator mounted damper 690 and any other devices, such as the structure to which the first end 620 of the cable 110 is attached to. However, as discussed above, this consideration should be balanced with the need to dampen vibrations, as low frequency vibrations can typically be better dampened by making the distance between the elevator mounted damper 690 and the pulley 630 relatively large (e.g., greater than 2.5 meters).

The damping coefficients of all of the above-discussed dampers are preferably set so as to as achieve optimum dissipation of vibratory energy in the cable 110, using the analysis and techniques discussed above. As discussed above, in the case movable dampers 540, the position(s) of the movable damper(s) 540 are preferably adjusted as needed to achieve optimum dissipation of vibratory energy. Also, any type of damper can be used including, but not limited to, hydraulic dampers, oil dampers, air dampers, friction dampers, linear viscous dampers, rotationary dampers and nonlinear dampers. However, the preferred type of damper is one that approximately satisfies the linear viscous damping law or the velocity-squared law.

Further, although the above embodiments illustrated the different type of damper mounting techniques in isolation, it should be appreciated that these different types of dampers and mounting mechanisms may be combined in one elevator system. For example, one or more movable dampers 540 and one or more fixed dampers 610 may be used together in one elevator system. Similarly, one or more fixed dampers 610 in combination with one or more elevator mounted dampers 530 may be used together in one elevator system. Generally, any combination of dampers and mounting mechanisms that achieve a desired level of vibration damping may be used.

FIG. 39 is a flowchart of a preferred method for determining the optimum damper placement and damping coefficients, in accordance with the present invention. The method starts at step 700, where the physical parameters of the elevator system are determined. As discussed above, the physical parameters preferably include the linear density of the elevator cable, the bending stiffness of the elevator cable, the mass of the elevator car and the stiffness of the elevator car suspension.

The method then proceeds to step 710, where the movement profile of the elevator is determined. As discussed above, the movement profile of the elevator preferably includes maximum velocity, maximum acceleration, initial car position, final car position and total travel time.

Next, at step 720, the excitation parameters of the elevator system are determined. As discussed above, excitation can come from building sway, pulley eccentricity, and guide-rail irregularity. Next, at step 730, the mounting position of the damper or dampers is chosen. As discussed above, the damper can be mounted in various locations and using various techniques.

Then, at step 740, the vibratory energy of the cable is calculated based on the movement profile, the excitation parameters and the position of the damper or dampers. As discussed above, the vibratory energy may be calculated using a string model or a beam model.

Next, at step 750, the optimum damping coefficient for the damper or dampers are determined based on the position of the damper or dampers and the calculated vibratory energy. At step 760, it is determined whether the optimal damping coefficients calculated in step 750 result in a vibratory energy profile that will meet the design requirements of the elevator system. If so, the method stops at step 770. Otherwise, the method jumps back to step 730, where the number of dampers and/or the mounting position of the damper or dampers are changed.

The foregoing embodiments and advantages are merely exemplary, and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. Various changes may be made without departing from the spirit and scope of the present invention, as defined in the following claims. For example, although the present invention was illustrated and described using a 1:1 traction elevator system and 2:1 traction elevator system, it should be appreciated that the present invention can be applied to any type of elevator system. Further, although several specific mounting positions and techniques were illustrated above, the present invention should not be so limited. Different mounting techniques and mounting positions may be used without departing from the spirit and scope of the present invention.

What is claimed is:

1. An elevator system, comprising:

an elevator cable;

an elevator car supported by the elevator cable; and at least one viscous damper attached to the cable, wherein damping coefficients of the at least one viscous damper are configured to reduce lateral vibratory energy in the elevator cable;

wherein the at least one viscous damper comprises a movable viscous damper having a first end movably attached to the elevator cable and a second end movably attached to guide rails, the movable viscous damper being configured to reduce lateral vibratory energy in the elevator cable by imparting a damping force to the elevator cable at the first end of the viscous damper responsive to a movement of the first end of the viscous damper relative to the second end of the viscous damper, and wherein at least a component of movement of the first end of the viscous damper relative to the second end of the viscous damper occurs along a direction of movement perpendicular to the elevator cable;

wherein the movable damper comprises a drive system configured to move the moveable damper along the guide rails independently of a movement of the elevator car.

2. The system of claim 1, further comprising a controller configured to output signals to the drive system of the moveable viscous damper to control the position of the movable viscous damper relative to the elevator car.

* * * * *